US008002623B2

(12) United States Patent
Resnick et al.

(10) Patent No.: US 8,002,623 B2
(45) Date of Patent: Aug. 23, 2011

(54) METHODS AND DEVICES FOR DISPLAYING MULTIPLE GAME ELEMENTS

(75) Inventors: Joseph Resnick, Reno, NV (US); Steven G. LeMay, Reno, NV (US); Jamal Benbrahim, Reno, NV (US); Richard E. Rowe, Reno, NV (US); Bryan D. Wolf, Reno, NV (US)

(73) Assignee: IGT, Reno, NV (US)

( * ) Notice: Subject to any disclaimer, the term of this patent is extended or adjusted under 35 U.S.C. 154(b) by 1379 days.

(21) Appl. No.: 11/481,666

(22) Filed: Jul. 5, 2006

(65) Prior Publication Data

US 2006/0287058 A1 Dec. 21, 2006

Related U.S. Application Data

(60) Provisional application No. 60/752,014, filed on Dec. 19, 2005.

(51) Int. Cl.
*A63F 9/24* (2006.01)

(52) U.S. Cl. ..... 463/19; 463/12; 463/13; 463/42

(58) Field of Classification Search ..... 463/19, 463/12, 13, 17
See application file for complete search history.

(56) References Cited

U.S. PATENT DOCUMENTS

| | | | |
|---|---|---|---|
| 3,671,041 | A | 6/1972 | Taylor et al. |
| 4,332,389 | A | 6/1982 | Loyd, Jr. et al. |
| 4,365,810 | A | 12/1982 | Richardson |
| 4,373,726 | A | 2/1983 | Churchill et al. |
| 4,455,025 | A | 6/1984 | Itkis |
| 4,572,509 | A | 2/1986 | Sitrick |
| 4,624,462 | A | 11/1986 | Itkis |
| 4,634,126 | A | 1/1987 | Kimura |
| 4,798,387 | A | 1/1989 | Richardson |
| 4,823,345 | A | 4/1989 | Daniel et al. |
| 4,848,771 | A | 7/1989 | Richardson |
| 4,856,787 | A | 8/1989 | Itkis |
| 4,885,703 | A | 12/1989 | Deering |
| 4,914,607 | A | 4/1990 | Takanashi et al. |
| 4,986,543 | A | 1/1991 | Heller |
| 5,007,649 | A | 4/1991 | Richardson |

(Continued)

FOREIGN PATENT DOCUMENTS

AU 200179477 A1 5/2002

(Continued)

OTHER PUBLICATIONS

PowerVR (PowerVR), 3D Graphical Processing, Nov. 14, 2000, © Power VR 2000.

(Continued)

*Primary Examiner* — Pierre E Elisca
(74) *Attorney, Agent, or Firm* — Weaver Austin Villeneuve & Sampson LLP

(57) ABSTRACT

This invention provides methods and devices for presenting a plurality of game elements on one or more display devices. The game elements may comprise, for example, bingo cards, playing cards, hands of playing cards, etc. Some implementations of the invention involve displaying a plurality of game elements as surfaces of a three-dimensional object. Preferably, the orientation of the three-dimensional object can be varied to display selected game elements. The game elements may be selected by a player and/or by a logic device. In some implementations, the three-dimensional object comprises a "carousel" that can be re-oriented (e.g., rotated) to display game elements.

36 Claims, 19 Drawing Sheets

U.S. PATENT DOCUMENTS

| | | | |
|---|---|---|---|
| 5,092,598 | A | 3/1992 | Kamille |
| 5,192,076 | A | 3/1993 | Komori |
| 5,227,771 | A | 7/1993 | Kerr et al. |
| 5,242,163 | A | 9/1993 | Fulton |
| 5,255,352 | A | 10/1993 | Faulk |
| 5,297,802 | A | 3/1994 | Pocock et al. |
| 5,303,388 | A | 4/1994 | Kreitman et al. |
| 5,339,390 | A | 8/1994 | Robertson et al. |
| 5,342,047 | A | 8/1994 | Heidel et al. |
| 5,351,970 | A | 10/1994 | Fioretti |
| 5,393,057 | A | 2/1995 | Marnell, II |
| 5,407,199 | A | 4/1995 | Gumina |
| 5,435,554 | A | 7/1995 | Lipson |
| 5,455,904 | A | 10/1995 | Bouchet et al. |
| 5,469,536 | A | 11/1995 | Blank |
| 5,485,197 | A | 1/1996 | Hoarty |
| 5,594,844 | A | 1/1997 | Sakai et al. |
| 5,604,852 | A | 2/1997 | Watters et al. |
| 5,608,850 | A | 3/1997 | Robertson |
| 5,611,729 | A | 3/1997 | Schumacher et al. |
| 5,621,906 | A | 4/1997 | O'Neill et al. |
| 5,639,088 | A | 6/1997 | Schneider et al. |
| 5,643,086 | A | 7/1997 | Alcorn et al. |
| 5,678,015 | A | 10/1997 | Goh |
| 5,689,628 | A | 11/1997 | Robertson |
| 5,729,673 | A | 3/1998 | Cooper et al. |
| 5,742,779 | A | 4/1998 | Steele et al. |
| 5,745,109 | A | 4/1998 | Nakano et al. |
| 5,755,621 | A | 5/1998 | Marks et al. |
| 5,766,074 | A | 6/1998 | Cannon et al. |
| 5,775,993 | A | 7/1998 | Fentz et al. |
| 5,788,573 | A | 8/1998 | Baerlocher et al. |
| 5,805,783 | A | 9/1998 | Ellson et al. |
| 5,807,172 | A | 9/1998 | Piechowiak |
| 5,816,918 | A | 10/1998 | Kelly et al. |
| 5,833,540 | A | 11/1998 | Miodunski et al. |
| 5,836,819 | A | 11/1998 | Ugawa |
| 5,880,733 | A | 3/1999 | Horvitz et al. |
| 5,903,271 | A | 5/1999 | Bardon et al. |
| 5,912,671 | A | 6/1999 | Oka |
| 5,934,672 | A | 8/1999 | Sines et al. |
| 5,941,772 | A | 8/1999 | Paige |
| 5,956,038 | A | 9/1999 | Rekimoto |
| 5,967,895 | A | 10/1999 | Kellen |
| 5,998,803 | A | 12/1999 | Forrest et al. |
| 6,002,403 | A | 12/1999 | Sugiyama et al. |
| 6,002,853 | A | 12/1999 | de Hond |
| 6,005,579 | A | 12/1999 | Suglyama et al. |
| 6,009,458 | A | 12/1999 | Hawkins et al. |
| 6,012,984 | A | 1/2000 | Roseman |
| 6,014,142 | A | 1/2000 | LaHood |
| 6,023,371 | A | 2/2000 | Onitsuka et al. |
| 6,027,115 | A | 2/2000 | Griswold et al. |
| 6,029,973 | A | 2/2000 | Takemoto |
| 6,031,545 | A | 2/2000 | Ellenby et al. |
| 6,033,307 | A | 3/2000 | Vancura |
| 6,043,818 | A | 3/2000 | Nakano et al. |
| 6,050,895 | A | 4/2000 | Luciano et al. |
| 6,057,856 | A | 5/2000 | Miyashita et al. |
| 6,062,978 | A | 5/2000 | Martino et al. |
| 6,080,063 | A | 6/2000 | Khosla |
| 6,089,976 | A | 7/2000 | Schneider et al. |
| 6,089,978 | A | 7/2000 | Adams |
| 6,093,100 | A | 7/2000 | Singer et al. |
| 6,094,196 | A | 7/2000 | Berry et al. |
| 6,104,815 | A | 8/2000 | Alcorn et al. |
| 6,106,396 | A | 8/2000 | Alcorn et al. |
| 6,131,909 | A | 10/2000 | Chilese |
| 6,135,884 | A | 10/2000 | Hedrick et al. |
| 6,149,156 | A | 11/2000 | Feola |
| 6,149,522 | A | 11/2000 | Alcorn et al. |
| 6,159,095 | A | 12/2000 | Frohm et al. |
| 6,168,521 | B1 | 1/2001 | Luciano et al. |
| 6,183,361 | B1 | 2/2001 | Cummings et al. |
| 6,203,009 | B1 | 3/2001 | Sines et al. |
| 6,203,428 | B1 * | 3/2001 | Giobbi et al. ..... 463/16 |
| 6,206,782 | B1 | 3/2001 | Walker et al. |
| 6,220,593 | B1 | 4/2001 | Pierce et al. |
| 6,234,901 | B1 | 5/2001 | Nagoshi et al. |
| 6,254,483 | B1 | 7/2001 | Acres et al. |
| 6,267,669 | B1 | 7/2001 | Luciano, Jr. et al. |
| 6,271,842 | B1 | 8/2001 | Bardon et al. |
| 6,280,325 | B1 | 8/2001 | Fisk |
| 6,287,201 | B1 | 9/2001 | Hightower |
| 6,315,666 | B1 | 11/2001 | Mastera et al. |
| 6,319,128 | B1 | 11/2001 | Miyoshi et al. |
| 6,331,146 | B1 | 12/2001 | Miyamoto et al. |
| 6,332,838 | B1 | 12/2001 | Yamagami |
| 6,342,892 | B1 | 1/2002 | Van Hook et al. |
| 6,346,956 | B2 | 2/2002 | Matsuda |
| 6,347,999 | B1 | 2/2002 | Yuan |
| 6,390,470 | B1 | 5/2002 | Huang |
| 6,398,218 | B1 | 6/2002 | Vancura |
| 6,409,602 | B1 | 6/2002 | Wiltshire et al. |
| 6,409,604 | B1 | 6/2002 | Matsuno |
| 6,413,162 | B1 | 7/2002 | Baerlocher et al. |
| 6,431,982 | B2 | 8/2002 | Kobayashi |
| 6,454,649 | B1 | 9/2002 | Mattice et al. |
| 6,458,032 | B1 | 10/2002 | Yamagami |
| 6,506,114 | B1 | 1/2003 | Estes et al. |
| 6,508,709 | B1 | 1/2003 | Karmarkar |
| 6,512,522 | B1 | 1/2003 | Miller et al. |
| 6,515,688 | B1 | 2/2003 | Berry et al. |
| 6,517,433 | B2 | 2/2003 | Loose et al. |
| 6,524,185 | B2 | 2/2003 | Lind |
| 6,533,273 | B2 | 3/2003 | Cole et al. |
| 6,537,150 | B1 | 3/2003 | Luciano |
| 6,542,168 | B2 | 4/2003 | Negishi et al. |
| 6,559,863 | B1 | 5/2003 | Megiddo |
| 6,569,017 | B2 | 5/2003 | Enzminger et al. |
| 6,570,587 | B1 | 5/2003 | Efrat et al. |
| 6,577,330 | B1 | 6/2003 | Tsuda et al. |
| 6,597,358 | B2 | 7/2003 | Miller |
| 6,597,380 | B1 | 7/2003 | Wang et al. |
| 6,626,760 | B1 | 9/2003 | Miyamoto et al. |
| 6,628,310 | B1 | 9/2003 | Hiura et al. |
| 6,641,478 | B2 | 11/2003 | Sakai |
| 6,645,070 | B2 | 11/2003 | Lupo |
| 6,656,040 | B1 | 12/2003 | Brosnan et al. |
| 6,656,044 | B1 | 12/2003 | Lewis |
| 6,661,426 | B1 | 12/2003 | Jetha et al. |
| 6,667,741 | B1 | 12/2003 | Kataoka et al. |
| 6,700,588 | B1 | 3/2004 | MacInnis et al. |
| 6,734,884 | B1 | 5/2004 | Berry et al. |
| 6,746,329 | B1 | 6/2004 | Duhamel |
| 6,760,050 | B1 | 7/2004 | Nakagawa |
| 6,769,982 | B1 | 8/2004 | Brosnan |
| 6,772,195 | B1 | 8/2004 | Hatleid et al. |
| 6,802,776 | B2 | 10/2004 | Lind et al. |
| 6,811,482 | B2 | 11/2004 | Letovsky |
| 6,822,662 | B1 | 11/2004 | Cook et al. |
| 6,840,858 | B2 | 1/2005 | Adams |
| 6,847,162 | B2 | 1/2005 | Duggal et al. |
| 6,866,585 | B2 | 3/2005 | Muir |
| 6,887,157 | B2 | 5/2005 | LeMay et al. |
| 6,902,481 | B2 | 6/2005 | Breckner et al. |
| 6,922,815 | B2 | 7/2005 | Rosen |
| 6,938,218 | B1 | 8/2005 | Rosen |
| 6,942,571 | B1 | 9/2005 | McAllister et al. |
| 7,008,324 | B1 | 3/2006 | Johnson et al. |
| 7,009,611 | B2 | 3/2006 | Di Lelle |
| 7,034,825 | B2 | 4/2006 | Stowe et al. |
| 7,070,504 | B2 | 7/2006 | Iwamoto |
| 7,179,166 | B1 | 2/2007 | Abbott |
| 7,192,345 | B2 | 3/2007 | Muir et al. |
| 7,241,221 | B1 | 7/2007 | Luciano et al. |
| 7,291,068 | B2 * | 11/2007 | Bryant et al. ..... 463/25 |
| 7,318,774 | B2 * | 1/2008 | Bryant et al. ..... 463/25 |
| 7,367,885 | B2 | 5/2008 | Escalera et al. |
| 7,400,322 | B1 | 7/2008 | Urbach |
| 7,465,230 | B2 | 12/2008 | LeMay et al. |
| 7,503,003 | B2 | 3/2009 | Kamen et al. |
| 7,503,006 | B2 | 3/2009 | Danieli |
| 7,572,186 | B2 | 8/2009 | Lemay et al. |
| 7,581,195 | B2 | 8/2009 | Sciammarella et al. |
| 7,614,948 | B2 | 11/2009 | Saffari et al. |
| 7,708,633 | B2 | 5/2010 | Lind et al. |

| | | | |
|---|---|---|---|
| 7,753,774 | B2 | 7/2010 | Gail et al. |
| 7,798,898 | B2 | 9/2010 | Luciano et al. |
| 7,901,289 | B2 | 3/2011 | Schlottmann et al. |
| 7,909,696 | B2 | 3/2011 | Beaulieu et al. |
| 7,918,730 | B2 | 4/2011 | Brosnan et al. |
| 7,934,994 | B2 | 5/2011 | LeMay et al. |
| 2001/0054794 | A1 | 12/2001 | Cole et al. |
| 2002/0013170 | A1 | 1/2002 | Miller |
| 2002/0016201 | A1 | 2/2002 | Bennett et al. |
| 2002/0019253 | A1 | 2/2002 | Reitzen et al. |
| 2002/0105515 | A1 | 8/2002 | Mochizuki |
| 2002/0111208 | A1 | 8/2002 | Marta |
| 2002/0111212 | A1 | 8/2002 | Muir |
| 2002/0113369 | A1 | 8/2002 | Weingardt |
| 2002/0113820 | A1 | 8/2002 | Robinson et al. |
| 2002/0132661 | A1 | 9/2002 | Lind et al. |
| 2002/0175466 | A1 | 11/2002 | Loose et al. |
| 2003/0013517 | A1 | 1/2003 | Bennett et al. |
| 2003/0032479 | A1 | 2/2003 | LeMay et al. |
| 2003/0045345 | A1 | 3/2003 | Berman |
| 2003/0064781 | A1 | 4/2003 | Muir |
| 2003/0064801 | A1 | 4/2003 | Breckner |
| 2003/0119581 | A1 | 6/2003 | Cannon et al. |
| 2003/0125101 | A1 | 7/2003 | Campo |
| 2003/0130029 | A1 | 7/2003 | Crumby |
| 2004/0002380 | A1 | 1/2004 | Brosnan |
| 2004/0029636 | A1 | 2/2004 | Wells |
| 2004/0048657 | A1 | 3/2004 | Gauselmann |
| 2004/0077402 | A1 | 4/2004 | Schlottmann |
| 2004/0077404 | A1 | 4/2004 | Schlottmann et al. |
| 2004/0092302 | A1 | 5/2004 | Gauselmann |
| 2004/0102244 | A1 | 5/2004 | Kryuchkov et al. |
| 2004/0102245 | A1 | 5/2004 | Escalera et al. |
| 2004/0152508 | A1 | 8/2004 | Lind et al. |
| 2004/0198485 | A1 | 10/2004 | Loose et al. |
| 2004/0266515 | A1 | 12/2004 | Gauselmann |
| 2005/0001845 | A1 | 1/2005 | Noyle |
| 2005/0075167 | A1 | 4/2005 | Beaulieu et al. |
| 2005/0096120 | A1 | 5/2005 | Lind et al. |
| 2005/0130730 | A1 | 6/2005 | Lind et al. |
| 2005/0225559 | A1 | 10/2005 | Robertson et al. |
| 2005/0233798 | A1 | 10/2005 | Van Asdale |
| 2005/0233799 | A1 | 10/2005 | LeMay et al. |
| 2006/0025197 | A1 | 2/2006 | Kane et al. |
| 2006/0025199 | A1 | 2/2006 | Harkins et al. |
| 2006/0082056 | A1 | 4/2006 | Kane et al. |
| 2006/0229122 | A1 | 10/2006 | Macke |
| 2007/0155471 | A1 | 7/2007 | Powell et al. |
| 2007/0155472 | A1 | 7/2007 | Gail et al. |
| 2007/0155473 | A1 | 7/2007 | Powell et al. |
| 2007/0161423 | A1 | 7/2007 | Bienvenue et al. |
| 2007/0173313 | A1 | 7/2007 | Bienvenue et al. |
| 2008/0045331 | A1 | 2/2008 | LeMay et al. |
| 2008/0076546 | A1 | 3/2008 | Moyle et al. |
| 2008/0188303 | A1 | 8/2008 | Schlottmann et al. |
| 2008/0188304 | A1 | 8/2008 | Escalera et al. |
| 2008/0303746 | A1 | 12/2008 | Schlottmann et al. |
| 2009/0062001 | A1 | 3/2009 | LeMay et al. |

FOREIGN PATENT DOCUMENTS

| | | | |
|---|---|---|---|
| AU | 200210214 | A1 | 8/2002 |
| AU | 200227720 | | 2/2003 |
| AU | 2003237479 | B2 | 1/2004 |
| AU | 2006203556 | B2 | 9/2006 |
| CA | 2 343 870 | A1 | 10/2001 |
| EP | 0 475 581 | | 3/1992 |
| EP | 0 759 315 | | 2/1997 |
| EP | 0 830 881 | A2 | 3/1998 |
| GB | 2 405 107 | | 2/2005 |
| GB | 2 412 282 | | 9/2005 |
| GB | 2 420 294 | | 5/2006 |
| GB | 2 459 628 | | 11/2009 |
| GR | 62140 | B | 8/1979 |
| JP | 2002-099926 | A | 4/2002 |
| RU | 2 067 775 | C1 | 10/1996 |
| RU | 2 168 192 | C2 | 5/2001 |
| WO | WO 98/45004 | | 10/1998 |
| WO | WO 01/99067 | | 12/2001 |
| WO | WO 02/32521 | | 4/2002 |
| WO | WO 02/073501 | | 9/2002 |
| WO | WO 03/085613 | | 10/2003 |
| WO | WO 2004/002591 | | 1/2004 |
| WO | WO 2004/028650 | | 4/2004 |
| WO | WO 2004/029893 | | 4/2004 |
| WO | WO 2004/095383 | A1 | 11/2004 |
| WO | WO 2005/016473 | | 2/2005 |
| WO | WO 2005/034054 | | 4/2005 |
| WO | WO 2006/039324 | | 4/2006 |
| WO | WO 2007/075401 | | 7/2007 |
| WO | WO 2007/075486 | | 7/2007 |
| WO | WO 2007/075582 | | 7/2007 |
| WO | WO 2007/078828 | | 7/2007 |
| WO | WO 2008/005278 | | 1/2008 |
| WO | WO 2008/154433 | | 12/2008 |

OTHER PUBLICATIONS

M2 Presswire, Aristocrat Technologies to use PowerVR technology in casino video machines; Australian company leads market for video machine games of chance, Oct. 17, 2000, http://www.aristocrat.com.au/PR181000.htm, Copyright 2000 M2 Communications, Ltd. All Rights Reserved.

David Einstein, 3D Web Browsing on the Horizon, Nov. 27, 2000, http://www.forbes.com/2001/11/27/1127threed.html., Forbes.com.

Mason Woo, Jackie Neider, Tom Davis, Dave Shreiner, OpenGL Program Guide: The Official Guide to Learning OpenGL, Introduction to OpenGL Chapter 1, Version 1.2, 3rd edition, OpenGL Architecture Review Board, Addison-Wesley Publishing, Co., 1999, ISBN: 0201604582.

Carson G. S.: "Standards Pipeline The OpenGL Specification" Computer Graphics, ACM, US, vol. 31, No. 2, May 1997, pp. 17-18, XP000939297, ISSN: 097-8930.

European Office Action dated Nov. 24, 2005 from a related EP Application No. 03770604.1 (4 pages).

Microsoft Press. Computer Dictionary Third Edition. Redmond, WA 1997. p. 406.

Bienvenue et al., U.S. Appl. No. 11/312,966, "Bingo System With Downloadable Common Patterns", filed Dec. 19, 2005.

Powell et al., U.S. Appl. No. 11/312,948, "Bingo Gaming Machine Capable of Selecting Different Bingo Pools", filed Dec. 19, 2005.

Gail, et al., U.S. Appl. No. 11/402,726, "Using Multiple Bingo Cards to Represent Multiple Slot Paylines and Other Class III Game Options", filed Apr. 11, 2006.

Powell, et al., U.S. Appl. No. 11/442,029, "Bingo System With Discrete Paycout Categories", filed May 26, 2006.

U.S. Office Action dated Jun. 13, 2003 issued in U.S. Appl. No. 09/927,901.

U.S. Final Office Action dated Dec. 22, 2003 issued in U.S. Appl. No. 09/927,901.

U.S. Examiner Interview Summary dated Mar. 16, 2004 issued in U.S. Appl. No. 09/927,901.

U.S. Office Action dated Jun. 21, 2004 issued in U.S. Appl. No. 09/927,901.

U.S. Examiner Interview Summary dated Jul. 27, 2004 issued in U.S. Appl. No. 09/927,901.

U.S. Notice of Allowance dated Dec. 16, 2004 issued in U.S. Appl. No. 09/927,901.

U.S. Office Action dated Dec. 10, 2007 issued in U.S. Appl. No. 11/112,076.

U.S. Notice of Allowance dated Sep. 15, 2008 issued in U.S. Appl. No. 11/112,076.

U.S. Office Action dated Dec. 12, 2007 issued in U.S. Appl. No. 11/829,807.

U.S. Notice of Allowance dated Sep. 8, 2008 issued in U.S. Appl. No. 11/829,807.

U.S. Office Action dated Mar. 15, 2010 issued in U.S. Appl. No. 12/264,877.

U.S. Notice of Allowance dated Aug. 16, 2010 issued in U.S. Appl. No. 12/264,877.

U.S. Notice of Allowance dated Nov. 1, 2010 issued in U.S. Appl. No. 12/264,877.

U.S. Office Action dated Jun. 17, 2005 issued in U.S. Appl. No. 10/187,343.

U.S. Final Office Action dated Jan. 30, 2007 issued in U.S. Appl. No. 10/187,343.
U.S. Office Action dated Jun. 27, 2007 issued in U.S. Appl. No. 10/187,343.
U.S. Office Action dated Aug. 21, 2008 issued in U.S. Appl. No. 10/187,343.
U.S. Office Action dated May 15, 2009 issued in U.S. Appl. No. 10/187,343.
U.S. Final Office Action dated May 10, 2010 issued in U.S. Appl. No. 10/187,343.
U.S. Notice of Allowance dated Aug. 6, 2010 issued in U.S. Appl. No. 10/187,343.
U.S. Office Action dated Sep. 6, 2007 issued in U.S. Appl. No. 10/803,233.
U.S. Office Action dated Jun. 24, 2008 issued in U.S. Appl. No. 10/803,233.
U.S. Office Action dated Jan. 23, 2009 issued in U.S. Appl. No. 10/803,233.
U.S. Final Office Action dated Oct. 1, 2009 issued in U.S. Appl. No. 10/803,233.
U.S. Notice of Allowance dated Jan. 27, 2010 issued in U.S. Appl. No. 10/803,233.
U.S. Notice of Allowance dated Mar. 11, 2010 issued in U.S. Appl. No. 10/803,233.
U.S. Notice of Allowance dated Jul. 12, 2010 issued in U.S. Appl. No. 10/803,233.
U.S. Notice of Allowance and Examiners Communication dated Nov. 3, 2010 issued in U.S. Appl. No. 10/803,233.
U.S. Office Action dated Jun. 12, 2007 issued in U.S. Appl. No. 10/674,884.
U.S. Office Action dated Feb. 20, 2008 issued in U.S. Appl. No. 10/674,884.
U.S. Action—Examiner's Answer re Brief on Appeal, dated Jun. 22, 2009 issued in U.S. Appl. No. 10/674,884.
U.S. Action—Examiner's Communication re IDS Considered dated Jul. 27, 2009 issued in U.S. Appl. No. 10/674,884.
U.S. Action—Examiner's Communication re Reply Brief filed Aug. 3, 2009, dated Aug. 27, 2009 issued in U.S. Appl. No. 10/674,884.
U.S. Office Action dated Feb. 12, 2007 issued in U.S. Appl. No. 10/676,719.
U.S. Notice of Allowance dated Sep. 24, 2007 issued in U.S. Appl. No. 10/676,719.
U.S. Office Action dated May 18, 2010 issued in U.S. Appl. No. 12/101,921.
U.S. Final Office Action dated Oct. 29, 2010 issued in U.S. Appl. No. 12/101,921.
U.S. Office Action dated Sep. 28, 2010 issued in U.S. Appl. No. 11/312,966.
U.S. Office Action dated Oct. 7, 2010 issued in U.S. Appl. No. 11/312,948.
U.S. Office Action dated Aug. 25, 2010 issued in U.S. Appl. No. 11/759,825.
U.S. Office Action dated Nov. 25, 2008 issued in U.S. Appl. No. 11/402,726.
U.S. Final Office Action dated Jul. 1, 2009 issued in U.S. Appl. No. 11/402,726.
U.S. Notice of Allowance and Examiner Interview Summary dated Mar. 1, 2010 issued in U.S. Appl. No. 11/402,726.
U.S. Notice of Allowance and Supplemental Notice of Allowability dated Jun. 3, 2010 issued in U.S. Appl. No. 11/402,726.
U.S. Office Action dated Sep. 3, 2010 issued in U.S. Appl. No. 11/442,029.
U.S. Office Action dated Feb. 8, 2005 issued in U.S. Appl. No. 10/272,788.
U.S. Office Action dated May 25, 2005 issued in U.S. Appl. No. 10/272,788.
U.S. Office Action dated Jun. 1, 2006 issued in U.S. Appl. No. 10/272,788.
U.S. Office Action dated Oct. 26, 2006 issued in U.S. Appl. No. 10/272,788.
U.S. Office Action dated Feb. 22, 2007 issued in U.S. Appl. No. 10/272,788.
U.S. Office Action dated Nov. 5, 2008 issued in U.S. Appl. No. 12/024,931.
U.S. Final Office Action dated Jun. 9, 2009 issued in U.S. Appl. No. 12/024,931.
U.S. Office Action dated Dec. 31, 2009 issued in U.S. Appl. No. 12/024,931.
U.S. Notice of Non-Compliant Amendment (37 CFR 1.121) dated Aug. 11, 2010 issued in U.S. Appl. No. 12/024,931.
U.S. Notice of Allowance dated Sep. 20, 2010 issued in U.S. Appl. No. 12/024,931.
U.S. Notice of Allowance dated Nov. 15, 2010 issued in U.S. Appl. No. 12/024,931.
Australian Examiner's first report dated Nov. 21, 2005 issued in AU Patent Application No. 27720/02.
Australian Examiner's first report dated Jun. 26, 2008 from AU Application No. 2006203556.
PCT International Search Report and Written Opinion dated Feb. 12, 2008 issued in PCT Application No. PCT/US2007/015015, 15 pages.
PCT International Preliminary Report on Patentability and Written Opinion dated Jan. 6, 2009 issued in PCT Application No. PCT/US2007/015015.
EP Examination Report dated Jun. 3, 2009 issued in Application No. 07 809 991.8-2221.
EP Result of Consultation dated Sep. 1, 2009 issued in Application No. 07 809 991.8-2221.
PCT International Search Report dated Jan. 13, 2004 issued in PCT Application No. PCT/US2003/018028.
Australian Examiner's first report dated Jun. 18, 2008 in Application No. 2003237479.
British Examination Report dated Jun. 9, 2005 issued in UK Application No. 0427512.9, 2 pgs.
British Examination Report dated Nov. 7, 2006 issued in Application No. 0427512.9.
UK Combined Search and Examination Report under Sections 17 and 18(3) dated Mar. 15, 2006 issued in GB0600005.3, 5 pgs.
Australian Examiner's first report dated Mar. 12, 2010 issued in Application No. 2005201148.
Australian Examiner's Report No. 2 dated Aug. 10, 2010 issued in Application No. 2005201148.
UK Search Report under Section 17(5) dated Jun. 22, 2005 issued in GB 0505328.5.
British Examination Report dated May 14, 2009 issued in Application No. GB 0505328.5.
British Examination Report dated Dec. 9, 2009 from Application No. GB 0505328.5.
PCT International Search Report dated Mar. 1, 2004 issued in PCT/US2003/031138.
Australian Examiner's first report dated Feb. 16, 2009 issued in Application No. 2003279092.
Russian Office Action dated Jul. 19, 2007 issued in RU Application No. 2005109160/09 (010839), 9 pages.
PCT International Search Report dated Mar. 19, 2004 issued in PCT/US2003/031158.
Australian Examiner's first report dated Feb. 6, 2009 issued in Application No. 2003279742.
European Examination Report dated Dec. 15, 2005 issued in EP Application No. 03 773 084.3-2218.
European Office Action dated Jun. 29, 2007 issued in EP Application No. 03 773 084.3-2218, 3 pages.
Russian Advisory Action dated Jul. 19, 2007 issued in Russian Application No. 2005109161/09 (010840) 7 pages.
PCT International Search Report dated Aug. 8, 2007 issued in WO2007/075401 (PCT/US2006/047887).
PCT International Preliminary Report on Patentability and Written Opinion dated Jun. 24, 2008 issued in WO2007/075401 (PCT/US2006/047887).
Chinese First Office Action dated Jan. 22, 2010 issued in CN 200680052457.0.
PCT International Search Report dated Jul. 5, 2007 issued in W02007/075486 (PCT/US2006/048064).
PCT International Preliminary Report on Patentability and Written Opinion dated Jun. 24, 2008 issued in WO2007/075486 (PCT/US2006/048064).

Chinese First Office Action dated Jan. 29, 2010 issued in CN 200680052896.1.
PCT International Search Report and Written Opinion dated Oct. 24, 2008 issued in PCT/US2008/066196.
PCT International Preliminary Report on Patentability and Written Opinion dated Dec. 7, 2009 issued in PCT/US2008/066196.
PCT International Search Report and Written Opinion dated Jul. 4, 2007 issued in WO2007/078828 (PCT/US2006/047714).
PCT International Preliminary Report on Patentability and Written Opinion dated Jun. 24, 2008 issued in WO2007/078828 (PCT/US2006/047714).
Chinese First Office Action dated Jan. 22, 2010 issued in CN 200680052834.0.
PCT International Search Report dated Jun. 6, 2007 issued in WO2007/075582 (PCT/US2006/048264).
PCT International Preliminary Report on Patentability and Written Opinion dated Jun. 24, 2008 issued in WO2007/075582 (PCT/US2006/048264).
Chinese First Office Action dated Feb. 12, 2010 issued in CN 200680051371.6.0.
3D Modelers Are Running under Linux LinuxFocus: vol. Nr 4, May 1998 http://mercury.chem.pitt.edu/~tiho/LinuxFocus/English/May1998/index.html printed on Oct. 11, 2002, 4 pages.
A Primer form Mercury Research The Basics of 3D Graphics Technology The Meter available at http://www.themeter.com/artilces/3DBasics.shtml printed on Jan. 31, 2003 pp. 1-2.
England and Wales High Court (Patent Court) Decisions; Neutral Citation No. [2005] EWHC 2416 (Pat) Case No. CH/2005/APP/0232 http://www.bailii.org/we/cases/EWHC/Patents/2005/2416.html (5 pgs.).
Game Machine, Patent Abstracts of Japan, Publication No. 2001-252393, published Sep. 18, 2001, 17 pages.
Game Machine, Patent Abstracts of Japan, Publication No. 2001-252394, published Sep. 18, 2001, 13 pages.
GameSpot Staff. "15 Most Influential Games of All Time" Gamespot [online], retrieved May 30, 2007]. Retrieved from the Internet http://web.archive.org/web/20010618175937/http://gamespot.com/gamespot/features/pc/most_influential/p16.html, 1 page.
Learn How to Program 3D Graphics LinuxFocus vol. NR 2, Jan. 1998 1-2 pages http://mercury.chem.pitt.edu/~tiho/LinuxFocus/English/January1998/index/html.
Miguel Angel Sepulveda, "Open GL Programming: The 3D Scene" pp. 1-7 http://mercury.chem.pitt.edu/~tiho/LinuxFocus/English/May1998/article46.html.
Miguel Angel Sepulveda, "What is OpenGL?" LinuxFocus vol. 2 pp. 1-5 http://mercury.chem.pitt.edu/~tiho/LinuxFocus/English/January1998/article15.html printed on Oct. 11, 2002.
Patents Act 1977: Examining for Patentability Article http://www.patent.gov.uk/patent/notices/practice/examforpat.htm (3 pgs.).
Pattern Display Device, Patent Abstracts of Japan, Publication No. 2002-085624, published Mar. 26, 2002, 9 pages.
Phillip Ross, "Hardware Review: 3Dfx Graphics Card" LinuxFocus vol. 2, pp. 1-7 http://mercury.chem.pitt.edu/~tiho/LinuxFocus/English/January1998/article18.ht printed on Oct. 11, 2002.
"PowerVR Technologies Debuts KYRO II SE Graphics Processor at CeBIT 2002", Tech/Zone, Mar. 13, 2002, available at http://www.techzone.pcvsconsole.com/news.php?tzd=1246, 3 pages.
Rose, "Nevada A.G. Finds Free Internet Gambling is Still Gambling", Mar. 2001, printed from http://rose.casinocitytimes.com/articles/974.html, pp. 1-4.
Scarne, John., Scarne on Cards, 1949, Crown Publishers, p. 243.
Scott et al. "An Overview of the VISUALIZE fx Graphics Accelerator Hardware" Article 4 Hewlet Packard Company May 1998 HP Journal, 7 pages.
Segal et al., "The OpenGL Graphics System: A Specification (Version 1.3)", 2001, printed from http://www.opengl.org/documentation/specs/version1.3/glspec13.pdf, pp. 1-11, 66-73 and 181-189 (29 pages).
Segal et al., "The OpenGL Graphics System: A Specification (Version 1.3)", 2001, printed from http://www.opengl.org/documentation/specs/version1.3/glspec13.pdf, pp. 1-11, 66-73 and 181-189 (40 pages).
Slot Machine, Patent Abstracts of Japan, Publication No. 2001-062032, published Mar. 13, 2001, 32 pages.
TE 5 Graphics Accelerator Technology Preview NEC Aug. 2001, 7 pages.
The Basics of 3D: Adding Parallelism, The Meter, available at http://www.themeter.com/articles/3DBasics-4.shtml, printed on Jan. 31, 2003 pp. 1-2.
The Basics of 3D: Balancing the Pipeline, The Meter, available at http://www.themeter.com/articles/3DBasics-3.shtml, printed on Jan. 31, 2003 pp. 1-2.
The Basics of 3D: Tackling the Pipeline, The Meter, available at http://www.themeter.com/articles/3DBasics-2.shtml, printed on Jan. 31, 2003 pp. 1-2.
The Basics of 3D: The Next Generation, The Meter, available at http://www.themeter.com/articles/3DBasics-7.shtml, printed on Jan. 31, 2003 pp. 1-2.
The Basics of 3D: Transform and Lighting, The Meter, available at http://www.themeter.com/articles/3DBasics-6.shtml, printed on Jan. 31, 2003 pp. 1-2.
The Basics of 3D: What's Next, The Meter, available at http://www.themeter.com/articles/3DBasics-5.shtml, printed on Jan. 31, 2003 p. 1.
U.S. Office Action (IDS considered) dated Mar. 24, 2011 issued in U.S. Appl. No. 12/264,877.
U.S. Notice of Allowance dated Nov. 30, 2010 issued in U.S. Appl. No. 10/187,343.
U.S. Office Action (IDS considered) dated Feb. 14, 2011 issued in U.S. Appl. No. 10/187,343.
U.S. Office Action (IDS considered) dated Feb. 10, 2011 issued in U.S. Appl. No. 10/803,233.
U.S. Examiner Interview Summary of interview Jan. 19, 2011, dated Jan. 26, 2011 issued in U.S. Appl. No. 12/101,921.
U.S. Office Action dated Feb. 15, 2011 issued in U.S. Appl. No. 12/101,921.
U.S. Final Office Action dated Jan. 28, 2011 issued in U.S. Appl. No. 11/759,825.
U.S. Office Action (Notice of Panel Decision on Pre-Appeal Brief Review) dated Apr. 6, 2011 issued in U.S. Appl. No. 11/759,825.
U.S. Office Action (Notice of Panel Decision on Pre-Appeal Brief Review) dated Aug. 2, 2007 issued in U.S. Appl. No. 10/272,788.
U.S. Office Action (IDS considered) dated Feb. 8, 2011 issued in U.S. Appl. No. 12/024,931.
US Office Action dated Mar. 17, 2011 issued in U.S. Appl. No. 11/312,966.
US Office Action Final dated Apr. 1, 2011 issued in U.S. Appl. No. 11/312,948.
US Office Action Final dated Feb. 18, 2011 issued in U.S. Appl. No. 11/442,029.
"Improving your Bingo odds", (2002-2005) 10 Best Bingo Sites, [downloaded on Dec. 13, 2010 at http://web.archive.org/web/20050629010907/http://10bestbingosites.com/bingo_odds.php].

* cited by examiner 150
x
y
z
152
154
156
158
159
GAME DISPLAY 160
161
162
164
165
166
I
J

METHODS AND DEVICES FOR DISPLAYING MULTIPLE GAME ELEMENTS

CROSS-REFERENCE TO RELATED APPLICATIONS

This application claims priority to U.S. Provisional Patent Application No. 60/752,014, entitled "BINGO GAMES THAT PROVIDE SIMULATED CLASS III GAME OUTCOMES" and filed Dec. 19, 2005, which is hereby incorporated by reference. This application is related to U.S. patent application Ser. No. 11/112,076, entitled "VIRTUAL CAMERAS AND 3-D GAMING ENVIRONMENTS IN A GAMING MACHINE" and filed Apr. 22, 2005, which is a continuation of U.S. patent application Ser. No. 09/927,901, entitled "VIRTUAL CAMERAS AND 3-D GAMING ENVIRONMENTS IN A GAMING MACHINE" and filed Aug. 9, 2001 (now issued as U.S. Pat. No. 6,887,157), both of which are hereby incorporated by reference. This application is also related to U.S. patent application Ser. No. 11/402,726, entitled "USING MULTIPLE BINGO CARDS TO REPRESENT MULTIPLE SLOT PAYLINES AND OTHER CLASS III GAME OPTIONS" and filed Apr. 11, 2006, which is also hereby incorporated by reference.

FIELD OF THE INVENTION

This invention relates to game presentation methods for gaming machines such as slot machines and video poker machines.

BACKGROUND OF THE INVENTION

As technology in the gaming industry progresses, the traditional mechanically driven reel slot machines are being replaced with electronic counterparts having video displays such as liquid crystal displays ("LCDs") or the like. These video/electronic gaming advancements enable the presentation of more complex games, which would not otherwise be possible on mechanically driven gaming machines.

Maintaining a game player's interest in game play, such as on a gaming machine or during other gaming activities, is an important consideration for an operator of a gaming establishment. The visual and audio components of the gaming presentation may be used to draw a player's attention to various game features and to heighten the player's interest in additional game play.

One method for maintaining a player's interest is to present multiple game elements at the same time during a game presentation. Such game elements may include, but are not limited to, multiple bingo cards and multiple hands of playing cards. Games involving multiple bingo cards are becoming quite popular. Moreover, some variants of poker include game presentations wherein a hundred or more poker hands are played during each game presentation.

Challenges associated with presenting multiple game elements in a single game presentation include display size and display resolution. For instance, in a poker game wherein one hundred or more poker hands are displayed during each game presentation, each card must be drawn quite small in order to display all of the cards on a single display screen. As the number of game elements presented in a game presentation increases, the amount of detail may be limited by the screen resolution. The lack of detail and small size of each element can make it difficult for players to understand or fully appreciate game events, including but not limited to game outcomes. Therefore, such display limitations may make game play less interesting and may even discourage some people from playing.

It would be desirable to provide methods and devices that allow multiple game elements to be presented on a video gaming machine in a more satisfactory fashion.

SUMMARY OF THE INVENTION

This invention addresses the needs indicated above by providing methods and devices for presenting a plurality of game elements on one or more display devices. The game elements may comprise, for example, bingo cards, playing cards, hands of playing cards, etc. Some implementations of the invention involve displaying a plurality of game elements as surfaces of at least one virtual three-dimensional object. Preferably, the orientation of the virtual three-dimensional object can be varied to display selected game elements. The game elements may be selected by a player and/or by a logic device. In some implementations, the three-dimensional object comprises a "carousel" that can be re-oriented (e.g., rotated) to display game elements.

Some implementations of the invention provide a method of displaying multiple game elements, including but not limited to multiple bingo cards. The method includes these steps: determining when a player will use B bingo cards in a bingo game, where B is a number greater than a predetermined number N of bingo cards that can simultaneously be displayed in a first area of a first display device; selecting automatically N of the B bingo cards to be displayed in the first area; and displaying N automatically selected bingo cards in the first area. In some such implementations, all B bingo cards may be displayed in a second area of the first display device. Selected bingo numbers may be displayed in a third area of the first display device.

The method may include the step of providing a graphical user interface ("GUI") in a second area of the first display device. The GUI may be configured to allow the selection of bingo cards.

The method may include the step of ascertaining when a player will use S bingo cards, where S is less than or equal to N. When it is ascertained that a player will use S bingo cards, the S bingo cards may be displayed in the first area. If S is less than N, the displaying step may involve displaying S bingo card fronts and N-S bingo card backs, blanks, etc.

The selecting step may involve selecting N bingo cards that were most recently selected by a player. The displaying process may include the following steps: displaying the N bingo cards on N corresponding sides of a bingo card carousel; displaying a side view of the bingo card carousel; and rotating the bingo card carousel such that N most recently selected bingo cards are in view. The selecting step may comprise selecting N bingo cards having the highest-ranking patterns after bingo numbers have been selected during a bingo game.

The displaying step may comprise displaying the N bingo cards on N corresponding three-dimensional surfaces. The N corresponding three-dimensional surfaces may be sides of a bingo card carousel, and the displaying step may involve displaying a side view of the bingo card carousel.

Some such methods of the invention facilitate the presentation of Class II games, such as bingo games, that simulate Class III games. One such method involves the steps of displaying a bingo outcome of a bingo game in at least the first area of the first display device and displaying a simulated Class III game outcome that is based on the bingo outcome. The simulated Class III game outcome may be displayed on the same display device or on a second display device.

In some such implementations, the simulated Class III game outcome comprises a slot game outcome. If so, the method may involve the steps of receiving an indication of how many paylines P have been selected and determining B according to P. In some instances the number of paylines of the slot game corresponds with B, but this is not necessarily the case.

Various method of the invention may be implemented as computer program products, including but not limited to one or more machine-readable media on which program instructions for implementing any of the methods described above are stored. Many methods of this invention may be represented as program instructions and/or data structures, databases, etc. that can be provided on such computer readable media. Similarly, methods of the invention may be implemented in various types of hardware and/or firmware.

For example, some embodiments of the invention provide a gaming machine that includes the following elements: a network interface; at least one user input device; a first display device; and at least one logic device. One of the user input devices may comprise a GUI in a second area of the first display device that is configured to allow selection of bingo cards.

The logic device is configured to do the following: determine, based at least in part on input received from the user input device, when a player will use B bingo cards in a bingo game, where B is a number greater than a predetermined number N of bingo cards that can simultaneously be displayed in a first area of the first display device; select N of the B bingo cards to be displayed in the first area; control the first display device to display N selected bingo cards in the first area; and provide a bingo game according to bingo game information received via the network interface.

A logic device may be further configured to control the first display device to display all B bingo cards in a second area. A logic device may also be configured to control the first display device to display selected bingo numbers in a third area.

A logic device may also be configured to ascertain when a player will use S bingo cards, where S is less than or equal to N. In such embodiments, when it is ascertained that a player will use S bingo cards, a logic device controls the first display device to display the S bingo cards in the first area. If S is less than N, the displaying step may involve displaying S bingo card fronts and N-S bingo card backs, blanks, or the like.

A logic device may also be configured to receive bingo card information from a user input device regarding selected bingo cards. If so, the selecting step may involve selecting N bingo cards for which bingo card information was most recently received. The displaying step may involve the following procedure: displaying the N bingo cards on N corresponding sides of a bingo card carousel; displaying a side view of the bingo card carousel; and rotating the bingo card carousel such that N most recently selected bingo cards are always in view. A logic device may be configured to select N bingo cards having the highest-ranking patterns after bingo number information has been received via the network interface.

A logic device may be configured to control the first display device to display the N bingo cards on N corresponding three-dimensional surfaces. In some such implementations, the N corresponding three-dimensional surfaces are sides of a bingo card carousel, and wherein the displaying step comprises displaying a side view of the bingo card carousel.

A logic device may also be configured to control the first display device to display a bingo outcome of a bingo game in at least the first area and to control a second display device to display a simulated Class III game outcome that is based on the bingo outcome. The simulated Class III game outcome may, for example, comprise a simulated slot game outcome, a simulated poker outcome, a simulated blackjack outcome, a simulated keno outcome or a simulated roulette outcome. For implementations involving the simulation of a slot outcome, a logic device may be further configured to receive an indication from a user input device of how many paylines P have been selected and to determine B according to P.

Alternative methods of displaying multiple bingo cards are provided herein. One such method includes these steps: determining a number B of bingo cards that a player has selected for a bingo game; determining whether B is equal to $B_{MAX}$, a maximum number of bingo cards that can be used in the bingo game; and displaying fewer than N selected bingo cards on surfaces of a virtual three-dimensional object when B is less than $B_{MAX}$, wherein N is a maximum number of bingo cards that can simultaneously be displayed on surfaces of the virtual three-dimensional object. N selected bingo cards will be displayed when B equals $B_{MAX}$.

According to some such methods, N−1 selected bingo cards will be displayed when B is at least N−1 but is less than $B_{MAX}$. B selected bingo cards when B is at least one but is less than N.

These and other features of the present invention will be presented in more detail in the following detailed description of the invention and the associated figures.

DESCRIPTION OF THE PREFERRED EMBODIMENTS

In this application, numerous specific details are set forth in order to provide a thorough understanding of the present invention. It will be obvious, however, to one skilled in the art, that the present invention may be practiced without some or all of these specific details. In other instances, well known process steps have not been described in detail in order not to obscure the present invention.

The present invention provides various methods and devices for presenting a plurality of game elements on one or more display devices. Preferred implementations of the invention allow games that can involve a large number of game elements (such as bingo cards, playing cards, hands of playing cards, etc.) to be presented in a manner that is entertaining to a player and that provides a satisfactory amount of information to the player.

Figure 1:
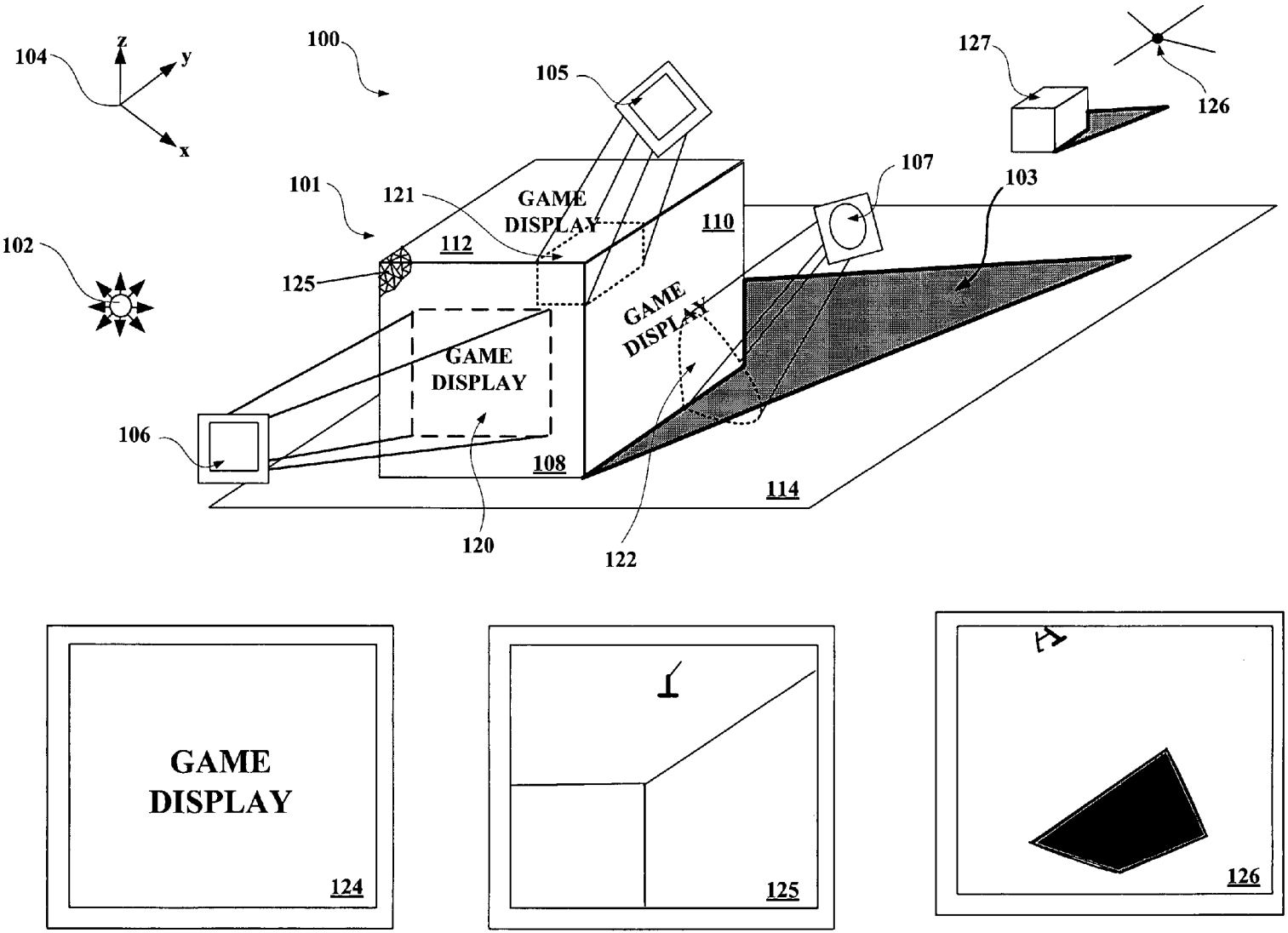
FIG. 1 is a perspective drawing of a 3-D virtual gaming environment implemented on a gaming machine for one embodiment of this invention.

FIG. 1 is a perspective drawing of a 3-D virtual gaming environment 100 implemented on a gaming machine for one embodiment of this invention. The 3-D virtual gaming environment may be used by the master gaming controller on the gaming machine to present a game of chance. The game of chance played on the gaming machine may include: 1) a wager selected by a player playing a game on the gaming machine, 2) an initiation of the game of chance on the gaming machine by the player, 3) a determination of an outcome for the game of chance by the gaming machine and 4) a presentation on the gaming machine of the game outcome to the player. In the present invention, the 3-D gaming environment may be used to present a game outcome to the player, describe operating functions of the gaming machine and provide an interface for obtaining gaming information and services. Apparatus and methods implementing these features are described with respect to FIGS. 1-12.

To utilize a virtual 3-D gaming environment for a game presentation or other gaming activities on a gaming machine, a 2-D view of the virtual 3-D gaming environment is rendered. The 2-D view captures some portion of the surfaces modeled in the virtual 3-D gaming environment. The captured surfaces define a 3-D object in the 3-D gaming environment. The captured surfaces in 2-D view are defined in the 3-dimensional coordinates of the virtual 3-D gaming environment and converted to a 2-dimensional coordinate system during the capturing process. As part of a game presentation, the 2-D view may be presented as a video frame on a display screen on the gaming machine. In some ways, the two-dimensional view is analogous to a photograph of a physical 3-D environment taken by a camera where the photograph captures a portion of the physical 3-D surfaces existing in the physical 3-D environment. However, the photograph from a camera is not strictly analogous to a 2-D view rendered from a virtual 3-D gaming environment because many graphical manipulation techniques may be applied in a virtual 3-D gaming environment that are not available with an actual camera.

In the present invention, the 2-D view is generated from a viewpoint within the virtual 3-D gaming environment. The viewpoint is a main factor in determining what surfaces of the 3-D gaming environment defining a 3-D object are captured in the 2-D view. Since information about the 3-D gaming environment is stored on the gaming machine, the viewpoint may be altered to generate new 2-D views of objects within the 3-D gaming environment. For instance, in one frame, a 2-D view of an object modeled in the 3-D gaming environment, such as a front side of a building (e.g. the viewpoint captures the front side of a building), may be generated using a first viewpoint. In another frame, a 2-D view of the same object may be generated from another viewpoint (e.g. the backside of the building).

A disadvantage of current gaming machines is that the 2-D views used as video frames in game presentations are only rendered from 2-D objects and information about the multi-dimensional nature of the objects rendered in the 2-D views, such as the viewpoint used to generate the 2-D view, are not stored on the gaming machine. Historically, due to the regulatory environment of the gaming industry, gaming software used to present a game of chance has been designed to "run in place" on an EPROM installed on the gaming machine. Using an EPROM, it was not feasible to store large amounts of game data relating to a complicated 3-D model. Thus, only 2-D object information used to render the 2-D view was stored on the gaming machine.

However, 2-D games rendered on gaming machines have also become more sophisticated and often employ complex animations. When complicated animations are used in a 2-D system, such as playing movies on a 2-D object, a 3-D system can actually can save memory because more types of animation can be used with a 3-D system versus a 2-D system without resorting to using movies which are memory intensive. In a 2-D system without using movies, the animation properties that may be used are simple two-dimensional movement and color cycling using color palettes which provide a limited visual appeal.

When only 2-D information about a 3-D object is available, it is not possible to generate new 2-D views from different viewpoints of the 3-D object. For instance, when a picture of a playing card is rendered on current gaming machines, 3-D information, such as the thickness of the card is not stored. Thus, it is not possible to generate a 2-D view of the playing card from an edge-on viewpoint, because the thickness of the card is not known. As another example, frames from a movie may be used as part of a game presentation on a gaming machine. Each frame of the movie represents a 2-D view from a viewpoint of a camera used to film each frame. If the frame included a picture of a building viewed from the front (e.g., the viewpoint captures the front of the building), it is not possible to generate a new 2-D view of the back of the building using because information regarding the back of the building is not known.

One advantage of the present invention is the potential game playing area used to present a game of chance modeled in a 3-D gaming environment is greater than the potential game playing area of a 2-D gaming environment. For instance, a game of chance may be presented on each of the six sides of a cube modeled in a virtual gaming environment. To play the game chance, 2-D views of the cube from different viewpoints in the 3-D gaming environment may be rendered in real-time and presented to the player. As described below, in some embodiments, the player may even select the viewpoint in the 3-D gaming environment used to generate the 2-D view.

On current gaming machine, the cube would be rendered as a 2-D object generated from the 3-D cube as seen from a particular viewpoint. The particular viewpoint is selected when the game is developed and only 2-D information about the cube as viewed from the selected viewpoint would be stored on an EPROM on the gaming machine. Thus, a game of chance could be presented on the sides of the cube rendered from the 2-D object that was generated from the selected viewpoint of the 3-D cube and stored on the EPROM. However, unless additional 2-D objects were generated from different viewpoints, it is not possible to present a game of chance on the sides of the cube not visible from the selected viewpoint because the 2-D object does not store information regarding the sides of the cube not visible from the selected viewpoint. Further, even if multiple 2-D objects were generated, it is difficult and time consuming to generate enough 2-D objects to allow smooth transitions between viewpoints captured by the 2-D objects. It is also difficult to a scale a 2-D object, either smaller or larger, without introducing distortion effects.

Distortion is also generated when scaling 3-D objects. However, it is easier to deal with using specialized 3-D graphics cards because the card applies a bilinear filtering process to the texels at render time. Without special hardware, such as a 3-D graphics card, it would be difficult to correct for distortion in real-time.

Finally, in a typical 2-D gaming system, due to the limited flexibility of 2D, outcomes for a game of chance rendered in 2D and displayed on a gaming machine have to be quantified and pre-rendered i.e. canned animations. Due to the flexibility of a 3-D gaming system the outcomes can be determined through user input giving an unlimited number of animations in response to the players input. By not having to make a series of pre-canned animations but instead determining the animation in response to the players input saves many bytes in storage space requirements. In following figures, details of methods and apparatus used to present a game of chance generated from a 3-D gaming environment are described.

Returning to FIG. 1, the 3-D gaming environment 100 includes three objects: 1) a rectangular box 101 on top of, 2) a plane 114 and 3) a second box 126. The box 101, box 127 and plane 114 are defined in a 3-dimensional rectangular coordinate space 104. Typically, surfaces of the objects in the gaming environment are defined using a plurality of surface elements. The surface elements may comprise different shapes, such as different types of polygons that are well known in the 3-D graphical arts. For example, the objects in the present information may be defined in a manner to be compatible with one or more graphics standards such as Open Graphics Library (OpenGL). Information on OpenGL may be found at www.opengl.org.

In one embodiment, the objects in the gaming environment 100 may be defined by a plurality of triangular elements. As an example, a plurality of triangular surface elements 125 are used to define a portion of the surface 108 and the surface face 112. In another embodiment, the objects in the gaming environment 100, such as box 101 and box 126, may be defined by a plurality of rectangular elements. In yet another embodiment, a combination of different types of polygons, such as triangles and rectangles may be used to describe the different objects in the gaming environment 100. By using an appropriate number of surface elements, such as triangular elements, objects may be made to look round, spherical, tubular or embody any number of combinations of curved surfaces.

Triangles are by the most popular polygon used to define 3-D objects because they are the easiest to deal with. In order to represent a solid object, a polygon of at least three sides is required (e.g. triangle). However, OpenGL supports Quads, points, lines, triangle strips and quad strips and polygons with any number of points. In addition, 3-D models can be represented by a variety of 3-D curves such as NURBs and Bezier Patches.

Each of the surface elements comprising the 3-D virtual gaming environment may be described in a rectangular coordinate system or another appropriate coordinate system, such as spherical coordinates or polar coordinates, as dictated by the application. The 3-D virtual gaming environments of the present invention are not limited to the shapes and elements shown in FIG. 1 (see FIGS. 2, 3 and 4) or the coordinate system used in FIG. 1 which are shown for illustrative purposes only. Details of 3-D graphical rendering methods that may be used with the present invention are described in "OpenGL Reference Manual: The Official Reference Document to Open GL, Version 1.2," 3rd edition, by Dave Shreiner (editor), OpenGL Architecture Review Board, Addison-Wesley Publishing, Co., 1999, ISBN: 0201657651 and "OpenGL Program Guide: The Official Guide to Learning OpenGL, Version 1.2," 3rd edition, by Mason Woo, Jackie Neider, Tom Davis, Dave Shreiner, OpenGL Architecture Review Board, Addison-Wesley Publishing, Co., 1999, ISBN: 0201604582, which are incorporated herein in their entirety and for all purposes.

Surface textures may be applied to each of the surface elements, such as elements 125, defining the surfaces in the virtual gaming environment 100. The surface textures may allow the 3-D gaming environment to appear more "real" when it is viewed on a display screen on the gaming machine. As an example, colors, textures and reflectance's may be applied to each of the surface elements defining the various objects in the 3-D gaming environment. Millions of different colors may be used to add a realistic "feel" to a given gaming environment. Textures that may be applied include smoothness or surface irregularities such as bumps, craters, lines bump maps, light maps, reflectance maps and refractance maps or other patterns that may be rendered on each element. The textures may be applied as mathematical models stored as "texture maps" on the gaming machine.

In one embodiment, the "texture map" may be an animated texture. For instance, frames of a movie or another animation may be projected onto a 3-D object in the 3-D gaming environment. These animated textures may be captured in 2-D views presented in video frames on the gaming machine. Multiple animated textures may be used at the same time. Thus, for example, a first movie may be projected onto a first surface in the 3-D gaming environment and a second movie may be projected onto a second surface in the 3-D gaming environment where both movies may be viewed simultaneously.

Material properties of a 3-D surface may describe how the surface reacts to light. These surface properties may include such things as a) a material's ability to absorb different wavelengths of light, b) a material's ability to reflect different wavelengths of light (reflectance), c) a material's ability to emit certain wavelengths of light such as the tail lights on a car and d) a material's ability to transmit certain wavelengths of light. As an example, reflectance refers to how much light each element reflects. Depending on the reflectance of a surface element other items in the gaming environment may be reflected fuzzily, sharply or not at all. Combinations of color, texture and reflectance may be used to impart an illusion of a particular quality to an object, such as hard, soft, warm or cold.

Some shading methods that are commonly used with 3-D graphics to add texture that may be applied to the present invention include Gourand shading and Phong shading. Gourand and Phong shading are methods used to hide an object's limited geometry by interpolating between two surfaces with different normals. Further, using Alpha Blending, pixels may be blended together to make an object appear transparent i.e. the object transmits light.

Virtual light sources, such as 102, may be used in the gaming environment to add the appearance of shading and shadows. Shading and shadows are used to add weight and solidity to the rendering of a virtual object. For example, to add solidity to the rectangular box 101, light rays emitted from light source 102 are used to generate a shadow 103 around the rectangular box 101. In one method, ray tracing is used to plot paths of imaginary light rays emitted from an imaginary light source such as 102. These light rays may impact and may reflect off various surfaces affecting the colors assigned to each surface element. In some gaming environments, multiple light sources may be used where the number of lights and the intensity of each light source change with time. Typically, in real time 3D, the light sources do not generate shadows and it is up to the programmer to add shadows manually. As stated earlier, however, the light sources produce shading on objects.

Perspective, which is used to convey the illusion of distance, may be applied to the gaming environment 100 by defining a vanishing point, such as 126. Typically, a single point perspective is used where all of the objects in the scene are rendered to appear as though they will eventually converge at a single point in the distance, e.g. the vanishing point. However, multiple point perspectives may also be employed in 3-D gaming environments of the present invention. Perspective allows objects in the gaming environment appear behind one another. For instance, box 101 and box 127 may be the same size. However, box 127 is made to appear smaller, and hence farther away, to a viewer because it is closer to the vanishing point 126. A 3-D gaming environment may or may not provide perspective correction. Perspective correction is accomplished by transforming points towards the center of the 2-D view screen. The farther away an object is from the viewpoint in 3-D gaming environment, the more it will be transformed into the center of screen.

The present invention is not limited to perspective views or multiple perspective views of the 3-D gaming environment. An orthographic view may be used where 3-D objects rendered in a 2-D view always appear the same size no matter how far away they are in the 3-D gaming environment. The orthographic view is what you would see as a shadow cast from a light source that is infinitely far away (so that the light rays are parallel), while the perspective view comes from a light source that are finitely far away, so that the light rays are diverging. In the present invention, combinations of both perspective and orthographic views may be used. For instance, an orthographic view of a text message may be layered on top of a perspective view of the 3-D gaming environment.

Related to perspective is "depth of field". The depth of field describes an effect where objects that appear closer to a viewer are more in focus and objects that are farther away appear out of focus. Depth of field may be applied renderings of the various objects in the gaming environment 100. Another effect that may be applied to renderings of objects in the gaming environment is "anti-aliasing". Anti-aliasing is used to make lines which are digitally generated as a number of straight segments appear more smooth when rendered on a display screen on the gaming machine. Because the 2D display only takes finite pixel positions, stair stepping occurs on any limes that are not straight up and down, straight across (left and right) or at 45 degrees on the display screen. Stair stepping produces a visually unappealing effect, thus, pixels are added to stair-stepped lines to make this effect less dramatic.

Objects in the gaming environment 101 may be appear to be static or dynamic. For instance, the coordinates of box 127 may change with time while the coordinates of box 101 and plane 114 remain fixed. Thus, when rendered on a display screen on a gaming machine, the box 127 may appear to move in the gaming environment 101 relative to the box 101. Many dynamic effects are possible. For instance, box 127 may appear to rotate while remaining in a fixed position or may rotate while also translating to generate an effect of bouncing or tumbling. Further, in the gaming environment, objects may appear to collide with one another. For instance, box 127 may appear to collide with box 101 altering the trajectory of box 127 in the gaming environment. Many digital rendering effects may be applied to the gaming environment of the present invention. The effects described above have been provided for illustrative purposes only.

Standard alpha-numeric text and symbols may be applied to one or more surface elements in the gaming environment 101 to display gaming information to a game player. The alpha-numeric text and symbols may be applied to various surfaces in the gaming environment to generate a plurality of game displays that may be used as part of game outcome presentations viewed on the gaming machine. For instance, game displays may be rendered on each of the 6 six surface faces of box 101 or box 127 and a plurality of game displays may also be rendered on planar surface 114. In the present invention, game displays may be rendered across one or more surfaces of any polyhedron or other object defined in the gaming environment.

The rendered text and symbols allow game outcome presentations to be generated for different games of chance. For instance, a card hand for a poker game or black jack game may be rendered on each of the faces of box 101 such as surfaces 108, 110 and 112. As another example, keno numbers or bingo numbers may be rendered on different faces of boxes 101 and 127. Further, slot displays and pachinko displays for slot and pachinko game outcome presentations may be rendered on different faces of boxes 101 and 127.

Many different combinations of games of chance may be rendered in the gaming environment 100. For instance, a slot display may be rendered on face 108 of box 101, a black jack game display may be rendered on face 110, poker game display may be rendered on face 112, a keno game display may be rendered on a face on the box 101 opposite face 108, a pachinko game display may be rendered on a face on the box 101 opposite 110 and a bingo game display may be rendered on a face on the box 101 opposite face 112. A different combination of game displays may be rendered on the surfaces of box 127. Other games of chance that may be used in the present invention include but are not limited to dice games (e.g. craps), baccarat and roulette.

In the present invention, games of chance are used to denote gaming activities where a game player has made a wager on the outcome of the game of chance. Depending on the game outcome for the game of chance initiated by the player, the wager may be multiplied. The game outcome may proceed solely according to chance, i.e. without any input by the game player or the game player may affect the game outcome according to one or more decisions. For instance, in a video poker game, the game outcome may be determined according to cards held or discarded by the game player. While in a slot game, the game outcome, i.e. the final position of the slot reels, is randomly determined by the gaming machine.

The combinations of games described above may be rendered at the same time in the 3-D gaming environment. A player may play one or more games in a sequential manner. For instance, a player may select one or more games, make a wager for the one or more games and then initiate the one or more games and view game outcome presentations for the one or more games. A player may also play one or more games in a parallel manner. For instance, a player may select one or more games, make a wager for the one or more games, initiate the one or more games. Before the game outcome presentations have been completed for the one or more selected games, the player may select one or more new games, make a wager for the one or more new games and initiate the one or more new games. Details of a parallel game methodology are described in co-pending U.S. application Ser. No. 09/553,437, filed on Apr. 19, 2000, by Brosnan et al. and entitled "Parallel Games on a Gaming Device," which is incorporated in its entirety and for all purposes.

The rendered text and symbols in a game display are not necessarily planar may be rendered in multiple in dimensions in the gaming environment 100. For example, rendered cards may have a finite thickness or raised symbols. The cards may be dealt by hands that are defined as 3 dimensional object models in the 3-D gaming environment 100 and move as the cards are dealt. As another example, a slot display may be rendered as multidimensional reels with symbols (see FIG. 2) that may rotate in the gaming environment 100.

A game display for a game outcome presentation may be rendered on a particular surface and may change with time in response to various player inputs. For example, in a poker game, a player may discard and hold various cards while they are playing the game. Thus, the cards in the hand change as the game outcome is rendered in the 3-D gaming environment and some cards (e.g. discarded cards) may appear to leave the gaming environment. As another example, reels on a slot display rendered in the gaming environment may begin to spin in the gaming environment in response to a player pulling a lever or depressing an input button on the physical gaming machine.

Other game features and gaming information may also be rendered in the gaming environment 100. For example, bonus games, promotions, advertising and attraction graphics may also be rendered in the gaming environment. For instance, a casino's logo or a player's face may be rendered in the gaming environment. These additional game features may be integrated into a game outcome presentation on the gaming machine or other operational modes of the gaming machine such as an attract mode.

In another embodiment of the present invention, a virtual person, e.g. a 3-D dimensional model of a portion (e.g., face, hands, face, head and torso, etc.) or all of a human being may be rendered in the 3-D gaming environment. The virtual person may be animated. For the instance, by adjusting parameters of the 3-D dimensional model of the virtual person in a sequence, the virtual person may appear to speak or gesture. The virtual person may be used to explain gaming instructions to a game player or may be used as a component in a game presentation. The virtual person may appear to respond or interact with a user according to inputs into the gaming machine made by the user. For instance, a player may ask the virtual person a particular question via an input mechanism on the gaming machine such as microphone on a gaming machine equipped with voice recognition software. Next, the virtual person may appear to speak a response to the question input by the user. Animated 3-D models for other objects, such as animals or fictional characters, may also be used in the 3-D gaming environment.

After the gaming environment is defined in 3-dimensions, to display a portion of the 3-D gaming environment on a display screen on the gaming machine, a "photograph" of a portion of the gaming environment is generated. The photograph is a 2-dimensional rendering of a portion of the 3-dimensional gaming environment. Transformations between 3-D coordinate systems and 2-D coordinate systems are well known in the graphical arts. The photograph may be taken from a virtual "camera" positioned at a location inside the gaming environment 100. A sequence of photographs taken by the virtual camera in the gaming environment may be considered analogous to filming a movie.

A "photograph" displayed on the display screen of a gaming machine may also a composite of many different photographs. For instance, a composite photograph may be generated from portions of a first photograph generated using an orthographic view and portions of a second photograph generated using a perspective view. The portions of the photographs comprising the composite photograph may be placed on top of one another to provide "layered" effects, may be displayed in a side by side manner to produce a "collage" or combinations thereof.

In another embodiment of the present invention, a photograph may be a blended combination of two different photographs. Using an interpolation scheme of some type, two photographs may be blended in a sequence of photographs to provide a morphing effect where the first photograph appears to morph into a second photograph. For instance, a slot game may appear to morph into a poker game.

Operating parameters of the virtual camera, such as its position at a particular time, are used to define a 3-D surface in the gaming environment, which is projected on to a 2-D surface to produce the photograph. The 3-D surface may comprise portions a number of 3-D objects in the 3-D gaming environment. The 3-D surface may also be considered a 3-D object. Thus, a photograph is a 2-D image derived from 3-D coordinates of objects in the 3-D gaming environment. The virtual camera may represent gaming logic stored on the gaming machine necessary to render a portion of the 3-D gaming environment 100 to a 2-D image displayed on the gaming machine. The photograph is converted into a video frame, comprising a number of pixels, which may be viewed on a display screen on the gaming machine.

The transformation performed by the virtual camera allowing a portion of the virtual gaming environment to be viewed one or more display screens on the gaming machine may be a function of a number of variables. The size of lens in the virtual gaming environment, the position of the lens, a virtual distance between the lens and the photograph, the size of the photograph, the perspective and a depth variable assigned to each object are some of the variables that may be incorporated into a transformation by the virtual camera that renders a photograph of the virtual gaming environment. The resolution of the display screen on the gaming machine may govern the size of a photograph in the virtual camera. A typical display screen may allow a resolution of 800 by 600 color pixels although higher or lower resolution screens may be used. A "lens size" on the virtual camera defines a window into the virtual gaming environment. The window is sometimes referred to as a viewport. The size and position of the lens determines what portion of the virtual gaming environment 100 the virtual camera views.

After the photograph of the virtual gaming environment has been generated, other effects, such as static and dynamic anti-aliasing, may be applied to the photograph to generate a frame displayed on one or more displays located on the gaming machine. Typically, the mathematical and logical operations, which are encoded in gaming software logic, necessary to perform a particular transformation and generate a video frame may be executed by video cards and graphics cards located on the gaming machine and specifically designed to perform these operations. The graphics cards usually include graphical processing units (GPUs). However, the transformation operations may also be performed by one or more general purpose CPUs located on the gaming machine or combinations of GPUs and CPUs.

In general, the 2D/3D video graphics accelerators or coprocessors, often referred to as graphics processing units (GPUs), are located on or connected to the master gaming controller and are used to perform graphical operations. The solutions described are most commonly found as video cards. The graphical electronics may be incorporated directly onto the processor board (e.g. the master gaming controller) of the gaming machine, and even tightly integrated within other very large scale integrated chip solutions. The integration methods are often cost saving measures commonly used to reduce the costs associated with mass production. For instance, video cards, such as the Vivid!XS from VideoLogic Systems (VideoLogic Systems is a division of Imagination Technologies Group plc, England) may used to perform the graphical operations described in the present invention. As another example, video cards from Nvidia Corporation (Santa Clara, Calif.) may be employed. In one embodiment, the video card may be a multi-headed 3-D video card, such as a Matrox G450 (Matrox Graphics Inc., Dorval, Quebec, Canada). Multi-headed video cards let a single graphics card power two displays simultaneously or render two images simultaneously on the same display.

When displaying photographs from a virtual camera in a 3-D gaming environment, a single image from the camera may be divided among a plurality of display devices. For instance, four display screens may be used to display one quarter of a single image. The video feeds for each of the plurality of display devices may be provided from a single video card. Multi-headed video cards let a single graphics card (or graphics subsystem) display output on two or more displays simultaneously. This may be multiple output rendering for each display or one rendering over multiple displays, or variation of both. For example, when a multi-headed video card is used, a first head on the multi-headed video card may be used to render an image from a first virtual camera in a 3-D gaming environment and a second head on the multi-head video card may be used to render a second image from a second virtual camera in a 3-D gaming environment. The rendered first and second images from the first head and the second head may be displayed simultaneously on the same display or the first image may be displayed on a first display and the second image may be displayed on a second display.

Returning to FIG. 1, three lenses, 105, 106 and 107 used in a virtual camera are shown positioned at three locations in the virtual gaming environment. Each lens views a different portion of the gaming environment. The size and shape of the lens may vary which changes a portion of the virtual gaming environment captured by the lens. For instance, lenses 105 and 106 are rectangular shaped while lens 107 is ovular shaped.

Lens 106 is positioned to view the "game display" for a game outcome presentation rendered on surface 108. The portion of the gaming environment captured by lens 106 is a six-sided shape 120. As described above, the game display may contain the presentation of a particular game played on the gaming machine, such as a hand of cards for a poker game. After applying an appropriate transformation, a photograph 124 of the portion of the virtual gaming environment 100 in volume 120 is generated by the virtual camera with lens 106.

Using differing terminology common within the 3D graphics community, the lenses 105, 106 and 107 may be described as a camera. Each camera has the ability to have different settings. A scene in the 3-D gaming environment is shot from the camera's viewpoint. A different scene is captured from each camera. Thus, the scene is rendered from the camera to produce and image.

The photograph 124 generated from the virtual camera with lens 106 may be viewed on one or more display screens on the gaming machine. For instance, photograph 124 may be viewed on a main display on the gaming machine and a secondary display on the gaming machine. In another embodiment, a portion of photograph 124 may be displayed on the main display and a portion of the photograph may be displayed simultaneously on a secondary display. In yet another embodiment, a portion of photograph 124 may be displayed on a first gaming machine while a portion of photograph 124 may be displayed simultaneously on a second gaming machine.

Lens 105 of a virtual camera is positioned to view volume 121 in the virtual gaming environment 100. The volume 121 intersects three faces, 108, 110 and 112, of box 101. After applying an appropriate transformation, a photograph 125 of the portion of the virtual gaming environment 101 in volume 121 is rendered by the virtual camera with lens 105 which may be displayed on one of the display screens on a gaming machine.

Lens 107 of a virtual camera is positioned to view volume 122 in the virtual gaming environment 100. The ovular shape of the lens produces a rounded volume 122 similar to a light from a flashlight. The volume 122 intersects a portion of face 110 and a portion of plane 114 including a portion of the shadow 103. After applying an appropriate transformation, a photograph 126 of the portion of the virtual gaming environment 101 in volume 122 is rendered by the virtual camera with lens 107 which may be displayed on one or more of the display screens on a gaming machine. For instance, a gaming machine may include a main display, a secondary display, a display for a player tracking unit and a remote display screen in communication with the gaming machine via a network of some type. Any of these display screens may display photographs rendered from the 3-D gaming environment.

A sequence of photographs generated from one or more virtual cameras in the gaming environment 101 may be used to present a game outcome presentation on the gaming machine or present other gaming machine features. The sequence of photographs may appear akin to movie or film when viewed by the player. For instance, a 3-D model of a virtual person may appear to speak. Typically, a refresh rate for a display screen on a gaming machine is on the order of 60 HZ or higher and new photographs from virtual cameras in the gaming environment may be generated as the game is played to match the refresh rate.

The sequence of photographs from the one or more virtual cameras in the gaming environment may be generated from at least one virtual camera with a position and lens angle that varies with time. For instance, lens 106 may represent the position of a virtual camera at time, $t_1$, lens 105 may represent the position of the virtual camera at time, $t_2$, and lens 107 may represent the position of the virtual camera at time $t_3$. Photographs generated at these three positions by the virtual camera may be incorporated into a sequence of photographs displayed on a display screen.

The position of the virtual camera may change continuously between the positions at times $t_1$, $t_2$, $t_3$ generating a sequence of photographs that appears to pan through the virtual gaming environment. Between the positions at times $t_1$, $t_2$, $t_3$, the rate the virtual camera is moved may be increased or decreased. Further, the virtual camera may move non-continuously. For instance, a first photograph in a sequence of photographs displayed on a display screen may be generated from the virtual camera using the position of lens 106. The next photograph in the sequence of photographs may be generated from the virtual camera using the position of lens 105. A third photograph in the sequence of photographs may be generated from the virtual camera using the position of lens 107. In general, the virtual camera in the gaming environment 101 may move continuously, non-continuously and combinations thereof.

In a game presentation, a plurality of virtual cameras, with time varying positions, in a plurality of virtual gaming environments may be used. The camera and environment information as a function of time may be stored on the gaming machine and may be accessed when a particular scene for a game event in a game outcome presentation is needed such that the scene may be rendered in "real-time". A scene may be defined by the positions of one or more virtual cameras in one or more gaming environments as a function of time. The scenes may be modularized, i.e. a library of scenes may be generated, so that they may be incorporated into different games. For instance, a scene of a button being depressed may be incorporated into any game using this type of sequence.

A sequence of photographs generated from a first virtual camera in a first virtual gaming environment may be displayed simultaneously with a sequence of photographs generated from a second virtual camera in a second virtual gaming environment. For instance, the first sequence of photographs and second sequence and second sequence of photographs may be displayed on a split screen or may be displayed on different screens. In addition, the first virtual camera in a first virtual gaming environment and the second virtual camera may be located in a second virtual gaming environment different from the first virtual gaming environment. Also, the first virtual gaming environment and the second virtual gaming environment may be in the same gaming environment. Further, a single virtual camera may jump between different gaming environments, such as between a game play environment to a bonus game environment. The transition between the gaming environments may also appear to be smooth (e.g. the camera may pan from one environment in a continuous manner).

In some embodiments, a player may be to select one or more virtual gaming environments used in a game play on a gaming machine. For instance, a first gaming environment may involve a cityscape, such as New York, while a second gaming environment may involve a cityscape, such as Paris. During a game play on a gaming machine, a player may be able to select New York or Paris as a cityscape for the virtual gaming environment used during game play. The different game environments and different scenes generated from the environments may be stored in a memory on the gaming machine as a library of some type.

Figure 5:
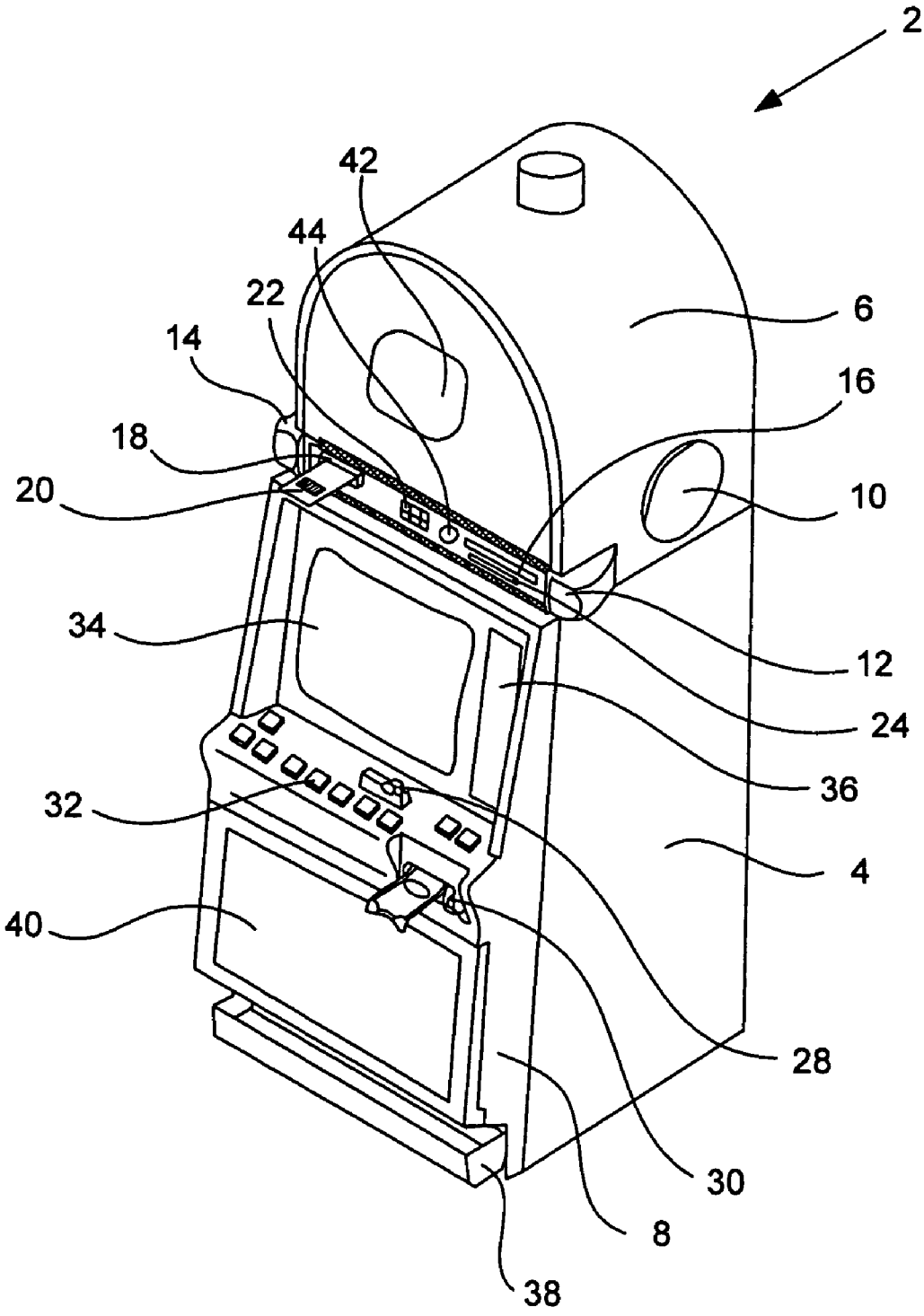
FIG. 5 is a perspective drawing of a gaming machine.

In particular embodiments, while using the gaming machine, a player may be able to control the position of the virtual camera using an input mechanism on the gaming machine (see FIG. 5). For instance, a player may be able to move the position of lens 106 closer to the surface 108 in the gaming environment 108 which generates the appearance of zooming or the object may be moved closer to the camera. For multiple hand card games, a player may be able to zoom-in on a particular hand to "expand on demand" the hand increasing the visibility of the hand. For instance, a player may use an input mechanism to "scroll" the camera and view larger portions. As another example, the player may be able maneuver a virtual camera through the gaming environment or select a scene in the gaming environment. An opportunity to move the virtual camera may be triggered by certain game events such as a bonus game event on the gaming machine or the movement of the camera may be scripted (e.g. pre-determined) as part of the game playing sequence. For example, as part of the play of a bonus game event, a player may be able to choose from a number of doors leading to different rooms with treasure chests. When the player enters of one of the rooms, the chest is opened their bonus award is revealed.

With the present invention, some advantages of generating a 3-D gaming environment that may be rendered in real-time to a display screen are as follows. First, it allows a player to be presented and possibly control a complex game outcome presentation in real-time. Thus, the game outcome presentation may be varied from game to game in a manner determined by the player. Traditional game outcome presentations have been modeled in 2-D and little control has been given to the player. Thus, traditional game outcome presentations do not vary much from game to game. Second, screen resolution issues associated with presenting a large number of games simultaneously on a single screen may be avoided by modeling the games in 3-D gaming environment.

At any given time during a game presentation viewed on a display screen on the gaming machine, only a portion of the plurality of the games modeled in the 3-D gaming environment may be visible to the player. Thus, a game playing area in a 3-D gaming environment is greater than a 2-D gaming environment because a game of chance may be presented on surfaces modeled in the 3-D gaming environment that may be hidden from view. Since the viewpoint in the 3-D model may be varied, the player or gaming machine may zoom-in on one or more games of interest, some of which may be hidden in a current 2-D view, and select a desirable resolution level. Thus, all of the games or game components do not have to be rendered on a single screen simultaneously.

Figure 2:
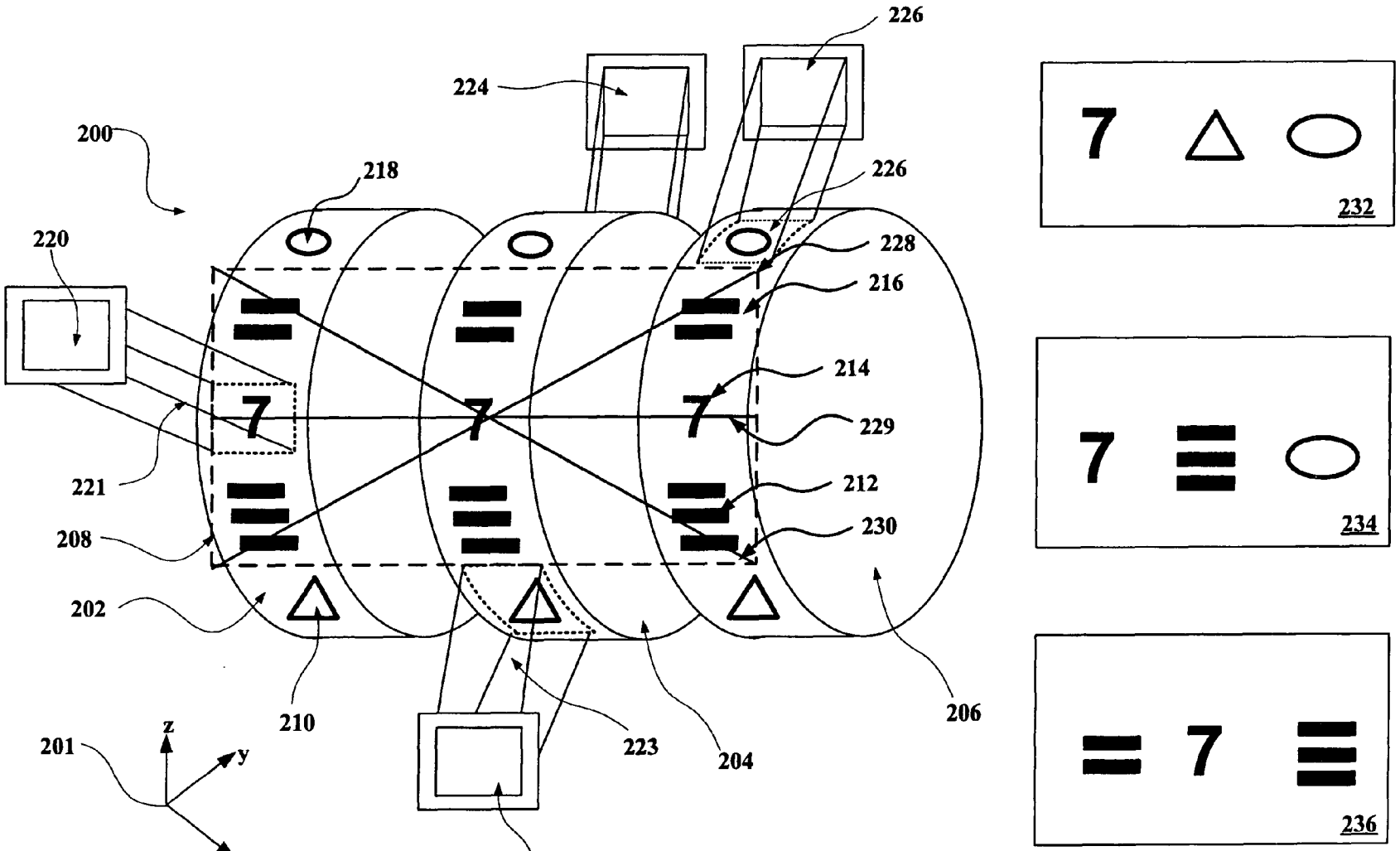
FIG. 2 is a is a perspective drawing of virtual slot reels in a 3-D virtual gaming environment implemented on a gaming machine for one embodiment of this invention.

FIG. 2 is a is a perspective drawing of three virtual slot reels, 202, 204 and 206 in a 3-D virtual gaming environment 200 implemented on a gaming machine for one embodiment of this invention. The three slot reels are modeled as cylinder portions in coordinate space 201. The reels appear to be hanging space. Different symbols are rendered on each reel including a triangle 210, a triple bar 212, a "seven" 214, double bar 216 and an oval 218. Other symbols (not shown) may be rendered on the backs of the reels. In a virtual 3-D slot gaming environment, such as 200, a size of the reels, a number of reels, a number of symbols on the reels and types of symbols on the reels may be varied. Also, background scenery (not shown) may be also varied in the environment.

A window 208 is rendered over the reels, 202, 204 and 206, to illustrate a number of symbols that may be visible on a mechanical slot display. At most, nine symbols, e.g. the three double bars, three sevens and three triple bars may be viewed on the mechanical slot display. When multiple symbols are viewed by the player, the multiple symbols may be used to generate multiple paylines that may be wagered on during game play.

When reels on a gaming machine stop after a wager has been received and a game has been initiated, a combination of symbols along a payline may be compared to winning combinations of symbols to determine an award for the game. For instance, three paylines 228, 229 and 230 are shown. Three "sevens" symbols are along payline 229. A triple bar, a seven and a double bar are shown along paylines 228 and 230. Often triple seven combination is used as a winning combination on slot games. The number of paylines increases the betting opportunities for a given game and multiple payline games are desired by some players. In some slot games, only a single line of symbols may be viewed, such as the three sevens, and a player may bet on only a single payline.

For a game outcome presentation, the slot reels 202, 204 and 206 may each begin to rotate and move in the virtual gaming environment. In the virtual space 200, the reels may rotate in different directions, translate, rotate around different axis, shrink in size or grow in size as the reels are not limited by the constraints of actual mechanical slot reels. During the game outcome presentation, a virtual camera, which may vary its position as a function of time, may film a sequence (e.g., generate a number of photographs in a sequence) that are displayed on a display screen on the gaming machine and that capture the motion of the reels.

A number of virtual cameras may be positioned in the virtual gaming environment 200 to capture one or more symbols on the slot reels. For instance, lens 220 of a virtual camera captures the "7" symbol on reel 202 in volume 221 of the virtual gaming environment 200. Lens 222 of a virtual camera captures the "triangle" symbol on reel 204 in volume 223 of the virtual gaming environment. Lens 224 of a virtual camera captures a "triple bar" symbol (not shown) on reel 204 of the virtual gaming environment. Finally, Lens 226 of a virtual camera captures the "oval" symbol on reel 206 in volume 226 of the virtual gaming environment. However, a single virtual camera may also by used to capture multiple symbols such as a line of symbols across multiple reels.

The symbols captured from the virtual cameras using lens 220, 222, 224 and 226 may be used to create various paylines that may be used for wagering. For example, the symbols captured from lens 220, 222 and 226 are used to generate a first combination of symbols 232 which may wagered on during game play. The symbols captured from lens 220, 224 and 226 are used to generate a second combination of symbols 234 which may wagered on during game play. Finally, virtual cameras may be positioned along payline 230 to capture the combination of symbols 236.

In the present invention, the number of paylines that may be implemented is quite large. For instance, for three virtual reels with 25 symbols on each reel, 253 paylines may be utilized. In one embodiment, to aid in the display of a large amount of gaming information generated in one virtual gaming environment, gaming information generated in a first gaming environment may be transferred to a second gaming environment. For example, gaming information regarding combinations of symbols along a plurality of paylines generated in gaming environment 200 may be transferred to a second gaming environment with virtual cameras for rendering it to a display viewed by a player.

In another embodiment, the slot reels 202, 204, 206 may be appear translucent such that symbols on the back of the reel may be visible from the front. Paylines, that may be wagered on by a player, may be rendered in "virtual space" to connect symbols on the front of a reel to a symbol on the back of the reel. For instance, a payline may be rendered from the front of reel 202 to the back of reel 204 and to the front of reel 206.

Figure 3:
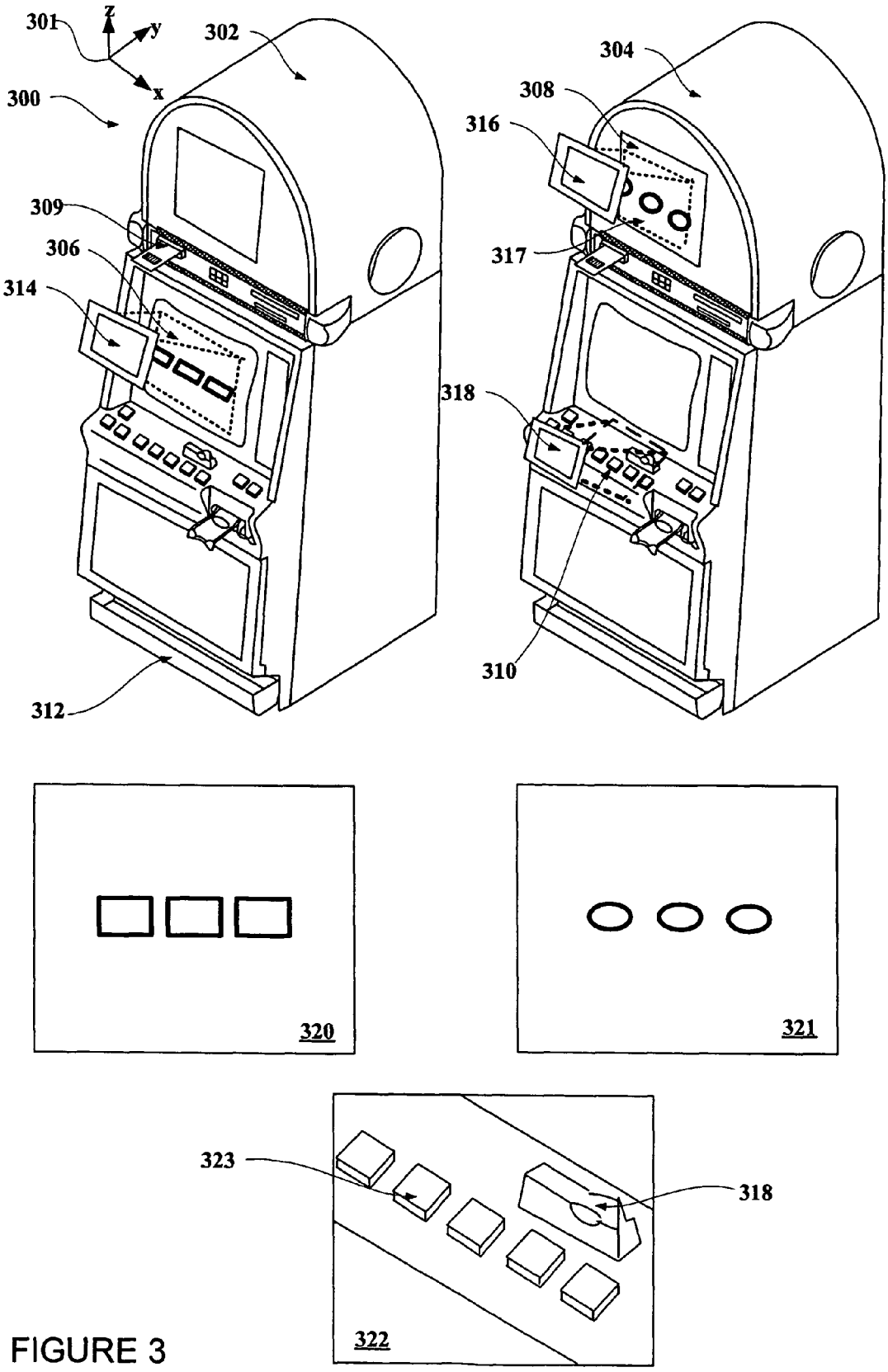
FIG. 3 is a is a perspective drawing of two gaming machines in a 3-D virtual gaming environment implemented on a gaming machine for one embodiment of this invention.

FIG. 3 is a is a perspective drawing of two gaming machines in a 3-D virtual gaming environment 300 implemented on a gaming machine for one embodiment of this invention. In the gaming environment 300, two gaming machines 302 and 304 with components, such as a main display 306, a secondary display, input buttons 310, a coin hopper 312 and a coin acceptor 318 are modeled in coordinate space 301. Other features of the gaming machines are described with respect to FIG. 5.

Three "photographs" 320, 321 and 322 from virtual cameras with lenses 314, 316 and 318 are shown. Photograph 320 shows a slot game display on the virtual gaming machine 302 and photograph 321 shows a bonus game display on the virtual gaming machine 304. Both photographs may be displayed on an actual display on the physical gaming machine. During a game outcome presentation, a virtual camera with lens 314 may show a game outcome on virtual main display 306 on gaming machine 302 and then when a bonus game is triggered the position of the virtual camera may be continuously moved to the position of 316 to capture the bonus game display on virtual secondary display 308 on gaming machine 304. When a player wins an award, the virtual camera may move to a position over virtual hopper 312 and virtual coins may be added to the hopper to simulate a win.

In another embodiment of the present invention, each gaming machine 302 and 304 may show a different game on its virtual main display. A player may be able to move a virtual camera in gaming environment 300 using input buttons on the real gaming machine to select either the game displayed on gaming machine 302 or the game displayed on gaming machine 304 for a game play. In another example, the player may be able to select both gaming machines 302 and 304 for simultaneous game play and make a single wager or separate wagers for the games played on each machine. The game player may then operate the virtual camera to examine the game outcome for each game such as zoom-in on one of the displays on gaming machine 302 or 304.

The gaming machines may be modeled from CAD/CAM drawings of actual gaming machines or other modeling formats. In one embodiment of the present invention, the physical gaming machine on which a game is played may be modeled as a virtual gaming machine in a virtual gaming environment such as 300. The virtual gaming machine in the virtual environment may be used to demonstrate various operating and maintenance features for the real gaming machine. For example, when a player needs to press an input button to play a game, a virtual input button 323 being depressed (see photograph 322) modeled from the physical gaming machine may be shown on the display screen of the gaming machine to aid the player. As another example, a player may be shown how to correctly insert a player tracking card into a card reader on the gaming machine using the virtual gaming machine. In yet another example, the player may be shown how to perform an electronics funds transfer, how to view an alternate video presentation or how to view other entertainment content available on the gaming machine. In another embodiment, a player may be required to use an electronic key with a gaming device connected to the gaming machine. For example, an electronic key may be used to gain access a particular function on the gaming machine. The electronic key may be compatible with one or more communication protocols used by the gaming device such as but not limited to wire communication protocols like USB, serial, parallel, Firewire and wireless communication protocols like IrDA, IEEE 802.11a, IEEE802.11b and Bluetooth.

Various maintenance procedures may be modeled in the virtual gaming environment which may be used to aid a person performing a maintenance operation on the gaming machine. A virtual 3-D maintenance manual may be stored on the gaming machine or on a remote host accessible to the gaming machine. For instance, a procedure for adding paper to printer on the gaming machine may be modeled in a 3-D virtual gaming environment. When a casino service person changes the paper in the printer, a 3-D simulation of the procedure using a virtual model of gaming machine 302 with printer 309 may be rendered on the display screen of the actual gaming machine to aid the service person.

Figure 4:
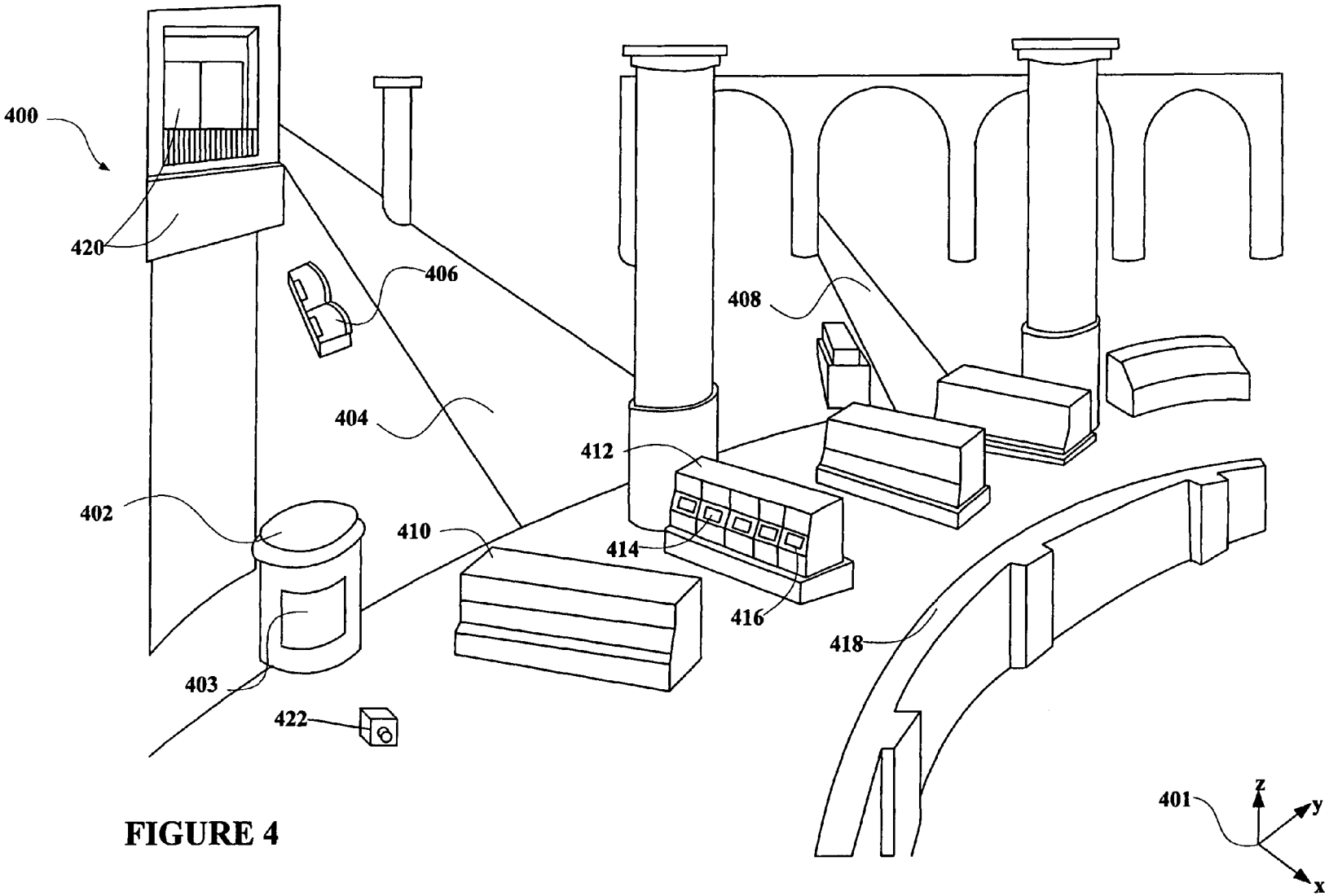
FIG. 4 is a is a perspective drawing of a virtual casino in a 3-D virtual gaming environment implemented on a gaming machine for one embodiment of this invention.

FIG. 4 is a is a perspective drawing of a virtual casino in a 3-D virtual gaming environment 400 implemented on a gaming machine for one embodiment of this invention. The virtual casino may be an actual model of the casino where the game is being played. The virtual casino is modeled with banks of gaming machines, such as 410 and 412, architectural features, such as window and balcony 420 and wall 418, gaming tables 406, walkways, such as 404 and 408, a casino kiosk 402 with a kiosk display 403, pillars and arches. The virtual casino is modeled in coordinate system 401.

The virtual casino may be used by the player to select various games to play on the physical gaming machine by operating a virtual camera 422 in the 3-D gaming environment 400. For instance, the player may be able to position the virtual camera to select between games played on gaming machines 414 and 416 or a table game played at table 406. The player or gaming program may move the camera 422 to follow path 404 or 408 to enter a different room as part of a game presentation. For example, a player may be shown a "treasure" or secret room as part of bonus game on the gaming machine. The treasure room may correspond to a theme consistent with the theme of the casino.

When the actual casino where the gaming machine is located is modeled in the gaming machine, a player may use the virtual casino to explore and locate various casino features such as restaurants and shops or locate another game player in the casino. Also, the virtual casino may also be used to give the player directions. As another example, the virtual casino may be used to locate other player and perhaps initiate a conversation with another player (e.g. instance messaging). Further, the virtual casino may be used by the player as an interface to obtain gaming information and casino services. For instance, the player may go to the virtual kiosk 403 to obtain information about their player tracking account, to redeem a prize or make dinner/entertainment reservations. As another example, a player may go to a virtual bar or a virtual café to order a drink or a snack.

Turning to FIG. 5, a video gaming machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The main display monitor 34 will typically be a cathode ray tube, high resolution flat-panel LCD, plasma/LED display or other conventional electronically controlled video monitor. The gaming machine 2 includes a top box 6, which sits on top of the main cabinet 4. A second display monitor 42 may be provided in the top box. The second display monitor may also be a cathode ray tube, high resolution flat-panel LCD or other conventional electronically controlled video monitor.

Typically, after a player has initiated a game on the gaming machine, the main display monitor 34 and the second display monitor 42 visually display a game presentation, including one or more bonus games, controlled by a master gaming controller (not shown). The bonus game may be included as a supplement to the primary game outcome presentation on the gaming machine 2. The video component of the game presentation consists of a sequence of frames refreshed at a sufficient rate on at least one of the displays, 34 and 42, such that it appears as a continuous presentation to the player playing the game on the gaming machine. Each frame rendered in 2-D on display 34 and/or 42 may correspond to a virtual camera view in a 3-D virtual gaming environment stored in a memory device on gaming machine 2.

One or more video frames of the sequence of frames used in the game presentation may be captured and stored in a memory device located on the gaming machine. The one or more frames may be used to provide a game history of activities that have occurred on the gaming machine 2. Details of frame capture for game history applications are provided co-pending U.S. application Ser. No. 09/689,498, filed on Oct. 11, 2000 by LeMay, et al., entitled, "Frame Buffer Capture of Actual Game Play," which is incorporated herein in its entirety and for all purposes.

Returning to the gaming machine in FIG. 5, the information panel 36 may be a back-lit, silk screened glass panel with lettering to indicate general game information including, for example, the denomination of bills accepted by the gaming machine (e.g. $1, $20, and $100). The bill validator 30, player-input switches 32, video display monitor 34, and information panel are devices used to play a game on the game machine 2. The devices are controlled by the master gaming controller, which is located inside the main cabinet 4 of the machine 2.

In the example, shown in FIG. 5, the top box 6 houses a number of devices, which may be used to input player tracking information or other player identification information into the gaming machine 2, including the bill validator 30 which may read bar-coded tickets 20, a key pad 22, a florescent display 16, and a camera 44, and a card reader 24 for entering a magnetic striped cards or smart cards. The camera 44 may be used to generate player images that are integrated into a virtual gaming environment implemented on the gaming machine. The key pad 22, the florescent display 16 and the card reader 24 may be used to enter and display player tracking information. In addition, other input devices besides those described above may be used to enter player identification information including a finger print recording device or a retina scanner. Methods and apparatus for capturing a player's image to a video frame is described in co-pending U.S. patent application Ser. No. 09/689,498, by LeMay et al. filed on Oct. 11, 2000 and titled "Frame Buffer Capture of Actual Game Play" is incorporated herein in its entirety and for all purposes.

In addition to the devices described above, the top box 6 may contain different or additional devices than those shown in the FIG. 5. For example, the top box may contain a bonus wheel or a back-lit silk screened panel which may be used to add bonus features to the game being played on the gaming machine. During a game, these devices are controlled and powered, in part, by the master gaming controller circuitry (not shown) housed within the main cabinet 4 of the machine 2.

Understand that gaming machine 2 is but one example from a wide range of gaming machine designs on which the present invention may be implemented. For example, not all suitable gaming machines have top boxes or player tracking features. Further, some gaming machines have only a single game display—mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a "slim" terminal, a personal computer (such as a laptop or a desktop computer), a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

Returning to the example of FIG. 5, when a user selects a gaming machine 2, he or she inserts cash through the coin acceptor 28 or bill validator 30. Additionally, the bill validator may accept a printed ticket voucher, which may be accepted by the bill validator 30 as an indicia of credit. Once cash or credit has been accepted by the gaming machine, it may be used to play a game on the gaming machine. Typically, the player may use all or part of the cash entered or credit into the gaming machine to make a wager on a game play. During the course of a game, a player may be required to make a number of decisions which affect the outcome of the game. For example, a player may vary his or her wager, select a prize, or make game-time decisions which affect the game play. These choices may be selected using the player-input switches 32, the main video display screen 34 or using some other device which enables a player to input information into the gaming machine including a key pad, a touch screen, a mouse, a joy stick, a microphone and a track ball.

In some embodiments, to change the format of a game outcome presentation on the gaming machine or to utilize different gaming machine functions, the player may use an input device on the gaming machine to control a virtual camera in a virtual gaming environment implemented on the gaming machine. For instance, a player may use the virtual camera to "zoom in" or "expand on demand" a portion of the virtual gaming environment such as one poker hand of a hundred poker hands displayed on display screen 34. In another example, the game player may alter the game outcome presentation, such as the view or perspective of the game outcome presentation, by controlling the virtual camera. In yet another example, the player may be able to select a type of game for game play on the gaming machine, select a gaming environment in which a game is played, receive casino information or obtain various casino services, such as dinner reservations and entertainment reservations, by navigating through a virtual casino implemented on the gaming machine. The virtual casino may correspond to the actual casino where the gaming machine is located. Thus, the virtual casino may be used to give the player directions to other portions of the casino.

In other embodiments of the present invention, CAD/CAM models of the gaming machine 2 may be used to generate a virtual 3-D model of the gaming machine. The virtual 3-D model may be used to visually demonstrate various operating features of the gaming machine 2. For instance, when a player tracking card is inserted incorrectly in the card reader 24, the virtual 3-D model of the gaming machine may be used to display a visual sequence of the card being removed from the card reader 24, flipped over and correctly inserted into the card reader 24. In another example, a visual sequence showing a player inputting an input code on the key pad 22 may be used to prompt and show the player how to enter the information. In another example, when the gaming machine 2 is expecting an input from the player using one of the player input switches 32, the virtual 3-D model of the gaming machine may be used to display a visual sequence of the correct button on the gaming machine being depressed. In yet another example, the manner in which a bill or ticket is inserted into the bill validator may be shown to the player using a sequence of photographs generated from the 3-D model.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights behind the belly glass 40. The ability of a player to control a virtual camera in a virtual gaming environment to change the game outcome presentation may also add to the excitement of the game. After the player has completed a game, the player may receive game tokens from the coin tray 38 or the ticket 20 from the printer 18, which may be used for further games or to redeem a prize.

Figure 6:
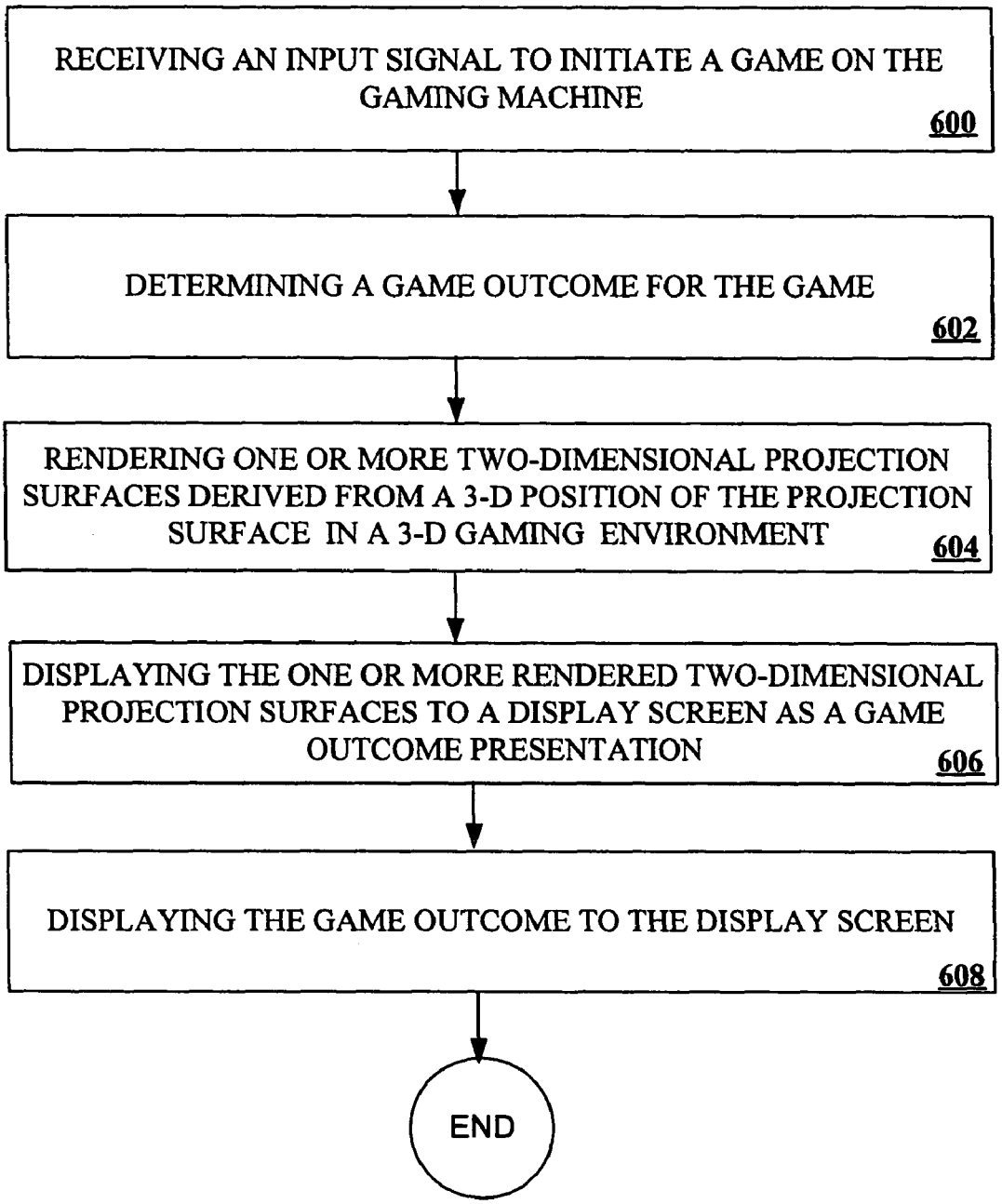
FIG. 6 is a flow chart depicting a method for generating a game outcome presentation using a 3-D virtual gaming environment.

FIG. 6 is a flow chart depicting a method for generating a game outcome presentation from a virtual gaming environment. In 600, after receiving a wager for one or more games played on a gaming machine, an input signal is received on the gaming machine to initiate a game of chance. The input signal may be input by a player using a various input devices available on the gaming machine, such as input buttons and a touch screen. In 602, one or more game outcomes are determined for the one or more games initiated by the game player. Typically, a game outcome is determined by generating one or more random numbers and comparing the numbers with a paytable stored on the gaming machine.

In 603, based upon the one or more game outcomes determined in 602, one or more game displays is rendered in a 3-D virtual game environment in the gaming machine. In 604, at least one virtual camera in the 3-D gaming environment is used to render a sequence of 2-D projection surfaces (e.g. images) derived from three-dimensional coordinates of surfaces in the 3-D gaming environment. As described with reference to FIG. 2, the position of the virtual camera may vary with time. In 606, the sequence of rendered 2-D projection surfaces is displayed to one or more game display screens on the gaming machine as part of a game outcome presentation or a bonus game presentation. In 608, the game outcome (e.g. an amount awarded for one or more games) is displayed to the display screen. The method described above is not limited to game outcome presentations. Other types of gaming information such as attract mode presentations, maintenance operation information, game operation information and casino information may be generated in a 3-D virtual gaming environment and displayed to a display screen on the gaming machine. Further, transition screens that allow a smooth transition between different gaming presentations may also be generated and displayed on the display screen. For instance, a transition screen may be generated to for a display a smooth transition between a game outcome presentation and a bonus game.

Figure 7:
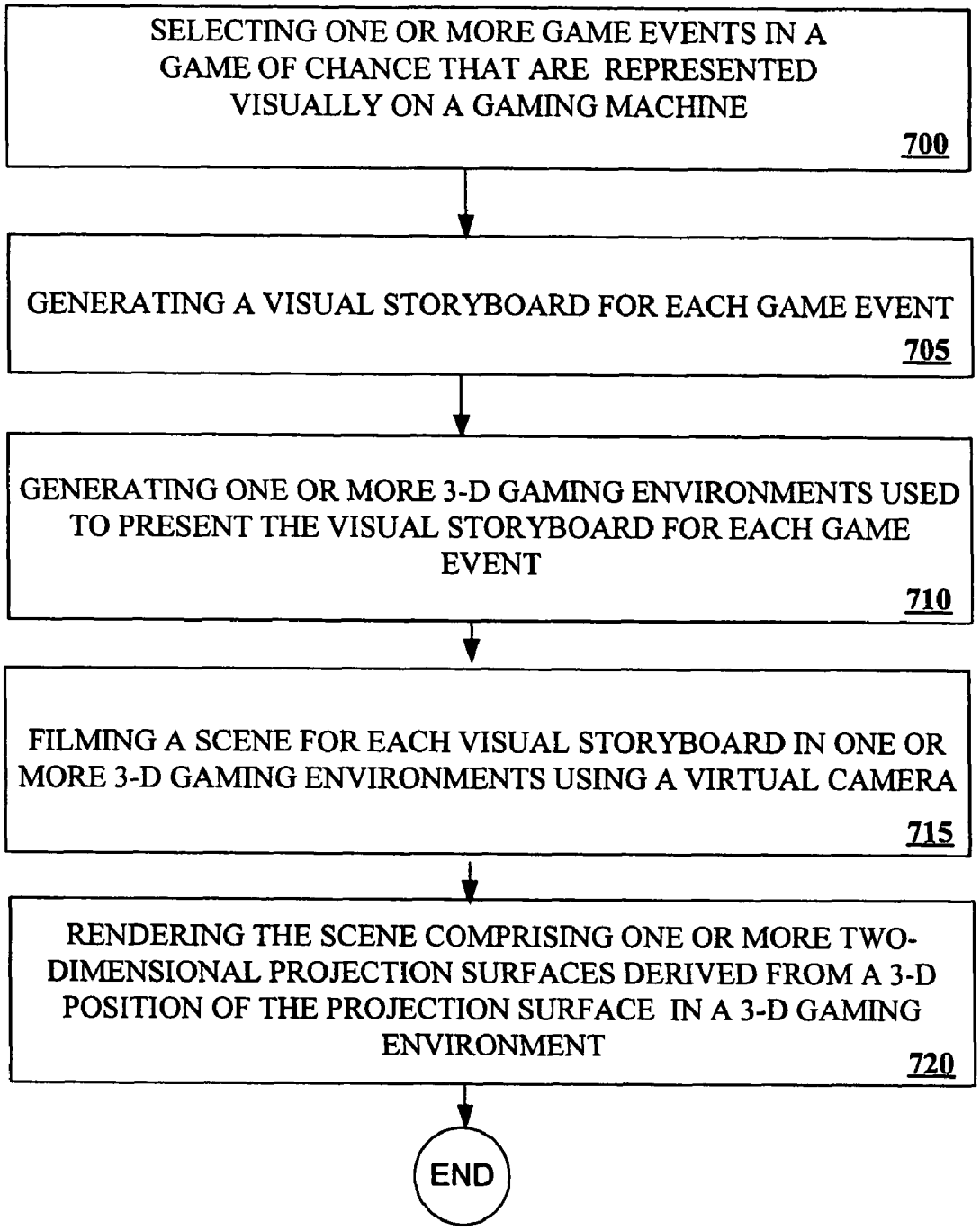
FIG. 7 is a flow chart depicting a method for generating a game of chance using a virtual gaming environment.

FIG. 7 is a flow chart depicting a method for generating a game using a 3-D virtual gaming environment. In 700, game events that comprise a game of chance played on the gaming machine and are represented visually are selected. In 705, a 3-D visual storyboard describing a scene in one or more virtual gaming environments is generated for each game event. The scene information may include virtual camera positions as a function of time in one or more gaming environments. For instance, a story board for cards being dealt in a card game may describe a pair of 3-D hands dealing the card over a gaming table with a virtual camera positioned directly above the gaming table looking down at the hands. In 710, a scene corresponding to the 3-D visual storyboard for each game event is generated in one or more 3-D virtual gaming environments. In 715, a scene corresponding to the visual storyboard for each game event is "filmed" in the one or more 3-D gaming environment. Filming each game event in the 3-D gaming environment comprises selecting a sequence of virtual camera positions and angles in the one or more 3-D gaming environments. In some embodiments, a player may control the position of the virtual camera in some manner. In 720, a sequence of 2-D projection surfaces (e.g. virtual camera images) derived from three-dimensional coordinates of surfaces in the 3-D gaming environment are rendered to a display screen on the gaming machine.

In the present invention, multiple "photographs" may be simultaneously generated from multiple virtual cameras located in one or more 3-D gaming environments on a gaming machine. The photographs may be displayed on one or more display screens available on the gaming machine. In addition, virtual cameras may be located in virtual 3-D gaming environments located on remote gaming devices, such as remote servers or other gaming machines, in communication with the local gaming machine. For instance, a plurality of linked gaming machines may "share" a 3-D gaming environment and players on each of the plurality of gaming machines may be able to see activities of other players in the "shared" 3-D gaming environment and possible interact with other players in the shared 3-D gaming environment. For instance game players may be able to play games against other game players or play games with other game players. The gaming machines may be linked via a local area network, a wide area network, the Internet, private intranets and virtual private intranets.

A plurality of photographs from virtual cameras in one or more 3-D gaming environments may be arranged as a number of smaller game windows on a display screen on the gaming machine. For example, the display screen may be divided into four equally sized game windows. As another example, a smaller game window may be generated within a larger game window on the display screen like picture-in-picture on a Television. The multiple game windows may contain photographs generated from 3-D virtual gaming environments both local and remote to the gaming machine. In addition, the multiple game windows may contain information from other sources. For instance, the game windows may each contain entertainment content such as an advertisement, news, stock quotes, electronic mail, a web page, a message service, a locator service or a hotel/casino service, a movie, a musical selection, a casino promotion and a broadcast event. Further, the windows may contain traditional casino games generated from 2-D objects.

Figure 8:
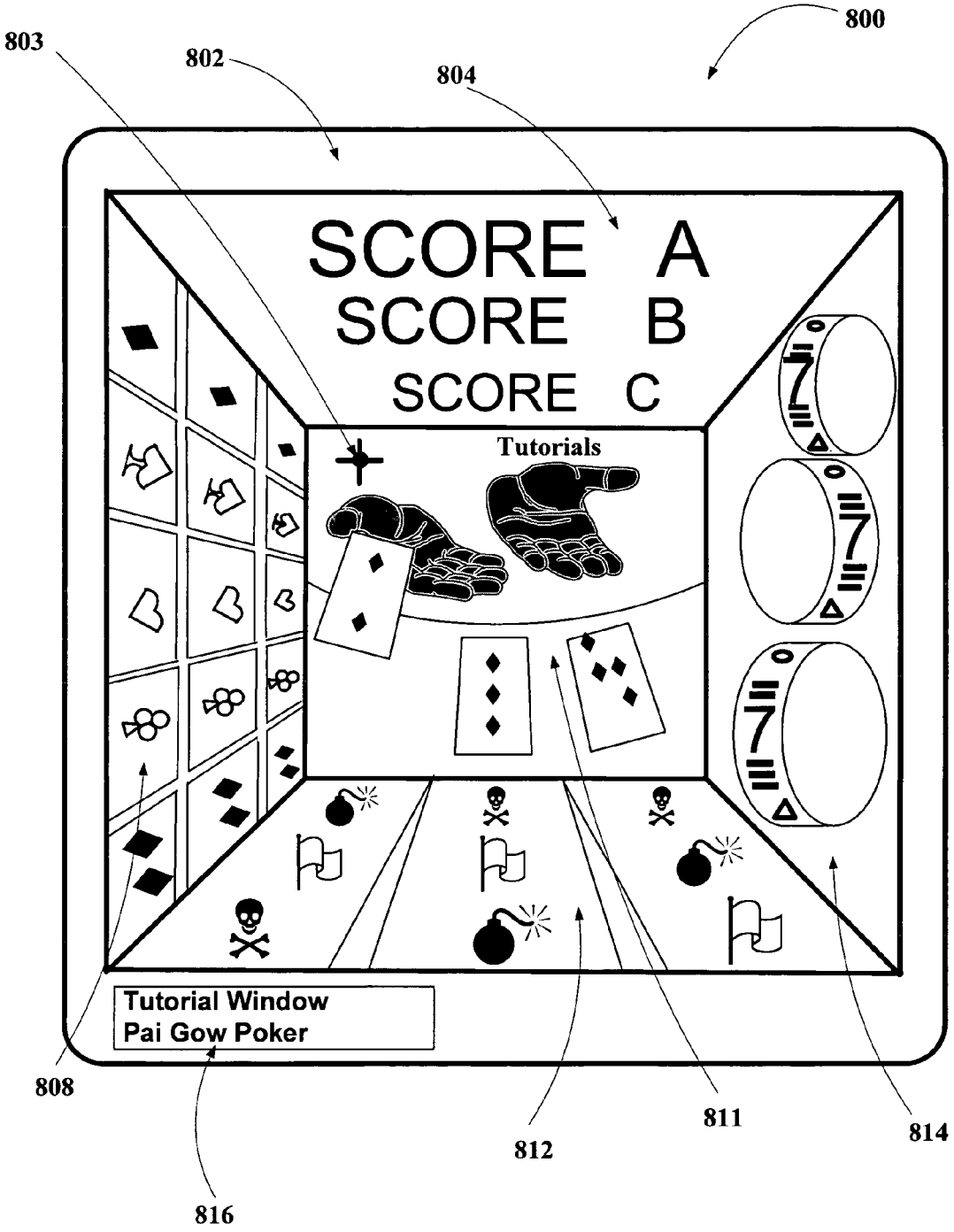
FIGS. 8 and 9 are perspective drawings of a 3-D interface for a gaming machine.
Figure 9:
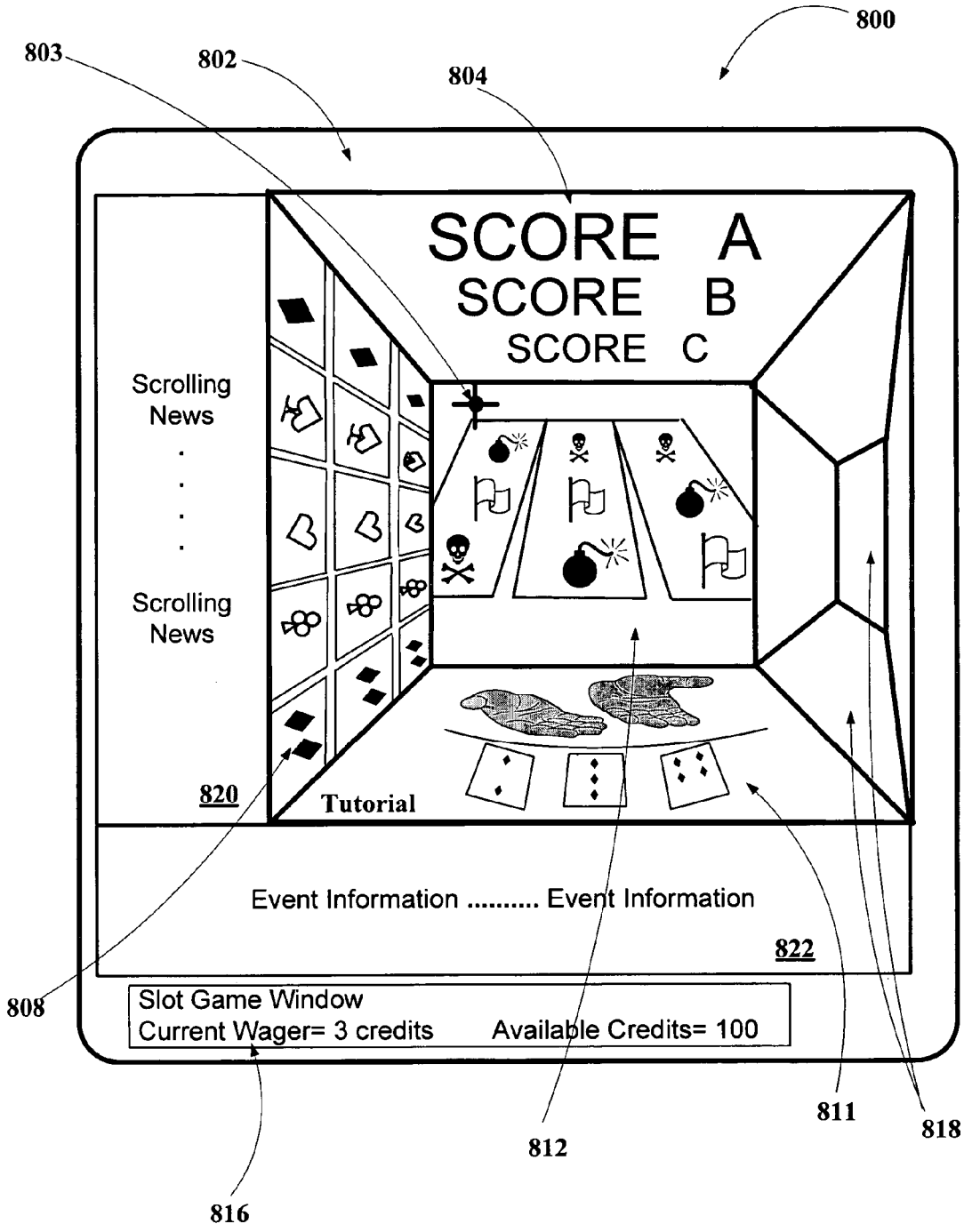

The present invention is not limited to windows arranged in an essentially planar manner on the display screen, i.e. rectangular windows arranged side by or over-layered on top of one another. A 3-D interface may be employed where the game windows are arranged in 3-D geometric pattern. In one embodiment, the 3-D interface may be a virtual 3-D gaming environment used to organize gaming information for viewing by a game player. FIGS. 8 and 9 are perspective drawings of a 3-D interface 800 for a gaming machine for one embodiment of the present invention.

In FIG. 8, six 3-D game windows are arranged on a display screen 802. Five of the 3-D game windows, 804, 808, 811, 812 and 814 are arranged in a cubic manner and one game window, 816, is displayed on a surface essentially parallel to the display screen. The cubic arrangement of the windows may be generated by rendering an open box in a 3-D virtual gaming environment. The five sides of the box are each used as a game window. Next, the game information shown in each of the five 3-D game windows are rendered to the 5 sides of the box. Then, a virtual camera positioned directly above the box may be used to render the photograph displayed on the display screen 802. With this approach any of the methods described above with regard to manipulating a virtual camera in a virtual camera in a 3-D gaming environment may be applied to the 3-D interface 800.

In FIG. 8, game window 804 is used to display attract information, game window 814 is used to display a bonus slot reel game, game window 812 is used to display a slot game, game window 808 is used to display a multi-hand card game and game window 811 is used to display a gaming tutorial. The displaying of information in the 3-D interface 800 may involve multiple transformations and rendering in different game environments. For instance, the multi-hand card game may be rendered in a first gaming environment. Then, a virtual camera in the first gaming environment may be used to generate a photograph showing a portion of the multi-hand card game (e.g. 3-D to 2-D transformation). Then, the photograph may be rendered in the game window 808 in the 3-D interface virtual environment (2-D to 2-D transformation). Next, a virtual camera in the 3-D interface environment may be used to render a photograph including game window 808 which is displayed on at least one display screen on the gaming machine (3-D to 2-D transformation). Game information may also be directly rendered into game windows in the 3-D interface virtual environment. For instance, the attract information in game window 804 may be directly rendered in the 3-D interface virtual environment.

The information in each of the windows is mapped to a particular side of the cube in the 3-D interface gaming environment. In one embodiment, a user of the 3-D interface may be able manipulate the mapping of the game windows. For example, a user may be able to exchange the position of various game windows such as exchanging the position of windows 811 and window 812 (see FIG. 9). When the game windows are exchanged, the 3-D interface may appear to rotate or move in some manner and other game windows may appear on the display screen while other windows may move off of the display screen. As another example, when the mapping is changed, the game windows may be re-rendered with the game information in each of the windows swapped.

Game window 816 is used to convey game window information about active game windows on the display screen 802. An "active game window" is a game window that may be operated actively by a user of the gaming machine. The user may use an input mechanism on the gaming machine such as a touch screen or mouse with cursor 803 to select a window for activation. In FIG. 8, the active game window is 811 which is being used to present a tutorial for playing a card game. Game 816 indicates that the tutorial is for "Pai gow poker." The user may move a cursor over different game windows in the 3-D game interface to obtain information about each game window. For instance, when the cursor 803 is moved from game window 811 to game window 812, the information in the game information window 816 may change to indicate that game window 812 is a slot game.

In one embodiment, the game windows may contain shared information. For instance, the multi-hand card game window 808 may be a shared game where each of the three card hands is played by a different player and the players are competing against one another. Therefore, the game window 808 may be used to participate in a card game tournament but also engage in other activities while watching the activities occurring in the game tournament. As another example, two players may be able to compete in a game of checkers. In another example, the bonus game 814 window may display a bonus game that is triggered by the activities of multiple players linked together on different gaming machines. Further, the bonus game may be visible to each of the players participating in the bonus game.

The players playing the shared game may be participating via different gaming machines. To share the game, the gaming machines may be linked via a local area network, a wide area network or combinations thereof. A remote gaming device in communication with a group of gaming machines, such as game sharing server or a tournament game server, may also be used to enable game sharing between groups of gaming machines.

Updates of game windows may occur in a simultaneous manner. Thus, while a game player is using a first game window, information in other game windows may be updated. For instance, while the game player is watching the tutorial in game window 811 updates of the multi-hand card game window 808, such as cards being dealt, may be occurring. As another example, a live video feed such as sporting event may be viewed in one of the game windows. As the live video feed is continually updated, the game player may play a game of chance in one of the other game windows.

In another embodiment, the multi-hand card game in the multi-hand card game window 808 may be a multi-hand poker game. The multi-hand poker game may be rendered in a 3-D multi-hand poker hand gaming environment. The number of hands rendered may range from 1 to a very large number of hands (e.g. millions) However, a thousand poker hands may be a practical upper limit. In this game, the player may select the number of hands to be played by betting. The player may select coins (wager amount) per hand and increment the bet until the player reaches the desired number of hands or all the hands available for betting (e.g. the maximum number) have been selected. The maximum number of hands available for betting may be some reasonable limit, such as 1000. The maximum number of hands can be set in the gaming machine such is in the game configuration or paytable configuration.

In one embodiment of the multi-hand poker game generated in a 3-D gaming environment, the player initiates a game and a first hand consisting of five cards is dealt with the types of cards showing (e.g. face card or number card as well as a suit). The remaining hands are dealt showing only card backs. When the player holds a card, the other hands show the same hold cards, When a player unholds, the other hands unhold. When the player selects redraw, the hands all start drawing the new cards from unique decks (with the original hold cards removed from all of them). To display the game, a virtual camera could fly over each of hands as they are being rendered to generate an effect similar to the text at the beginning of the "Star Wars" movies (e.g. the hands appear to be scrolling up the screen in "space", shrinking and disappearing into the horizon as the hands move farther away. Once the virtual camera reaches the last hand, it can reset to the main hand i.e., the original dealt hand, which now has its own unique rendered cards. The user could also manually control the camera to review the cards, or start playing again. In addition, the cards could be displayed in multiple game windows of the 3-D interface 800.

In FIG. 9, another embodiment of the 3-D interface 800 is shown. The cubic arrangement of the windows has been reduced in size in the display screen 802 as compared to FIG. 8. An important advantage of the present invention is the ability to scale objects (either larger or smaller) and then render objects in the virtual gaming environment with proper perspective. When 2-D objects are scaled by any significant amount, the scaling can distort the rendered objects reducing the quality of any graphics presentation using the scaled 2-D object.

On the display screen 802 in FIG. 9, the mapping of the game windows has been changed as compared to FIG. 8. The tutorial game window 811 has been exchanged with the slot game window 812. The slot game window has become the "active" window as indicated by the cursor 803. The game information window indicates that the player has wagered 3 credits on the slot game shown in the slot game window 812 and has 100 credits available for game play.

The bonus game window 814 in FIG. 8 has been replaced with 5 additional game windows 818 arranged in a cubic pattern. These game windows may be selected by a user and rotated into view to replace game windows 804, 808, 811 and 812. The present invention is not limited to the arrangement of game windows as shown in FIGS. 8 and 9 which are presented for illustrative purposes only. A 3-D game interface environment may be generated that uses nearly an unlimited variety of game window arrangements. For example, the game windows may be arranged on any combination of different polyhedron surfaces. Some game windows may be rendered on curved game surfaces and the colors of different game windows may vary to aid a user in identifying various features of the 3-D game interface. For instance, the active game window may be displayed with a green border.

Two additional game windows, 820 and 822 around game windows, 804, 806, 808, 811, 812 and 818. Game window 820 displays scrolling news while game window 822 displays casino event information. Game windows 820 and 822 may be used to display button menus, game service menus, entertainment content and any other type of information that may be displayed in any other game window. In one embodiment, game windows 820 and 822 may be displayed and then removed. When the game windows, 820 and 822, are removed the other game windows in the screen may be enlarged to fill the space occupied by game windows 820 and 822. The shrinking and enlarging of the windows may be initiated by a player playing the game or may be triggered by game events occurring during game play on the gaming machine.

Figure 10:
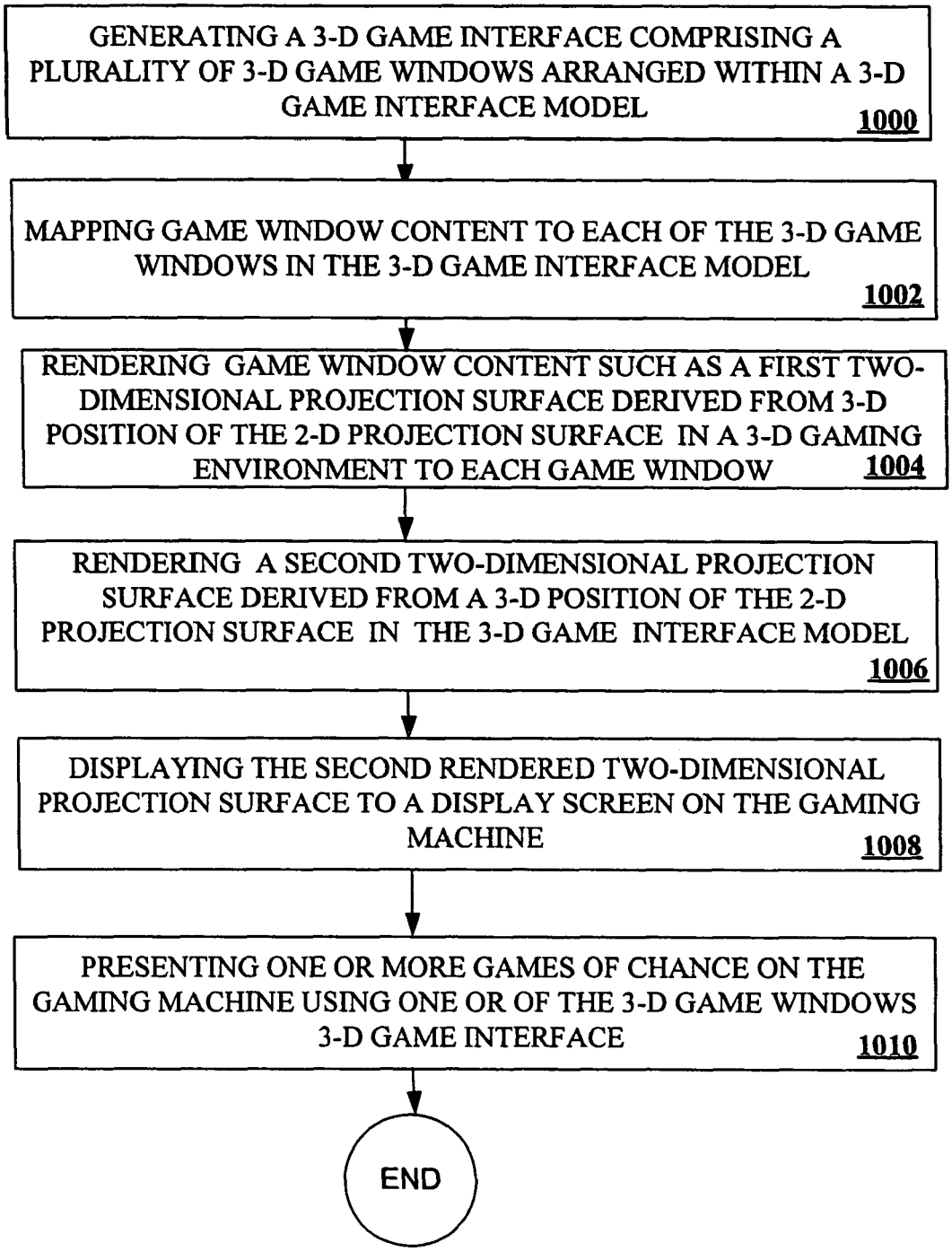
FIG. 10 is a flow chart depicting a method of playing a game on a gaming machine using a 3-D interface.

FIG. 10 is a flow chart depicting a method of playing a game on a gaming machine using a 3-D interface. In 1000, a 3-D game interface is generated. The 3-D game interface comprises a plurality of game windows arranged within a 3-D game interface model or environment as described with respect to FIGS. 8 and 9. In 1002, game window content is mapped to each of the 3-D game windows in the 3-D game interface model. The game window content may be a game of chance, bonus game, entertainment content as previously described, or even a blank window. The game window content map may be used to allow the contents in each of the game windows to be redistributed in different game windows to create a new game window content map. For example, as described above, the content in two game windows may be swapped.

In 1004, the game window content in each game window is rendered to the game window. In one embodiment, a first two-dimensional projection surface (e.g., an image from a virtual camera) derived from a 3-D coordinates of a first surface in a 3-D gaming environment may be rendered to one or more of the game windows in 3-D game interface model. In 1006, a virtual camera in the 3-D game interface model may be used to render a second two-dimensional projection surface derived from a 3-D coordinates of a second surface in the 3-D game interface model. In 1006, the rendered second two-dimensional projection surface may be displayed to at least one display screen on the gaming machine. In 1010, one or more games of chance may be presented on the gaming machine using one or more of the 3-D game windows in the 3-D game interfaces. As previously described, multiple games of chance presented in multiple game windows may be played in a sequential or parallel manner.

Figure 11:
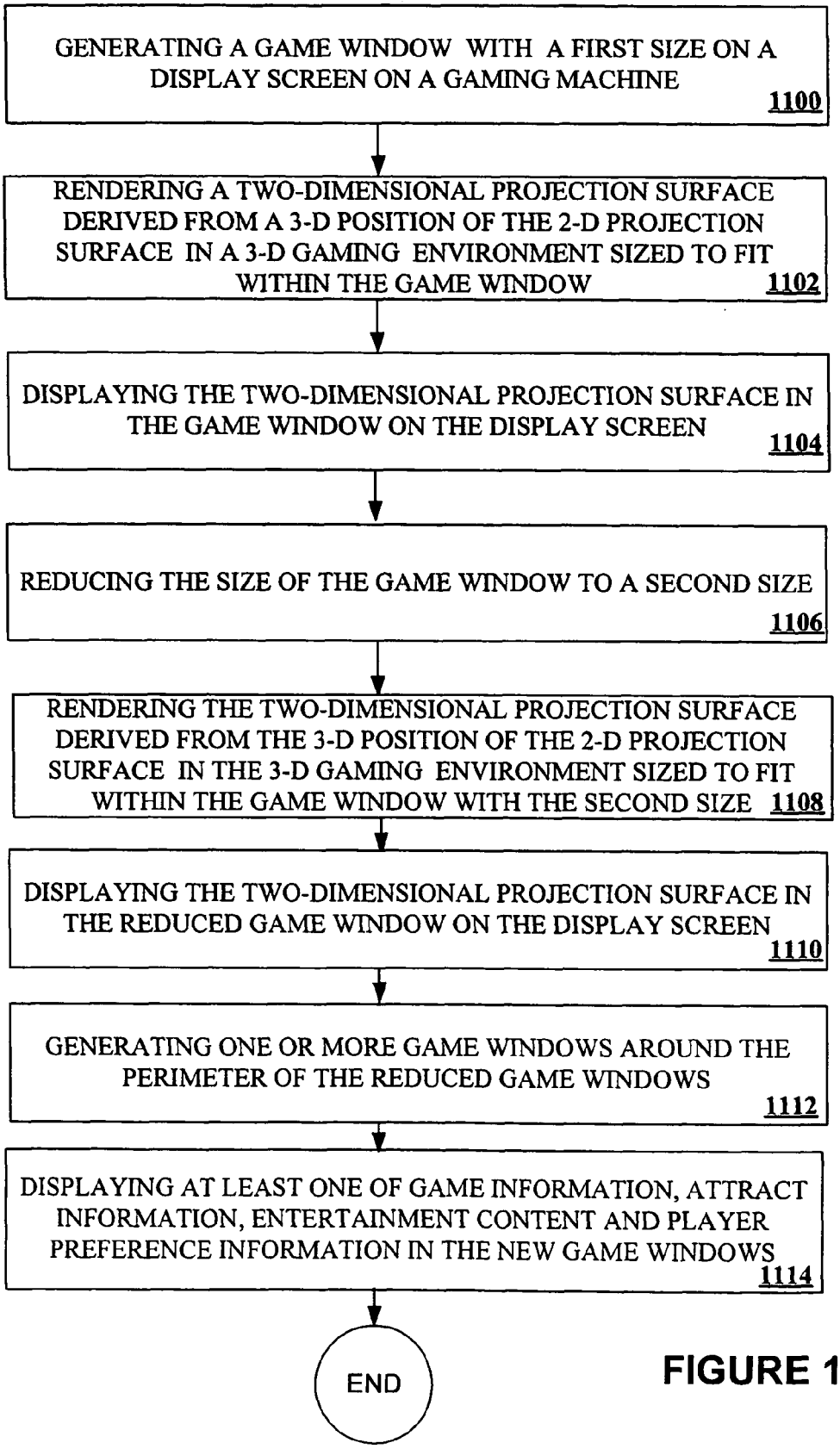
FIG. 11 is a flow chart depicting a method of displaying game information on a gaming machine.

FIG. 11 is a flow chart depicting a method of displaying game information on a gaming machine. In 1100, a first game window with a first size is generated on a display screen on the gaming machine. The first game window may be part of a 3-D game interface comprising multiple game windows as described with respect to FIGS. 8, 9 and 10. In 1102, a first two dimensional projection surface derived from 3-D coordinates a surface in a 3-D gaming environment (e.g., an image from a virtual camera in the 3-D gaming environment), is rendered to fit within the size of the first game window. In 1104, the rendered first two-dimensional projection surface is displayed in the first game window on the display screen.

In 1106, the first game window is reduced to a second size. In 1108, the same game window content is rendered to fit within the reduced first game window. The game window content of the first game window may be held constant during a game window size transition but may be later varied after the transition of the game window to the new size. Therefore, a second projection surface derived from the same 3-D coordinates of the surface in the 3-D gaming environment as in 1102 is rendered accounting for the new window size. In 1111, the second two-dimensional projection surface is displayed in the reduced first game window on the gaming machine.

To account for a change in game window size, the rendering may involve adjusting the parameters of a transformation performed by a virtual camera in the 3-D gaming environment to produce a "photograph" that fits in the window. This transformation may be performed while the 3-D coordinates of a captured surface in the 3-D gaming environment remain constant. In addition, the transition between the first game window size and the second game window size may be gradual. Thus, the first game window may be rendered in a series of sizes going from the first size to the second size where the 3-D coordinates of the captured surface in the 3-D gaming environment remain constant but the "photograph" from the virtual camera is rendered to fit in each of the window sizes generated during the transition. The method is not limited to reducing the size of game windows and may also be applied to increasing the size of game windows.

In 1112, one or more new game windows may be generated in the display space created by the reduction in size of the first game window. In 1114, information such as but not limited to game information, attract information, entertainment content, player preference information and gaming machine operational information may be displayed in the new game windows. In one embodiment, the new game windows may be removed and the first game window may be returned to its original size.

An input location on a display screen of a gaming machine is often an important parameter for operating a gaming machine. The input location on the display screen may be used to determine whether an input button modeled on the display screen has been activated. The input location on a display screen may be determined from a cursor location on the display screen or an input to a touch screen on top of the display screen. The cursor may be moved by a mouse, touch pad or joystick on the gaming machine. Then, a input location of the cursor may be specified by using an input mechanism on the gaming machine. For instance, a user may hit an "enter button" on a mouse or a joy-stick.

In traditional gaming machines, the position of input buttons or input surfaces modeled on a display screen on the gaming machine are fixed. As described above, input buttons that may be used with a touch screen or a screen cursor and screen cursor controller may be modeled in a 3-D gaming environment. In the present invention, the position of these buttons on the display screen may vary as a function of time. For instance, the position of an input button or input surface modeled in a 3-D gaming environment may change on the display screen when a position of a virtual camera in the 3-D gaming environment is changed or an object in the 3-D gaming environment is moved. The position of the input buttons may change as a result of user input into the gaming machines or some other game event. For instance, the position of the button on the display screen may be change or an area occupied by the input button on the display screen may change as a view of the input button is changed. Thus, methods are needed to account for a change of position or size of an input button modeled on the display screen to determine when an input button has been activated. A few methods of accounting for input buttons with variable positions and sizes are described as follows with respect to FIGS. 12A-12F and FIG. 13.

Figures 12A, 12B, 12C, 12D, 12E, 12F:
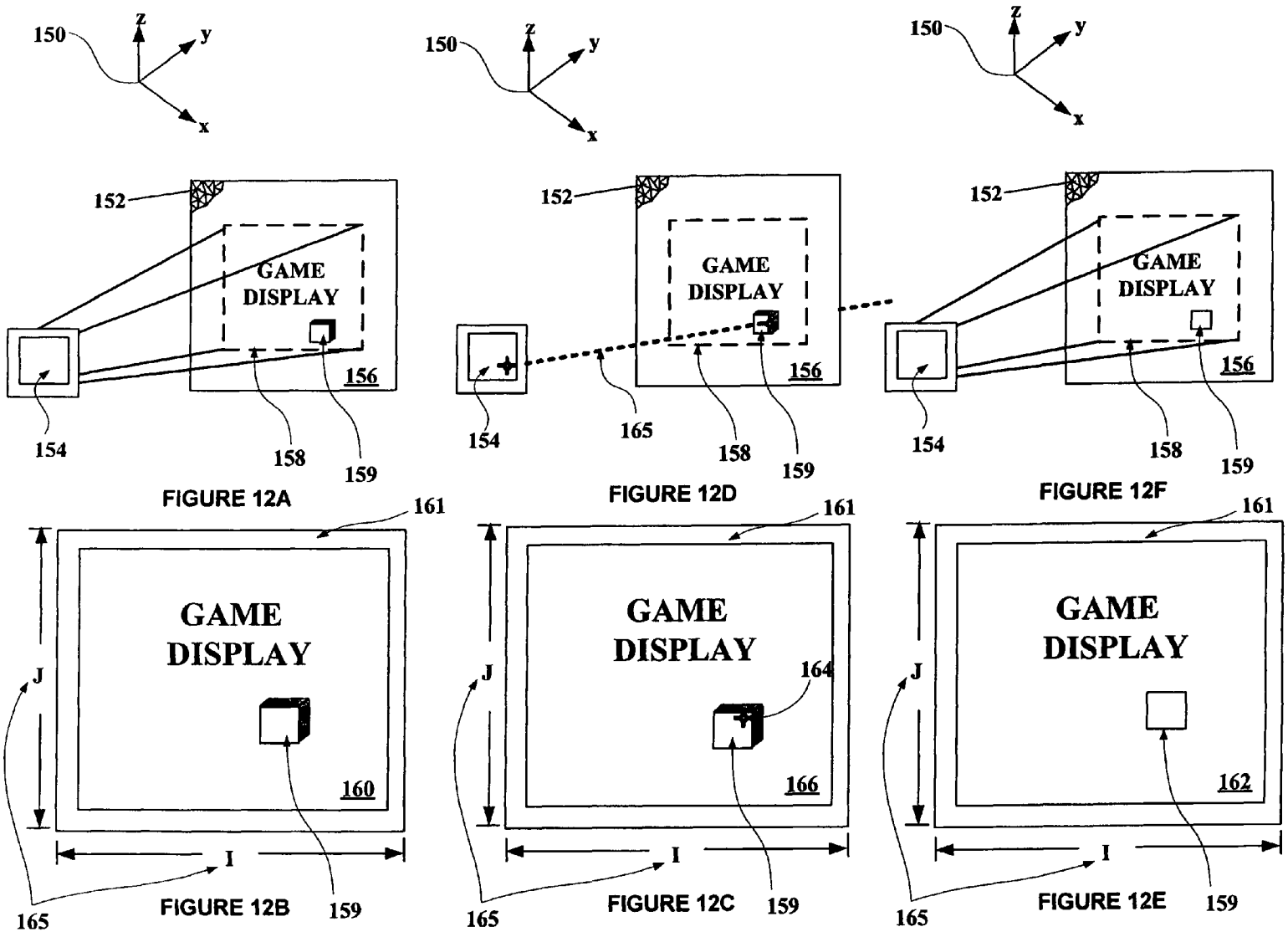
FIGS. 12A-12F are perspective drawings of screen input interfaces as modeled in a 3-D gaming environment on a gaming machine.

FIGS. 12A-12F are perspective drawings of screen input interfaces modeled in a 3-D gaming environment on a gaming machine. In FIG. 12A, a game display 158 is on a surface 156 comprising a plurality of elements 152 modeled in a 3-D gaming environment with coordinate system 150. A 3-D dimensional input button 159 is also modeled in the game display 158. A virtual camera 154 is positioned in the game environment and used to render a photograph of the game display 158 with the input button 159. In FIG. 12B, the rendered photograph 160 is displayed in game window 161 which may be displayed on a portion of a display screen on a gaming machine. The game window 161 has dimensions I by J which may correspond to a pixel length and a pixel width on the gaming machine. The game window 161 may be divided up into a 2-D grid of pixel locations. The input button 159 occupies a certain number of pixels on the game window 161.

In FIG. 12C, a screen input is detected at the screen location specified by the cross hairs 164. The screen input may be generated by a touch screen or some other input device on the gaming machine. In one embodiment of the present invention, the 2-D coordinates of the screen location and knowledge of the transformation used to render the 2-D view from the 3-D virtual gaming environment on the display screen may be used to generate a line in the 3-D gaming environment.

In FIG. 12D, an "input line" 165 is generated in the 3-D gaming environment from the 2-D coordinates of the screen location at 164 and a transformation used to render the 2-D view 166 in the game window 161 in FIG. 12C. The coordinates of the "input line" are checked to determine whether the input line intersects with an input button modeled in the 3-D gaming environment. In FIG. 12D, the line 165 intersects with input button 159. When the "collision" is detected, the gaming machine may determine whether the input button is "active." When the input button is active, the gaming machine may implement a gaming event specified by the input button. For instance, the gaming event may be to initiate a game on the gaming machine. When the input button is not active, the gaming machine may ignore the collision. When a non-rectangular coordinate system is used to model the 3-D gaming environment, the input line may not be straight and may be a curved line. Often the input line is referred to a as a ray and determining whether a collision has occurred is referred to as casting a ray.

After a collision has been detected on an "active" input button, the input button may be animated in some manner. For instance, the input button may be shown sinking into a surface from which it protrudes as if it were physically depressed. In FIG. 12F, the input button 159 is shown in a depressed position in the 3-D gaming environment. In FIG. 12E, the depressed button is rendered in a photograph 162 shown in the game window 161.

Figure 13:
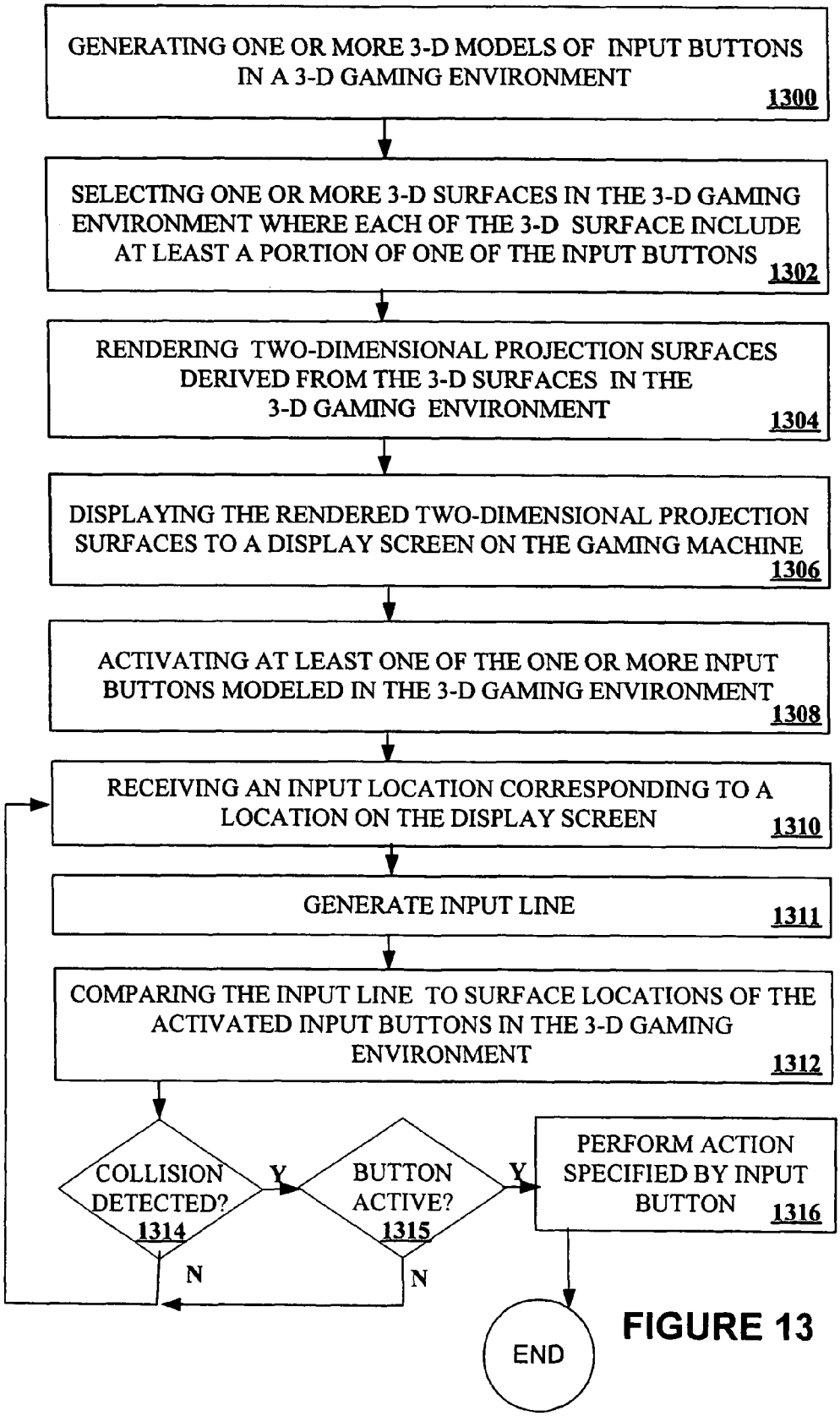
FIG. 13 is a flow chart depicting a method of detecting input button collisions for input buttons modeled in a 3-D gaming environment on a gaming machine.

FIG. 13 is a flow chart depicting a method of detecting input button collisions for input buttons modeled in a 3-D gaming environment on a gaming machine. In 1300, one or more 3-D models of input buttons are generated in a 3-D gaming environment. In 1302, a 3-D surface in the 3-D gaming environment is selected that includes at least portion of one or more input buttons modeled in the 3-D gaming environment. In 1304, a two-dimensional projection surface is rendered from the selected 3-D surface in the gaming environment. As noted above, the 3-D surface may be considered a 3-D object and a 2-D projection surface may be considered a 2-D image. In 1306, the rendered two-dimensional projection surface is displayed to at least one display surface on a gaming machine.

In 1308, at least one or the one or more input buttons modeled in the 3-D gaming environment are activated. In 1310, an input location corresponding to a 2-D coordinate on a display screen is received. In 1311, an input line is generated in the 3-D gaming environment based on the coordinate transformation used to render the two-dimensional projection surface in 1304. In 1312, the input line is compared to 3-D surface locations in the 3-D gaming environment.

In 1314, when a collision between the input line and an input buttons in the 3-D gaming environment are not detected, the screen input is ignored by the gaming machine. In 1315, when a collision between the input line and an input button has been detected, the gaming machine determines whether the input button is active. When the input button is not active, the screen input is ignored by the gaming machine. In 1316, when the input button is active, the gaming machine may execute the action specified by the input button. For instance, a game of chance may initiated on the gaming machine.

In some implementations of the invention, a plurality of game elements may be displayed as surfaces of at least one virtual three-dimensional object. It is sometimes impractical (or at least not desirable) to display all game elements at the same time on surfaces of the three-dimensional object. This may happen, for example, if more than a threshold number of game elements is active.

Therefore, some such implementations of the invention allow the orientation of the three-dimensional object to be varied (e.g., by rotation about one or more axes) in order to display selected game elements. The game elements may be selected by a player and/or by a logic device. In some such implementations, the orientation of the three-dimensional object is varied to display game elements that are selected on the basis of a game outcome. In some implementations, for example, the virtual three-dimensional object comprises a "carousel" that can be re-oriented (e.g., rotated) to display game elements.

According to some such implementations, a plurality of game elements may be displayed as surfaces of a virtual three-dimensional object in a first window of a display and one or more corresponding game elements may be displayed in a second window of a display. The first and second window may be displayed in the same display device or on different display devices, e.g., on the same screen or on two different screens of the same gaming machine.

For example, game cards (such as bingo cards or other playing cards) may be displayed as surfaces of the carousel in one window of a display and as two-dimensional game cards in another window of the display. In some such implementations, the game elements may be displayed in a larger size in one window than in the other window.

Figure 14A:
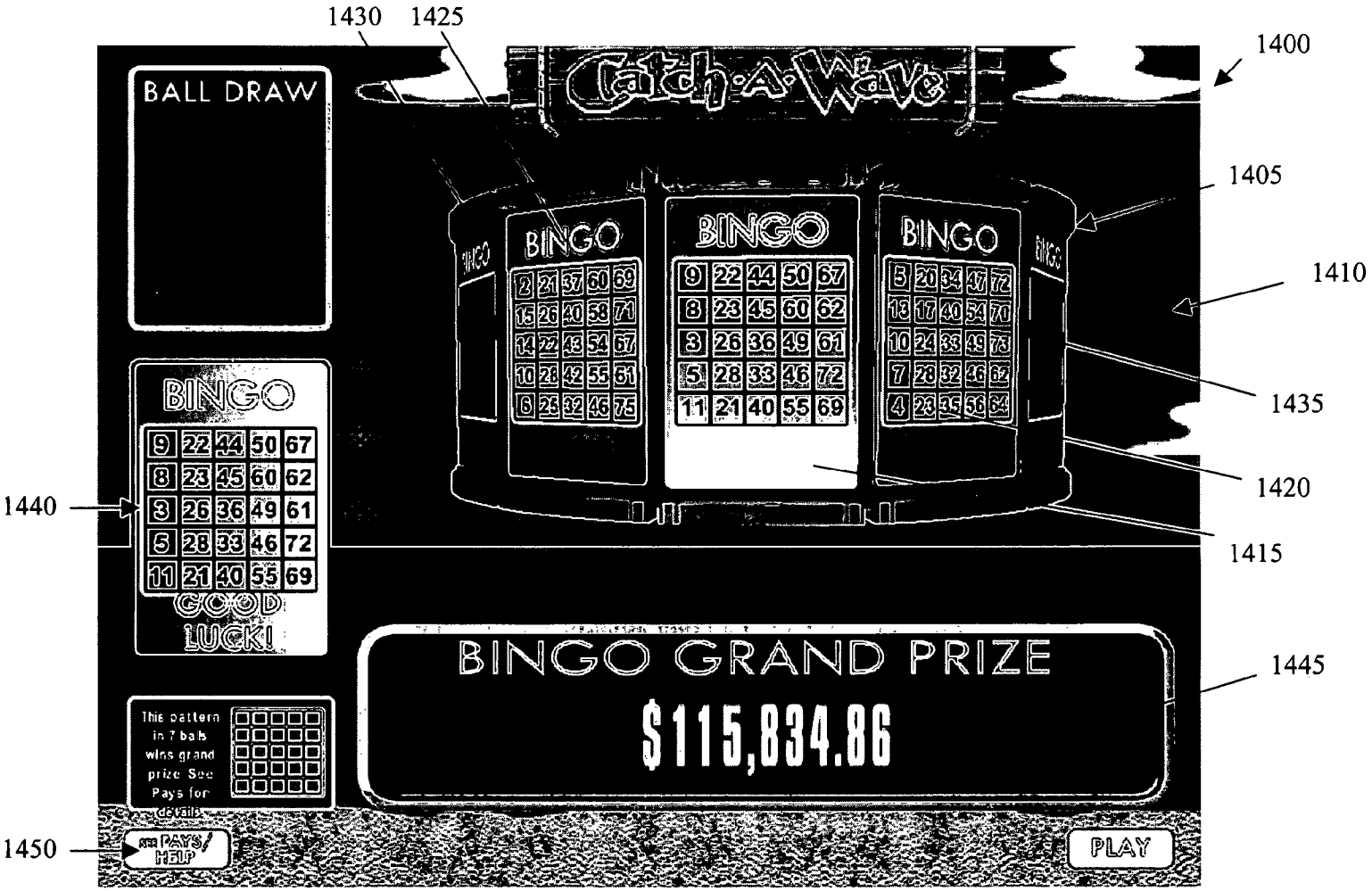
FIG. 14A illustrates a display for implementing some aspects of the invention.

Some specific examples of the foregoing implementations will now be described with reference to FIG. 14A et seq. Referring now to FIG. 14A, display 1400 is an exemplary display that may be used to implement some aspects of the present invention. Display 1400 could be presented, for example, on a display device of a gaming machine.

In this example, display 1400 includes a virtual three-dimensional object (bingo card carousel 1405) in area 1410. Bingo card carousel 1405 is seen from one end, much like the perspective of virtual lens 106 of FIG. 1. A plurality of bingo cards may be displayed as surfaces of bingo card carousel 1405. Although in this implementation the displayed game elements are bingo cards, other implementations provide for the display of other game elements, such as playing cards, hands of playing cards (e.g., poker hands), etc.

Here, the view of bingo card carousel 1405 allows an observer to see five game elements on five corresponding surfaces. Surface 1415 is in the front and the bingo card displayed thereon is most clearly visible. Here, a corresponding bingo card is displayed in window 1440. The bingo cards on surfaces 1420 and 1425 are also visible, but the bingo cards on surfaces 1430 and 1435 are not clearly rendered. Accordingly, in this implementation only 3 bingo cards may be clearly displayed at one time.

It will often be the case that more than 3 game elements (here, bingo cards) will be used during a game. Therefore, the present invention provides various methods for presenting games having additional game elements. In some implementations, as here, the apparent orientation of bingo card carousel 1405 may be altered e.g., by rotation about a vertical axis and/or by opening/unfolding bingo card carousel 1405 to reveal additional surfaces. Changing the orientation of bingo card carousel 1405 allows for the display different cards at different times, as if the cards were otherwise displayed on surfaces of a three-dimensional carousel that were not visible to an observer at all times.

Instead of (or in addition to) changing the orientation of bingo card carousel 1405, some implementations allow the bingo cards to be re-ordered according to user input and/or according to game results. In this implementation, prior to game play a player may select bingo cards by accepting or rejecting a bingo card displayed in area 1440, e.g., via a button, a touch screen, etc. Each time a bingo card is displayed in area 1440, the bingo card is also displayed on surface 1415. Subsequent figures provide examples of bingo cards being displayed according to interim or final game results.

It will sometimes be the case that surfaces are displayed for which there is no corresponding game element. For example, a particular display may allow up to 7 surfaces to be available for displaying a game element, but at time fewer than 7 game elements will be used for a game presentation. If the game is bingo, it will sometimes be the case that a player wishes to player fewer than 7 bingo cards at a time. Some such implementations will cause a "blank" image, a "card back" image (or the like) to be displayed on surfaces having no corresponding game element.

Display 1400 includes other features for playing a game and/or for conveying information to a player. For example, window 1445 indicates the current amount of a progressive jackpot that a player could potentially win by playing the game. Button 1450 provides access to additional displays that explain game play, bingo win patterns, interim win patterns and progressive win patterns, pays, etc. After a player has made a wager and selected bingo cards, window 1440 (or another window) may indicate whether there are enough players available to play a bingo game. For example, one such window could indicate "Waiting for Players" or the like until such time as there are a predetermined number of players available to play. An audio prompt may also be provided.

In some implementations, the game begins automatically after there are sufficient players. In other implementations, a player is notified when there are enough players available to play a bingo game and must take action (e.g., activating play button 1450 of FIG. 14B) to participate in the game. Game play involves at least one round of randomly selecting bingo numbers. These bingo numbers are indicated as balls in "ball draw" area 1460 and as hits on displayed bingo cards.

In this example, the player has selected more bingo cards than can be simultaneously displayed according to this implementation of the invention (here, more than 3 cards). Here, a player can interact with the display in order to view hidden bingo cards. For example, if a player activates area 1420, bingo card carousel 1405 will appear to rotate in the direction of area 1420. Similarly, if a player activates area 1425, bingo card carousel 1405 will appear to rotate in the direction of area 1425.

It will often be the case that the bingo cards displayed prior to the ball draw will not be the cards that have the most hits, the highest-value patterns hit, etc., after the first ball draw. These bingo cards will be of greatest interest to a player and will convey the most useful information. To allow a player to view such bingo cards, some implementations of the invention cause the bingo cards to be re-ordered according to such game results.

Figure 14B:
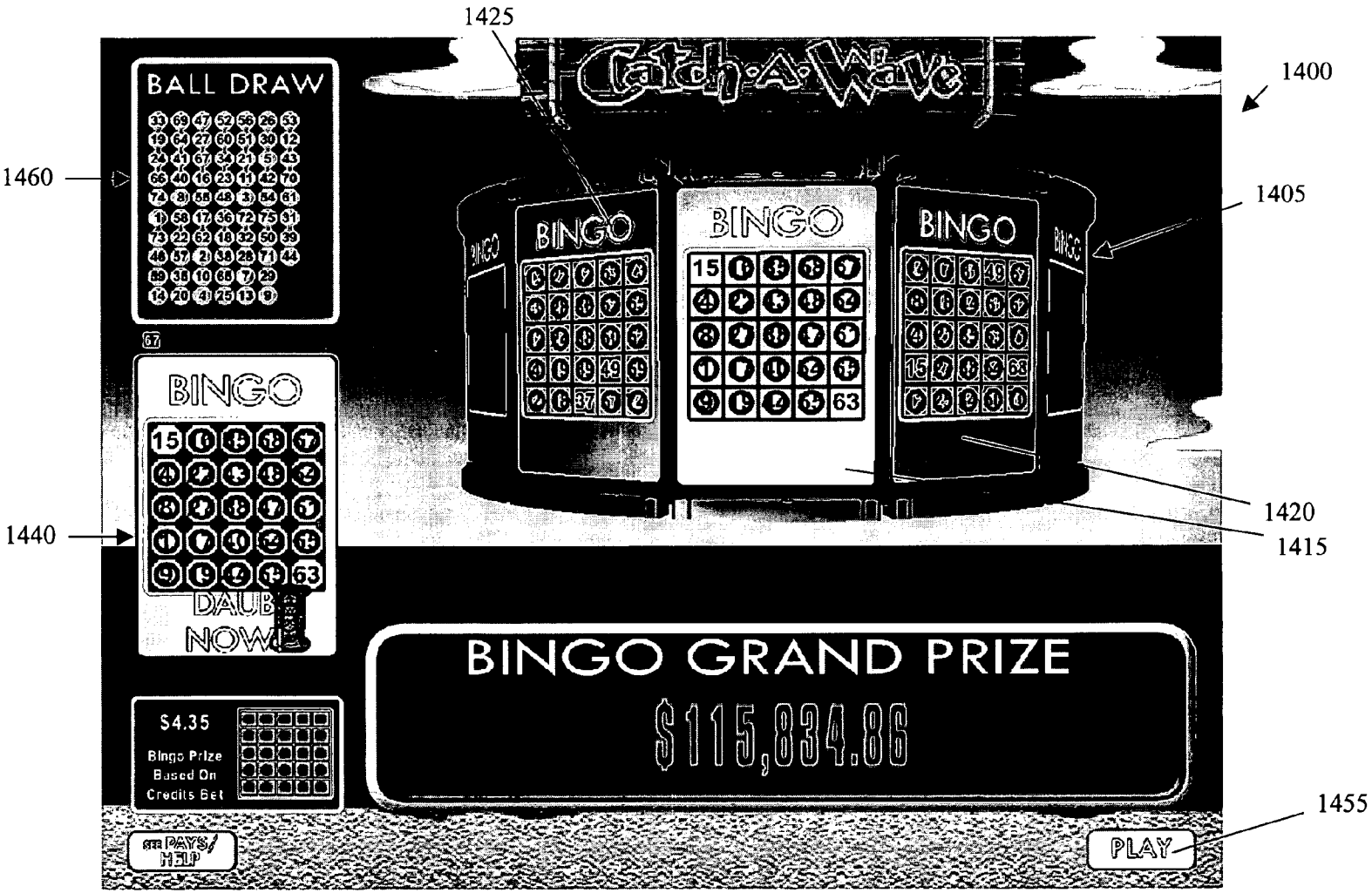
FIG. 14B illustrates a display for implementing some aspects of the invention.
Figure 14C:
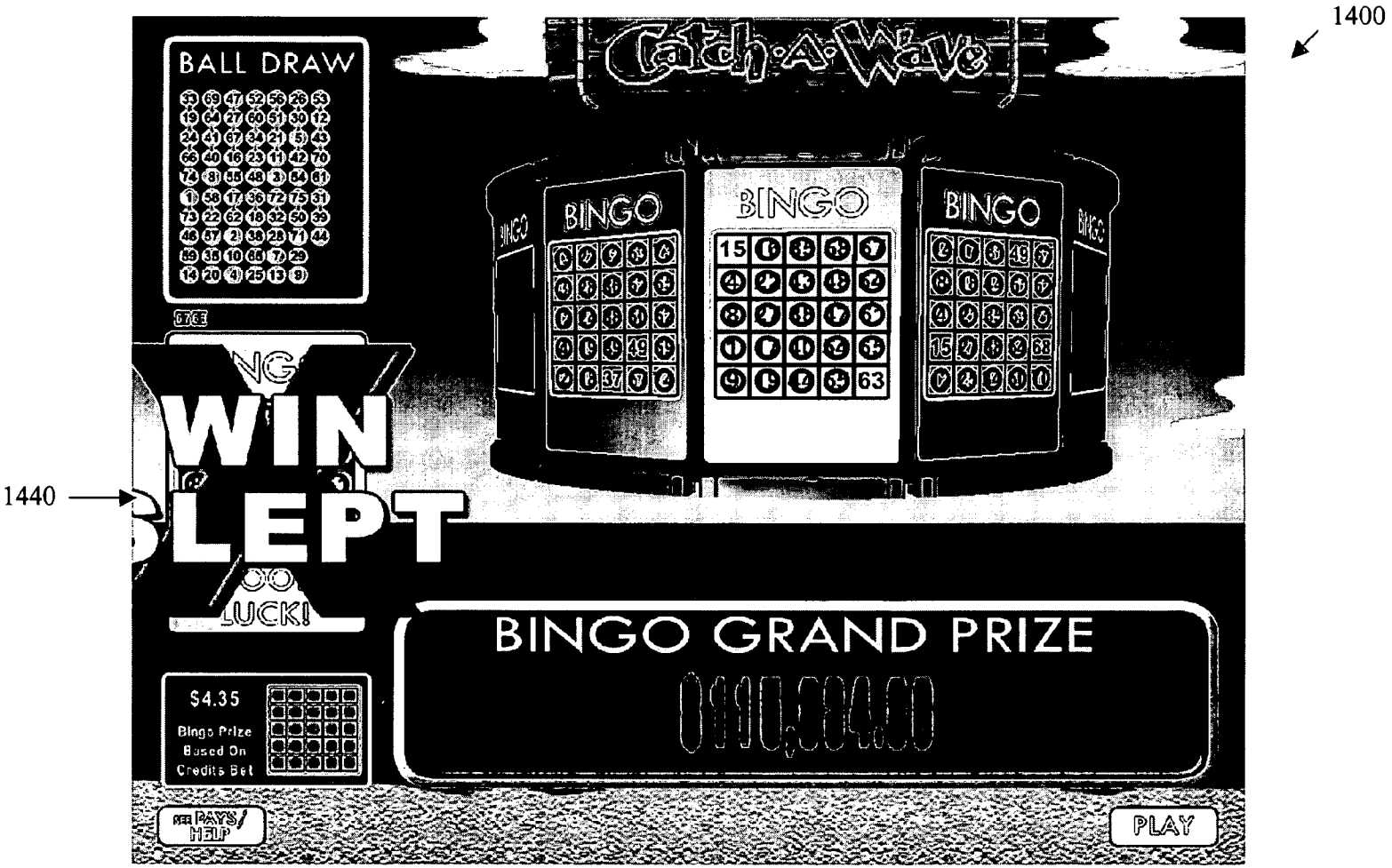
FIG. 14C illustrates a display for implementing some aspects of the invention.

One such example is shown in FIG. 14B. Here, the player's bingo cards have been re-ordered such that areas 1415, 1420 and 1425 indicate the bingo cards having the most hits after the ball draw. At the moment captured in the "screen shot," window 1440 is prompting a player to "DAUB NOW," indicating that a daub timer is running. The player could daub, e.g., by activating Play button 1455. In this example, the player does not daub before the daub timer runs, so the player's win is slept. (See window 1440 of FIG. 14C.)

Figure 14D:
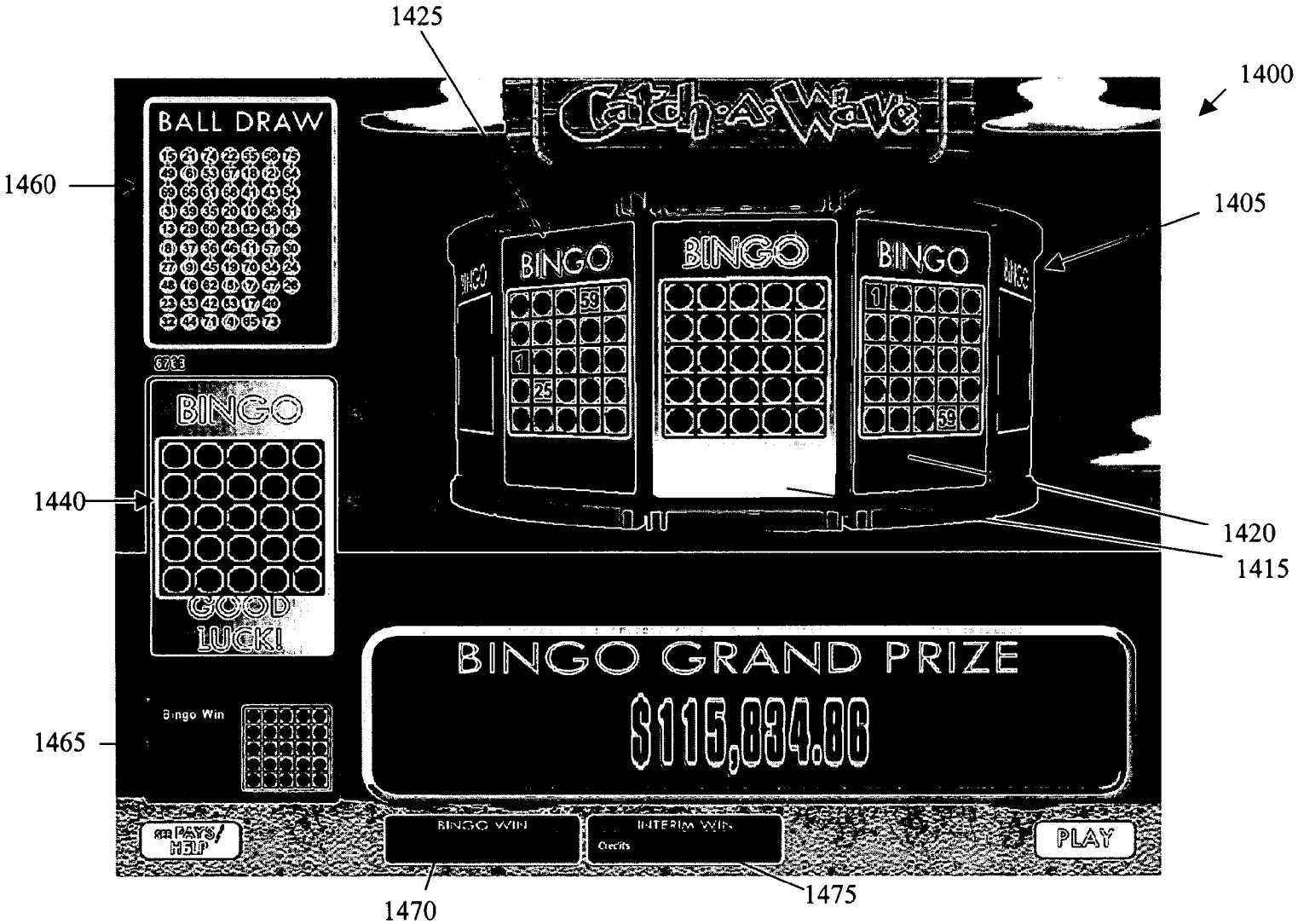
FIG. 14D illustrates a display for implementing some aspects of the invention.

However, in the example depicted by FIG. 14D, the player has daubed before the daub timer could run. As before, the selected bingo numbers are indicated in Ball Draw area 1460. The player's bingo cards have once again been re-ordered such that areas 1415, 1420 and 1425 indicate the bingo cards having the most hits after the ball draw.

The best result is indicated by the bingo card most prominently displayed by bingo carousel 1405, which is the bingo card displayed on surface 1415. The same bingo card is displayed in area 1440. Window 1465 indicates that the pattern of hits on this bingo card corresponds to a bingo win. In some implementations, if several bingo cards indicate bingo, interim or progressive wins, these bingo cards will be successively displayed on surface 1415 and in area 1440. Windows 1470 and 1475 can display bingo win and interim win credits.

Figure 15A:
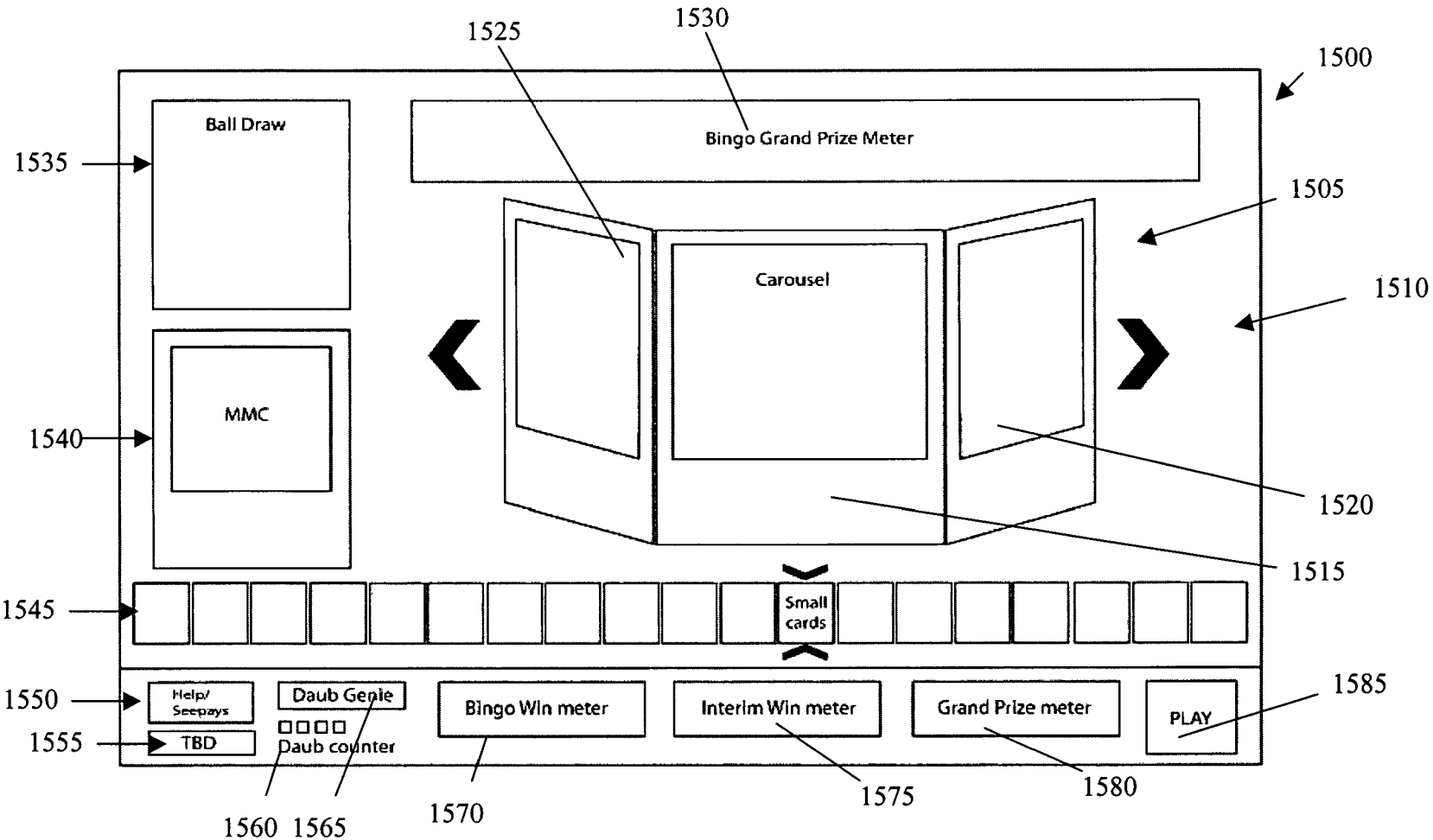
FIG. 15A illustrates a display layout for implementing alternative aspects of the invention.
Figure 15B:
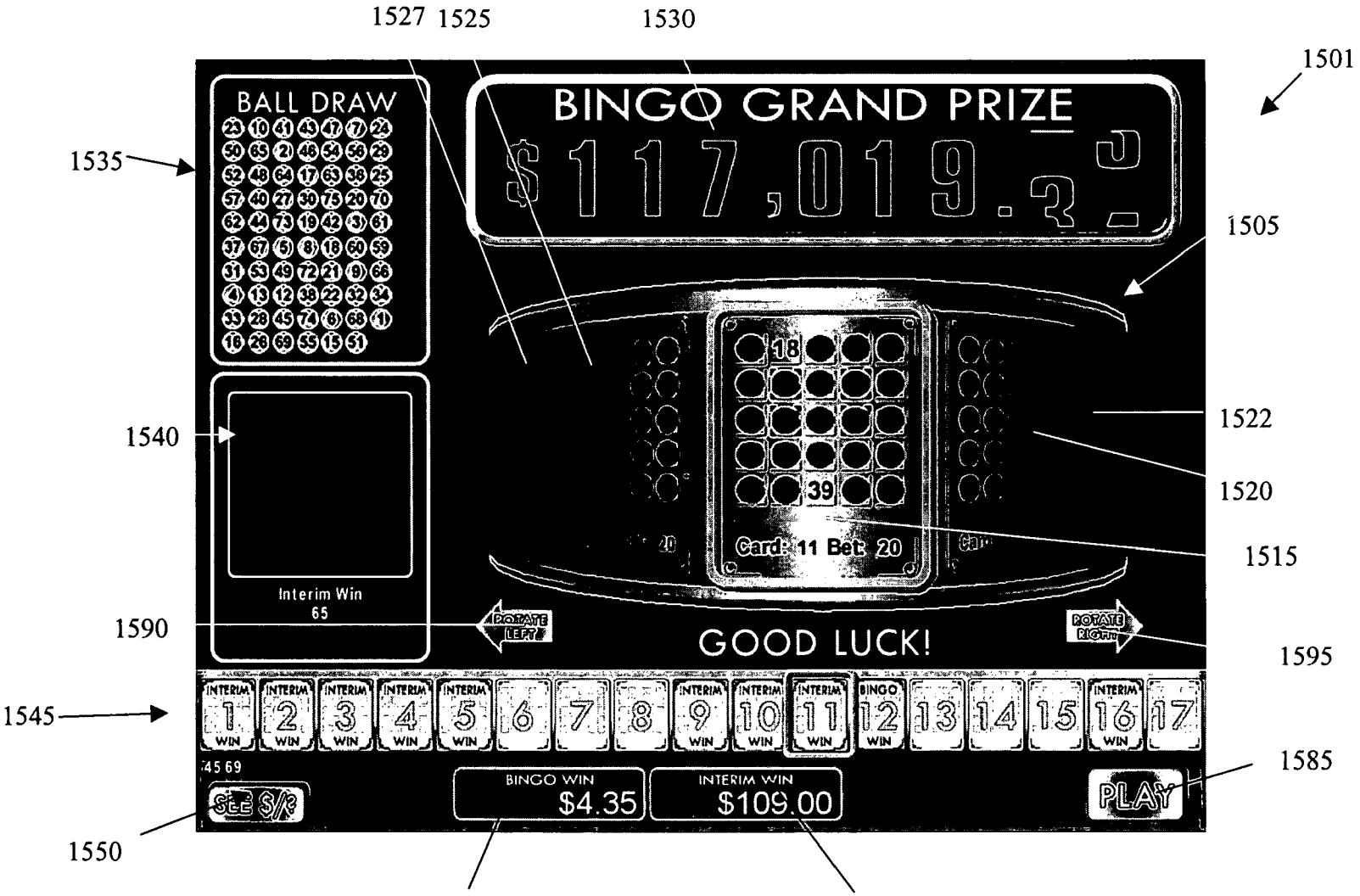
FIG. 15B illustrates a display for implementing alternative aspects of the invention.

Referring now to FIGS. 15A and 15B, an alternative layout and display will now be discussed. Referring first to FIG. 15A, display layout 1500 includes carousel 1505 in area 1510. Again, an end view of a virtual three-dimensional carousel is presented in area 1510. Surfaces 1515, 1520 and 1525 are visible to a viewer.

Areas 1530 and 1535 are for the display of a progressive meter and a ball draw, respectively. Area 1540 may be used to convey various types of game information, including but not limited to an indication of a winning pattern that has been achieved by hits on one of the bingo cards.

In window 1545, additional game elements may be displayed. For example, if a player has selected more than 3 bingo cards for a bingo game, some or all of the additional bingo cards can be displayed in area 1550. The game element in window 1545 that corresponds to that displayed in area 1515 may be highlighted.

In some implementations, the scale of game elements displayed in window 1545 will be changed to ensure that all active game elements can be displayed. In other implementations, a fixed number of areas is reserved for the display of game elements in window 1545. According to some such implementations, areas of window 1545 that are not used for the display of game elements in a particular game presentation will indicate "card backs" or the like.

Area 1550 is intended for a button that allows a player to cause game information, including but not limited to payout information, to be displayed. Area 1555 is reserved for a utility to be determined. Area 1560 indicates a daub counter and button 1565 allows an automatic dauber to be invoked. Windows 1570, 1575 and 1580 are for the display of a bingo win meter, an interim win meter and a grand prize meter, respectively. A play/daub button may be displayed in area 1585.

FIG. 15B illustrates one exemplary display 1501 that generally corresponds to layout 1500 of FIG. 15A. At the moment depicted in FIG. 15B, a jackpot of $117,019.33 is indicated in window 1530. Moreover, bingo numbers have been selected and are displayed as numbered balls in ball draw area 1535.

Here, surfaces 1515, 1520 and 1525 of bingo carousel 1505 are displayed clearly enough to read at least some of their numbers and the indicated hits. Surfaces 1522 and 1527 are hidden in shadow. Surface 1515 is not only centered, but is also displayed more clearly the other surfaces and occupies more space. Accordingly, the viewer's attention is drawn to surface 1515.

Here, area 1545 is configured to display up to 17 complete game elements. In this implementation, the game elements are bingo cards for which no numbers or patterns have been rendered. In alternative implementations, patterns and/or numbers are indicated on such game elements.

However, in this example, an appealing "cleaner" display nonetheless indicates which bingo cards indicate wins: here, cards 1-5, 9-11 and 16 indicate interim wins and card 12 indicates a bingo win. Card 11, which is displayed on surface 1515 of bingo carousel 1505, indicates an interim win. The lower portion of surface 1515 indicates the card number and the wager amount. The interim win pattern of card 11 is indicated in area 1540.

Bingo carousel 1505 may be "rotated" in order to display additional bingo cards. Here, bingo carousel 1505 may be rotated to indicate cards to the left of card 11 by activating arrow 1590. Similarly, bingo carousel 1505 may be rotated to indicate cards to the right of card 11 by activating arrow 1595.

Areas 1550, 1570, 1575 and 1585 are substantially as shown in layout 1500. At the instant captured by display 1501, bingo win meter 1570 indicates a bingo win of $4.35 and interim win meter 1575 indicates an interim win of $109.

Multiple-card bingo games allow a player select up to a maximum number of bingo cards, which we will call $B_{MAX}$. Let us refer to the number of bingo cards played in a bingo game as B. The virtual three-dimensional object is capable of displaying up to N bingo cards. Very often, it will be the case that $N<B$.

Some implementations of the invention provide an indication when the player is not playing $B_{MAX}$ bingo cards. When it is determined that $B<B_{MAX}$, some implementations of the invention provide this indication by displaying N−1 bingo cards on surfaces of a virtual three-dimensional object. In other words, such implementations display an empty space, a card back, or the like even when this causes fewer than B bingo cards to be displayed on the virtual three-dimensional object. As long as the player is playing $B<B_{MAX}$ bingo cards, fewer than N bingo cards will be displayed on the virtual three-dimensional object.

Following are some examples, wherein the on the virtual three-dimensional object is a bingo card carousel having 5 surfaces capable of simultaneously displaying bingo cards (N=5). The surfaces will be referred to as surface_1 through surface_5, in left-to-right order. In this example, the bingo game can play a maximum of 20 bingo cards, so $B_{MAX}$,=20.

When B=1, the carousel display is as follows: surface_1=blank, surface_2=blank, surfaces_3=bingo_card_1, surface_4=blank, surface_5=blank.

When B=2, the carousel display is as follows: surface_1=blank, surface_2=blank, surface_3=bingo_card_1, surface_4=bingo_card_2, surface_5=blank.

When B=3 through 18, the carousel display is as follows: surface_=blank, surface_2=blank, surface_3=bingo_card_1, surface_4=bingo_card_2, surface_5=bingo_card_3.

When B=19, the carousel display is as follows: surface_1=bingo_card_19, surface_2=blank, surface_3=bingo_card_1, surface_4=bingo_card_2, surface_5=bingo_card_3.

When B=20, the carousel display is as follows: surface_1=bingo_card_19, surface_2=bingo_card_20, surface_3=bingo_card_1, surface_4=bingo_card_2, surface_5=bingo_card_3.

This aligns very well with the mental image of a strip of bingo cards winding around the carousel like a bicycle chain around a gear. Each time the number of cards played is incremented, the new card is placed to the right of the previous card.

According to some such implementations, when the bingo carousel is rotated (due to player interaction, or due to automatic displaying of wins), the bingo cards remain in their increasing order. For example, if the carousel is rotated clockwise by two cards, then it will display cards 1 through 5. However, once the next game begins or when the player selects a different number of bingo cards (or paylines) to play, they will always see the blank bingo card representing "card 20 not played." When the player plays all $B_{MAX}$ bingo cards, the carousel will show N bingo cards and no blank positions.

Gaming in the United States is divided into Class I, Class II and Class III games. Class I gaming includes social games played for minimal prizes, or traditional ceremonial games. Class II gaming includes bingo and bingo-like games. Bingo includes games played for prizes, including monetary prizes, with cards bearing numbers or other designations in which the holder of the cards covers such numbers or designations when objects, similarly numbered or designated, are drawn or electronically determined, and in which the game is won by the first person covering a previously designated arrangement of numbers or designations on such cards. Such an arrangement will sometimes be referred to herein as a "game-winning pattern" or a "game-ending pattern." Class II gaming may also include pull tab games if played in the same location as bingo games, lotto, punch boards, tip jars, instant bingo, and other games similar to bingo. Class III gaming includes any game that is not a Class I or Class II game, such as a game of chance of the kind typically offered in non-Indian, state-regulated casinos.

Some implementations of the present invention can be particularly advantageous for providing Class II games that simulate Class III games. For example, as described in detail in U.S. patent application Ser. No. 11/402,726, providing and presenting multiple bingo cards can be very useful for presenting bingo games with entertaining displays that simulate Class III games. In some such implementations, one display device of a gaming machine presents a Class II game and another display device presents a corresponding simulated Class III game. According to some such implementations, players may choose from a variety of Class III game themes, each theme having a different entertaining display adapted from a corresponding Class III game. Preferably, each Class III game theme will offer play and win dynamics and paytable percentages closely matching those of the original Class III game.

The following applications describe pertinent material and are hereby incorporated by reference: U.S. patent application Ser. No. 10/925,710, entitled "Draw Bingo, and filed on Aug. 24, 2004; U.S. patent application Ser. No. 10/937,227, entitled "Bingo Game Morphed to Display Non-Bingo Outcomes" and filed on Sep. 8, 2004; U.S. patent application Ser. No. 11/149,828, entitled "Perrius Poker and Other Bingo Game Variations" and filed on Jun. 10, 2005; This application is related to U.S. patent application Ser. No. 11/312,966, entitled "Bingo System with Downloadable Common Patterns" and filed on Dec. 19, 2005; and U.S. patent application Ser. No. 11/312,948, entitled "Bingo Gaming Machine Capable of Selecting Different Bingo Pools" and filed on Dec. 19, 2005 (the "Bingo Pools Application"), collectively, the "Class II/Class III Applications."

As described in the foregoing applications, providing Class II games that simulate Class III games presents a number of challenges. One of these challenges is to implement such systems while complying with an evolving regulatory framework. It is expected, for example, that Class II regulations will soon require that all gaming machines participating in a single bingo game have the same bingo paytable (the same patterns with the same corresponding probabilities and payouts). This would mean, for example, that an "X" bingo pattern that pays 10 credits and has a 5% probability of occurring in one game, the pattern must pay 10 credits and have a 5% probability of occurring for all games participating in the same bingo pool.

As described in the Bingo Pools Application, such requirements introduce further challenges for Class II games that simulate Class III games having a number of player options that will sometimes be referred to herein as "Class III game options" or the like. Class III game options may be, e.g., the number of paylines in a simulated slot game, a number of hands in a simulated video poker game, a number of spots picked for a simulated keno game or a number of wagers placed on a simulated roulette game. However, in part because of the popularity of slot games, the most commonly referenced Class III game options herein are paylines for simulated slot games.

In a typical Class III slot game, the paytable changes based on the number of paylines played. A player playing one line expects all wins to be a multiple of his wager. Increasing the number of lines played increases the "hit frequency" but reduces the average payout size. Accordingly, players can play longer but are less likely to have substantial payouts when they do win. For example, a player playing 10 paylines expects some wins that are less than his wager (sometimes referred to as "dribble pays" or "cherry dribblers"), but that allow the player to continue playing longer than if only 1 payline were being played. Playing a large number of paylines appeals to players who desire a smooth, low-volatility game that they can play for a relatively long time. On the other hand, playing a small number of paylines appeals to players who prefer a higher-volatility game with less frequent but larger payouts.

In order to comply with the anticipated Class II regulations and more closely match Class III game play, some implementations described in the Bingo Pools Application provide a system wherein separate paytables and bingo pools are formed according to the number of Class III game options. For example, separate paytables and bingo pools may be formed according to the number of paylines played on slot-type game themes and/or the number of hands played on poker game themes. In some such implementations, players will be limited to predetermined numbers of lines (or hands) played, e.g., only 1, 3, 5 or 9 lines. In alternative implementations, a player's options regarding the number of lines played will depend, at least in part, on how many other players are playing any given number of lines on a slot game.

In order to have as many machines as possible participating in the same bingo game, it may be desirable to allow the hit frequency of the game to change when a player selects options of a simulated Class III game (e.g., selects to play more paylines) without switching to a different bingo pool or paytable. Accordingly, U.S. patent application Ser. No. 11/402,726 provides gaming methods and devices wherein the hit frequency of a bingo game will be modulated by assigning differing numbers of bingo cards according to Class III game options selected by a player.

For example, some implementations described in U.S. patent application Ser. No. 11/402,726 cause the hit frequency of a simulated slot game to change according to the number of paylines played without switching to a different bingo pool. Instead, a multi-card bingo game is provided wherein differing numbers of bingo cards are assigned, depending on the number of paylines selected by a player. In addition to a number of paylines for a simulated slot game, the player's selected Class III game options may involve, for example, a number of hands for a simulated poker game, a number of spots picked for a simulated keno game and/or a number of wagers placed on a simulated roulette game that is provided in accordance with the same paytable of a bingo game.

However, the examples described in greatest detail in U.S. patent application Ser. No. 11/402,726 involve bingo games that provide various types of simulated slot games. As a player plays more paylines, he or she is assigned more bingo cards. In some such implementations, the wins for all bingo cards are summed up to form the total bingo game win, which is then represented on the slot game using some or all of the paylines available. Depending on the implementation, there may or may not be a one-to-one correspondence between wins on a single card and wins on a single payline.

Some implementations provide a system wherein a plurality of electronic gaming machines, each of which is configured for presenting entertaining displays of various Class III game themes, is linked to a single bingo server. By linking many participating electronic gaming machines to a single server, some implementations of the invention allow progressive contributions from all of the participating electronic gaming machines to be pooled into a single progressive jackpot.

Some embodiments of the invention involve gaming machines that are configured with a graphical user interface ("GUI") or the like that allows a player to select a Class III game theme from a plurality of Class III game themes. In some such embodiments, the gaming machine is configured to present any of the proffered Class III game themes.

Alternatively, or additionally, the game theme of a particular networked gaming machine (or a group of networked gaming machines) may be changed according to instructions received from a central system: some gaming networks described herein include a central system that is configured to download game software and data, including but not limited to the underlying bingo patterns, pays and game outcomes, to networked gaming machines. Such gaming networks allow for the convenient provisioning of networked gaming machines.

Moreover, such gaming networks allow additional game themes to be easily and conveniently added, if desired. If a new game theme requires new bingo patterns to match new payout amounts, preferred implementations of the invention allow a new pattern set (or updates to an old pattern set) to be downloaded to all networked gaming machines. Related software, including but not limited to game software, may be downloaded to networked gaming machines. Relevant information is set forth in U.S. patent application Ser. No. 11/225,407, by Wolf et al., entitled "METHODS AND DEVICES FOR MANAGING GAMING NETWORKS" and filed Sep. 12, 2005, in U.S. patent application Ser. No. 10/757,609 by Nelson et al., entitled "METHODS AND APPARATUS FOR GAMING DATA DOWNLOADING" and filed on Jan. 14, 2004, in U.S. patent application Ser. No. 10/938,293 by Benbrahim et al., entitled "METHODS AND APPARATUS FOR DATA COMMUNICATION IN A GAMING SYSTEM" and filed on Sep. 10, 2004, in U.S. patent application Ser. No. 11/225,337 by Nguyen et al., filed Sep. 12, 2005 and entitled "DISTRIBUTED GAME SERVICES" and in U.S. patent application Ser. No. 11/173,442 by Kinsley et al., filed Jul. 1, 2005 and entitled "METHODS AND DEVICES FOR DOWNLOADING GAMES OF CHANCE," all of which are hereby incorporated by reference in their entirety and for all purposes.

Although the foregoing invention has been described in some detail for purposes of clarity of understanding, it will be apparent that certain changes and modifications may be practiced within the scope of the appended claims. For example, alternative implementations display game elements on surfaces of more than one virtual three-dimensional object (e.g., on 2 or more carousels). Yet other implementations provide for the display of more than 3 surfaces of a bingo card carousel by displaying a "longer" side of the bingo card carousel that has additional surfaces. The scale of the areas used to display game elements (including but not limited to the scale of the virtual three-dimensional object or objects) may be altered, within predetermined limits, according to the number of game elements that need to be displayed. Accordingly, the specific embodiments described herein are merely illustrative and no corresponding limitations should be read into the claims.

We claim:

1. A gaming machine, comprising:

a network interface;

at least one user input device;

a first display device; and at least one logic device configured to do the following:

determine, based at least in part on input received from the user input device, when a player will use B bingo cards in a bingo game, where B is a number greater than a predetermined number N of bingo cards that can simultaneously be displayed in a first area of the first display device;

select N of the B bingo cards to be displayed in the first area;

control the first display device to display N selected bingo cards in the first area; and provide a bingo game according to bingo game information received via the network interface wherein the at least one logic device is further configured to ascertain when a player will use S bingo cards, where S is less than or equal to N, and wherein, when the player will use S bingo cards, a logic device controls the first display device to display the S bingo cards in the first area.

2. The gaming machine of claim 1, wherein at least one logic device is further configured to receive bingo card information from a user input device regarding selected bingo cards and wherein the selecting step comprises selecting N bingo cards for which bingo card information was most recently received.

3. The gaming machine of claim 2, wherein the displaying step comprises:

displaying the N bingo cards on N corresponding sides of a bingo card carousel;

displaying a side view of the bingo card carousel; and rotating the bingo card carousel such that N most recently selected bingo cards are always in view.

4. The gaming machine of claim 1, wherein one of the user input devices comprises a graphical user interface ("GUI") in a second area of the first display device, the GUI configured to allow selection of bingo cards.

5. The gaming machine of claim 1, wherein at least one logic device is further configured to select N bingo cards having the highest-ranking patterns after bingo number information has been received via the network interface.

6. The gaming machine of claim 1, wherein at least one logic device is further configured to control the first display device to display the N bingo cards on N corresponding three-dimensional surfaces.

7. The gaming machine of claim 6, wherein the N corresponding three-dimensional surfaces are sides of a bingo card carousel, and wherein the displaying step comprises displaying a side view of the bingo card carousel.

8. The gaming machine of claim 1, wherein at least one logic device is further configured to control the first display device to display all B bingo cards in a second area.

9. The gaming machine of claim 1, wherein at least one logic device is further configured to control the first display device to display selected bingo numbers in a third area.

10. The gaming machine of claim 1, wherein at least one logic device is further configured to control the first display device to display a bingo outcome of a bingo game in at least the first area and to control a second display device to display a simulated Class III game outcome that is based on the bingo outcome.

11. The gaming machine of claim 10, wherein the simulated Class III game outcome comprises a slot game outcome.

12. The gaming machine of claim 11, wherein at least one logic device is further configured to receive an indication from a user input device of how many paylines P have been selected and to determine B according to P.

13. The gaming machine of claim 1, wherein S is less than N and wherein the displaying step comprises displaying S bingo card fronts and N-S bingo card backs or blanks.

14. A method of displaying multiple bingo cards, the method comprising:

determining when a player will use B bingo cards in a bingo game, where B is a number greater than a predetermined number N of bingo cards that can simultaneously be displayed in a first area of a first display device;

selecting automatically N of the B bingo cards to be displayed in the first area;

displaying N automatically selected bingo cards in the first area and ascertaining when a player will use S bingo cards, where S is less than or equal to N, and, when the player will use S bingo cards, further comprising the step of displaying the S bingo cards in the first area.

15. The method of claim 14, wherein the selecting step comprises selecting N bingo cards that were most recently selected by a player.

16. The method of claim 15, wherein the displaying step comprises:

displaying the N bingo cards on N corresponding sides of a bingo card carousel;

displaying a side view of the bingo card carousel; and rotating the bingo card carousel such that N most recently selected bingo cards are always in view.

17. The method of claim 14, further comprising the step of providing a graphical user interface ("GUI") in a second area of the first display device, the GUI configured to allow selection of bingo cards.

18. The method of claim 14, wherein the selecting step comprises selecting N bingo cards having the highest-ranking patterns after bingo numbers have been selected during a bingo game.

19. The method of claim 14, wherein the displaying step comprises displaying the N bingo cards on N corresponding three-dimensional surfaces.

20. The method of claim 19, wherein the N corresponding three-dimensional surfaces are sides of a bingo card carousel, and wherein the displaying step comprises displaying a side view of the bingo card carousel.

21. The method of claim 14, wherein the displaying step comprises displaying all B bingo cards in a second area of the first display device.

22. The method of claim 14, wherein the displaying step comprises displaying selected bingo numbers in a third area of the first display device.

23. The method of claim 14, further comprising:

displaying a bingo outcome of a bingo game in at least the first area of the first display device; and displaying a simulated Class III game outcome that is based on the bingo outcome.

24. The method of claim 23, wherein the simulated Class III game outcome is displayed on a second display device.

25. The method of claim 23, wherein the simulated Class III game outcome comprises a slot game outcome.

26. The method of claim 25, further comprising:

receiving an indication of how many paylines P have been selected; and determining B according to P.

27. The method of claim 25, wherein a number of paylines of the slot game corresponds with B.

28. The method of claim 14, wherein S is less than N and wherein the displaying step comprises displaying S bingo card fronts and N-S bingo card backs or blanks.

29. Software stored in a non-transitory machine-readable medium, the software including stored instructions which, when executed by a gaming machine, control the gaming machine to perform the following steps:

determine when a player will use B bingo cards in a bingo game, where B is a number greater than a predetermined number N of bingo cards that can simultaneously be displayed in a first area of a first display device;

select, when a playing will use B bingo cards, N of the B bingo cards to be displayed in the first area; and display N selected bingo cards in the first area controlling the gaming machine to ascertain when a player will use S bingo cards, where S is less than or equal to N, and, when the player will use S bingo cards, display the S bingo cards in the first area.

30. The software of claim 29, further comprising instructions for controlling the gaming machine to display the N bingo cards on N corresponding three-dimensional surfaces.

31. The software of claim 29, further comprising instructions for controlling the gaming machine to display all B bingo cards in a second area of the first display device.

32. The software of claim 29, further comprising instructions for controlling the gaming machine to display a bingo outcome of a bingo game in at least the first area of the first display device and to display a simulated Class III game outcome that is based on the bingo outcome on a second display device.

33. The software of claim 32, wherein the simulated Class III game outcome comprises a slot game outcome.

34. The software of claim 33, further comprising instructions for controlling the gaming machine to receive an indication of how many paylines P have been selected and to determine B according to P.

35. The software of claim 29, further comprising instructions for controlling the gaming machine to do the following:

display the N bingo cards on N corresponding sides of a simulated bingo card carousel;

display a side view of the simulated bingo card carousel; and rotate the simulated bingo card carousel such that N most recently selected bingo cards are always in view.

36. The software of claim 29, wherein the N corresponding three-dimensional surfaces are sides of a bingo card carousel, and wherein the displaying step comprises displaying a side view of the bingo card carousel.

* * * * *